United States Patent [19]

Kofron et al.

[11] 4,439,520

[45] Mar. 27, 1984

[54] SENSITIZED HIGH ASPECT RATIO SILVER HALIDE EMULSIONS AND PHOTOGRAPHIC ELEMENTS

[75] Inventors: James T. Kofron, Rochester; Robert E. Booms, Churchville; Cynthia G. Jones, Bergen; John A. Haefner, Webster; Herbert S. Wilgus, Conesus; Francis J. Evans, Rochester, all of N.Y.

[73] Assignee: Eastman Kodak Company, Rochester, N.Y.

[21] Appl. No.: 429,407

[22] Filed: Sep. 30, 1982

Related U.S. Application Data

[63] Continuation-in-part of Ser. No. 320,904, Nov. 12, 1981, abandoned.

[51] Int. Cl.[3] ..... G03C 1/04; G03C 1/12; G03C 1/46; G03C 7/26

[52] U.S. Cl. ..... 430/434; 430/495; 430/496; 430/502; 430/503; 430/567; 430/564; 430/569; 430/570; 430/599; 430/603; 430/605

[58] Field of Search ..... 430/567, 569, 564, 599, 430/570, 603, 605, 502, 495, 496, 503, 434

[56] References Cited

U.S. PATENT DOCUMENTS

| | | | |
|---|---|---|---|
| 2,221,805 | 11/1940 | Leermaker | 430/575 |
| 2,222,264 | 11/1940 | Nietz et al. | 430/603 |
| 2,344,084 | 3/1944 | Gaspar | 430/375 |
| 2,388,859 | 11/1945 | Mannes et al. | 430/571 |
| 2,456,954 | 12/1948 | Knott et al. | 430/409 |
| 2,642,361 | 6/1953 | Damschroder et al. | 430/603 |
| 3,320,069 | 5/1967 | Illingsworth | 430/603 |
| 3,402,046 | 9/1968 | Zwick | 430/504 |
| 3,894,871 | 7/1975 | Land | 430/228 |
| 4,063,951 | 12/1977 | Bogg | 430/567 |
| 4,067,739 | 1/1978 | Lewis | 430/567 |
| 4,150,994 | 4/1979 | Maternaghan | 430/567 |
| 4,184,877 | 1/1980 | Maternaghan | 430/567 |
| 4,184,878 | 1/1980 | Maternaghan | 430/567 |

FOREIGN PATENT DOCUMENTS

| | | |
|---|---|---|
| 2905655 | 2/1979 | Fed. Rep. of Germany . |
| 2921077 | 5/1979 | Fed. Rep. of Germany . |
| 55-142329 | 11/1980 | Japan . |
| 1560963 | 2/1980 | United Kingdom . |
| 1570581 | 2/1980 | United Kingdom . |

OTHER PUBLICATIONS

Evans, Hedges and Mitchell, "Further Contribution to the Theory of Photographic Sensitivity", Journal of Photographic Science, vol. 3, pp. 73–87, (1955).

Shiozawa, "Electron Microscopic Study on Conversion of Silver Halides, I Effect of PEO on Conversion of AgBr to AgI", Bulletin of the Society of Photographic Science and Technology of Japan, No. 22, pp. 6–13, (1972).

Gutoff, "Nucleation and Growth Rates During the Precipitation of Silver Halide Photographic Emulsions", *Photographic Sciences and Engineering*, vol. 14, No. 4, Jul.–Aug. 1970, pp. 248–257.

Mees and James, *The Theory of the Photographic Process*, Third Edition, pp. 75 and 76, 233, 234, 251, 252.

Leermakers, Carroll and Staud, *J. Chem. Phys.*, vol. 5, No. 1–12, p. 894.

Ullmans, *Encyklopadie de Technischen Chemie*, Band 18, Photographie, Section 3.2.1, pp. 425 and 426, (1979).

Farnell, The Relationship Between Speed and Grain Size, *The Journal of Photographic Science*, vol. 17, 1969, pp. 116–125.

(List continued on next page)

*Primary Examiner*—Mary F. Downey

*Attorney, Agent, or Firm*—Carl O. Thomas

[57] ABSTRACT

High aspect ratio chemically and spectrally sensitized tabular grain silver halide emulsions, photographic elements incorporating these emulsions, and processes for the use of the photographic elements are disclosed. In the tabular grain emulsions the silver halide grains having a thickness of less than 0.3 micron and a diameter of at least 0.6 micron have a high aspect ratio and account for at least 50 percent of the total projected area of the silver halide grains present.

64 Claims, 9 Drawing Figures

OTHER PUBLICATIONS

Tani, Factors Influencing Photographic Sensitivity, *J. Soc. Photogr. Sci. Technol.*, Japan, vol. 43, No. 6, 1980, pp. 335–346.

Zelikman and Levi, *Making and Coating Photographic Emulsions,* Focal Press, 1964, pp. 221–223.

Carroll, MacWilliam and Henrickson, The Effect of Chemical Sensitization on Spectral Sensitization, *Photographic Science and Engineering,* vol. 5, No. 4, Jul.–Aug. 1961.

Mees, *Theory of the Photographic Process,* First Edition, p. 962.

Item 13452, *Research Disclosure,* vol. 134, Jun. 1975.

deCugnac and Chateau, "Evolution of the Morphology of Silver Bromide Crystals During Physical Ripening", *Science et Industries Photographiques,* vol. 33, No. 2, (1962), pp. 121–125.

Duffin, *Photographic Emulsion Chemistry,* Focal Press, 1966, pp. 66–72.

Trivelli and Smith, "The Effect of Silver Iodide Upon the Structure of Bromo–Iodide Precipitation Series", *The Photographic Journal,* vol. LXXX, Jul. 1940, pp. 285–288.

SENSITIZED HIGH ASPECT RATIO SILVER HALIDE EMULSIONS AND PHOTOGRAPHIC ELEMENTS

FIELD OF THE INVENTION

The invention relates to silver halide photography and specifically to radiation-sensitive emulsions and photographic elements containing silver halide as well as to processes for the use of the photographic elements.

BACKGROUND OF THE INVENTION

Photography, since its emergence as a practical art in the last half of the ninteenth century, has relied upon elements containing radiation-sensitive silver halide to serve a wide range of imaging needs. As compared to available imaging alternatives, silver halide photographic elements exhibit a combination of very advantageous properties, including higher speed and better image definition. Further, silver halide photographic elements are virtually unique in their highly refined capability for accurately reproducing multicolor images.

Over the last century silver halide photographic elements have retained their prominent position in the photographic industry by reason of intensive and painstaking investigations, both theoretically and empirically based, aimed at better understanding and improving photographic capabilities. Extensive academic and industrial research has been devoted to the improvement of silver halide photographic elements, and thousands of patents have been issued, attesting to the vigor with which improvement has been pursued.

a. Speed, granularity, and sensitization

Silver halide photography employs radiation-sensitive emulsions comprised of a dispersing medium, typically gelatin, containing embedded microcrystals—known as grains—of radiation-sensitive silver halide. During imagewise exposure a latent image center, rendering an entire grain selectively developable, can be produced by absorption of only a few quanta of radiation, and it is this capability that imparts to silver halide photography exceptional speed capabilities as compared to many alternative imaging approaches.

The sensitivity of silver halide emulsions has been improved by sustained investigation for more than a century. A variety of chemical sensitizations, such as noble metal (e.g., gold), middle chalcogen (e.g., sulfur and/or selenium), and reduction sensitizations, have been developed which, singly and in combination, are capable of improving the sensitivity of silver halide emulsions. When chemical sensitization is extended beyond optimum levels, relatively small increases in speed are accompanied by sharp losses in image discrimination (maximum density minus minimum density) resulting from sharp increases in fog (minimum density). Optimum chemical sensitization is the best balance among speed, image discrimination, and minimum density for a specific photographic application.

Usually the sensitivity of the silver halide emulsions is only negligibly extended beyond their spectral region of intrinsic sensitivity by chemical sensitization. The sensitivity of silver halide emulsions can be extended over the entire visible spectrum and beyond by employing spectral sensitizers, typically methine dyes. Emulsion sensitivity beyond the region of intrinsic sensitivity increases as the concentration of spectral sensitizer increases up to an optimum and generally declines rapidly thereafter. (See Mees, *Theory of the Photographic Process,* Macmillan, 1942, pp. 1067–1069, for background.)

Within the range of silver halide grain sizes normally encountered in photographic elements the maximum speed obtained at optimum sensitization increases linearly with increasing grain size. The number of absorbed quanta necessary to render a grain developable is substantially independent of grain size, but the density that a given number of grains will produce upon development is directly related to their size. If the aim is to produce a maximum density of 2, for example, fewer grins of 0.4 micron as compared to 0.2 micron in average diameter are required to produce that density. Less radiation is required to render fewer grains developable.

Unfortunately, because the density produced with the larger grains is concentrated at fewer sites, there are greater point-to-point fluctuations in density. The viewer's perception of point-to-point fluctuations in density is termed "graininess". The objective measurement of point-to-point fluctuations in density is termed "granularity". While quantitative measurements of granularity have taken different forms, granularity is most commonly measured as rms (root mean square) granularity, which is defined as the standard deviation of density within a viewing microaperture (e.g., 24 to 48 microns). Once the maximum permissible granularity (also commonly referred to as grain, but not to be confused with silver halide grains) for a specific emulsion layer is identified, the maximum speed which can be realized for that emulsion layer is also effectively limited.

From the foregoing it can be appreciated that over the years intensive investigation in the photographic art has rarely been directed toward obtaining maximum photographic speed in an absolute sense, but, rather, has been directed toward obtaining maximum speed at optimum sensitization while satisfying practical granularity or grain criteria. True improvements in silver halide emulsion sensitivity allow speed to be increased without increasing granularity, granularity to be reduced without decreasing speed, or both speed and granularity to be simultaneously improved. Such sensitivity improvement is commonly and succinctly referred to in the art as improvement in the speed-granularity relationship of an emulsion.

In FIG. 1 a schematic plot of speed versus granularity is shown for five silver halide emulsions 1, 2, 3, 4, and 5 of the same composition, but differing in grain size, each similarly sensitized, identically coated, and identically processed. While the individual emulsions differ in maximum speed and granularity, there is a predictable linear relationship between the emulsions, as indicated by the speed-granularity line A. All emulsions which can be joined along the line A exhibit the same speed-granularity relationship. Emulsions which exhibit true improvements in sensitivity lie above the speed-granularity line A. For example, emulsions 6 and 7, which lie on the common speed-granularity line B, are superior in their speed-granularity relationships to any one of the emulsions 1 through 5. Emulsion 6 exhibits a higher speed than emulsion 1, but no higher granularity. Emulsion 6 exhibits the same speed as emulsion 2, but at a much lower granularity. Emulsion 7 is of higher speed than emulsion 2, but is of a lower granularity than emulsion 3, which is of lower speed than emulsion 7. Emulsion 8, which falls below the speed-granularity line A, exhibits the poorest speed-granularity relationship shown in FIG. 1. Although emulsion 8 exhibits the highest photographic speed of any of the emulsions, its speed is realized only at a disproportionate increase in granularity.

The importance of speed-granularity relationship in photography has led to extensive efforts to quantify and generalize speed-granularity determinations. It is normally a simple matter to compare precisely the speed-granularity relationships of an emulsion series differing by a single characteristic, such as silver halide grain size. The speed-granularity relationships of photographic products which produce similar characteristic curves are often compared. However, universal quantitative speed-granularity comparisons of photographic elements have not been achieved, since speed-granularity comparisons become increasingly judgmental as other photographic characteristics differ. Further, comparisons of speed-granularity relationships of photographic elements which produce silver images (e.g., black-and-white photographic elements) with those which produce dye images (e.g., color and chromogenic photographic elements) involve numerous considerations other than the silver halide grain sensitivites, since the nature and origin of the materials producing density and hence accounting for granularity are much different. For elaboration of granularity measurements in silver and dye imaging attention is directed to "Understanding Graininess and Granularity", Kodak Publication No. F-20, Revised 11-79 (available from Eastman Kodak Company, Rochester, New York 14650); Zwick, "Quantitative Studies of Factors Affecting Granularity", *Photographic Science and Engineering,* Vol. 9, No. 3, May-June, 1965; Ericson and Marchant, "RMS Granularity of Monodisperse Photographic Emulsions", *Photographic Science and Engineering,* Vol. 16, No. 4, July-August 1972, pp. 253–257; and Trabka, "A Random-Sphere Model for Dye Clouds", *Photographic Science and Engineering,* Vol. 21, No. 4, July-August 1977, pp. 183–192.

Silver halide emulsions other than silver bromoiodides find limited use in camera speed photographic elements. A silver bromoiodide emulsion having outstanding silver imaging (black-and-white) speed-granularity properties is illustrated by Illingsworth U.S. Pat. No. 3,320,069, which discloses gelatino-silver bromoiodide emulsions in which the iodide preferably comprises from 1 to 10 mole percent of the halide. (Except as otherwise indicated, all references to halide percentages are based on silver present in the corresponding emulsion, grain, or grain region being discussed; e.g., a grain consisting of silver bromoiodide containing 40 mole percent iodide also contains 60 mole percent bromide.) The emulsion is sensitized with a sulfur, selenium, or tellurium sensitizer. The emulsion, when coated on a support at a silver coverage of between 300 and 1000 mg per square foot (0.0929 $m^2$) and exposed on an intensity scale sensitometer, and processed for 5 minutes in Kodak Developer DK-50® (an N-methyl-p-aminophenol sulfate-hydroquinone developer) at 20° C. (68° F.), has a log speed of 280–400 and a remainder (resulting from subtracting its granularity value from its log speed) of between 180 and 220. Gold is preferably employed in combination with the sulfur group sensitizer, and thiocyanate may be present during silver halide precipitation or, if desired, may be added to the silver halide at any time prior to washing. (Uses of thiocyanate during silver halide precipitation and sensitization are illustrated by Leermakers U.S. Pat. No. 2,221,805, Nietz et al U.S. Pat. No. 2,222,264, and Damschroder U.S. Pat. No. 2,642,361.) The Illingsworth emulsions also provide outstanding speed-granularity properties in color photography, although quantitative values for dye image granularity are not provided.

In a few instances the highest attainable photographic speeds have been investigated at higher than the normally useful levels of granularity. Farnell, "The Relationship Between Speed and Grain Size", *The Journal of Photographic Science,* Vol. 17, 1969, pp. 116–125, reports blue-speed investigations of silver bromide and bromoiodide emulsions in the absence of spectral sensitization. The author observed that with grain sizes greater than about 0.5 micron$^2$ in projected area (0.8 micron in diameter) no further increase in speed with increasing grain size, as expected based on the assumption that the number of absorbed quanta required for developability is independent of grain size, was observed. Actual declines in speed as a function of increasing grain size are reported. Farnell attributes the decline in sensitivity of large grains to their large size in relation to the limited average diffusion distance of photo-generated electrons which are required to produce latent image sites, since it is the proximity of a few atoms of $Ag^{\circ}$ produced by capture of photo-generated electrons that produces a latent image site.

Tani, "Factors Influencing Photographic Sensitivity", *J. Soc. Photogr. Sci. Technol. Japan,* Vol. 43, No. 6, 1980, pp. 335–346, is in agreement with Farnell and extends the discussion of reduced sensitivity of larger silver halide grains to additional causes attributable to the presence of spectral sensitizing dye. Tani reports that the sensitivity of spectrally sensitized emulsion is additionally influenced by (1) the relative quantum yield of spectral sensitization, (2) dye desensitization, and (3) light absorption by dyes. Tani notes that the relative quantum yield of spectral sensitization has been observed to be near unity and therefore not likely to be practically improved. Tani notes that light absorption by grains covered by dye molecules is proportional to grain volume when exposed to blue light and to grain surface area when the grain is exposed to minus-blue light. Thus, the magnitude of the increase in minus-blue sensitivity is, in general, smaller than the increase in blue sensitivity when the size of emulsion grains is increased. Attempts to increase light absorption by merely increasing dye coverage does not necessarily result in increased sensitivity, because dye desensitization increases as the amount of dye is increased. Desensitization is attributed to reduced latent image formation rather than reduced photo-generation of electrons. Tani suggests possible improvements in the speed-granularity relationship of larger silver halide grains by preparing core-shell emulsions to avoid desensitization. Internal doping of silver halide grains to allow the use of otherwise desensitizing dye levels is taught by Gilman et al U.S. Pat. No. 3,979,213.

b. Sharpness

While granularity, because of its relationship to speed, is often a focal point of discussion relating to image quality, image sharpness can be addressed independently. Some factors which influence image sharpness, such as lateral diffusion of imaging materials during processing (sometimes termed "image smearing"), are more closely related to imaging and processing materials than the silver halide grains. On the other hand, because of their light scattering properties, silver halide grains themselves primarily affect sharpness during imagewise exposure. It is known in the art that silver halide grains having diameters in the range of from 0.2 to 0.6 micron exhibit maximum scattering of visible light.

Loss of image sharpness resulting from light scattering generally increases with increasing thickness of a silver halide emulsion layer. The reason for this can be appreciated by reference to FIG. 2. If a photon of light 1 is deflected by a silver halide grain at a point 2 by an angle $\theta$ measured as a declination from its original path and is thereafter absorbed by a second silver halide grain at a point 3 after traversing a thickness $t^1$ of the emulsion layer, the photographic record of the photon is displaced laterally by a distance x. If, instead of being absorbed within a thickness $t^1$, the photon traverses a second equal thickness $t^2$ and is absorbed at a point 4, the photographic record of the photon is displaced laterally by twice the distance x. It is therefore apparent that the greater the thickness displacement of the silver halide grains in a photographic element, the greater the risk of reduction in image sharpness attributable to light scattering. (Although FIG. 2 illustrates the principle in a very simple situation, it is appreciated that in actual practice a photon is typically reflected from several grains before actually being absorbed and statistical methods are required to predict its probable ultimate point of absorption.)

In multicolor photographic elements containing three or more superimposed silver halide emulsion layers an increased risk of reduction in image sharpness can be presented, since the silver halide grains are distributed over at least three layer thicknesses. In some applications thickness displacement of the silver halide grains is further increased by the presence of additional materials that either (1) increase the thicknesses of the emulsion layers themselves—as where dye-image-providing materials, for example, are incorporated in the emulsion layers or (2) form additional layers separating the silver halide emulsion layers, thereby increasing their thickness displacement—as where separate scavenger and dye-image-providing material layers separate adjacent emulsion layers. Further, in multicolor photographic elements there are at least three superimposed layer units, each containing at least one silver halide emulsion layer. Thus, there is a substantial opportunity for loss of image sharpness attributable to scattering. Because of the cumulative scattering of overlying silver halide emulsion layers, the emulsion layers farther removed from the exposing radiation source can exhibit very significant reductions in sharpness.

Zwick U.S. Pat. No. 3,402,046 discusses obtaining crisp, sharp images in a green-sensitive emulsion layer of a multicolor photographic element. The green-sensitive emulsion layer lies beneath a blue-sensitive emulsion layer, and this relationship accounts for a loss in sharpness attributable to the green-sensitive emulsion layer. Zwick reduces light scattering by employing in the overlying blue-sensitive emulsion layer silver halide grains which are at least 0.7 micron, preferably 0.7 to 1.5 microns, in average diameter, which is in agreement with the 0.6 micron diameter referred to above.

c. Blue and minus-blue speed separation

Silver bromide and silver bromoiodide emulsions possess sufficient native sensitivity to the blue portion of the spectrum to record blue radiation without blue spectral sensitization. When these emulsions are employed to record green and/or red (minus blue) light exposures, they are correspondingly spectrally sensitized. In black-and-white and monochromatic (e.g. chromogenic) photography the resulting orthochromatic or panchromatic sensitivity is advantageous.

In multicolor photography, the native sensitivity of silver bromide and silver bromoiodide in emulsions intended to record blue light is advantageous. However, when these silver halides are employed in emulsion layers intended to record exposures in the green or red portion of the spectrum, the native blue sensitivity is an inconvenience, since response to both blue and green light or both blue and red light in the emulsion layers will falsify the hue of the multicolor image sought to be reproduced.

In constructing multicolor photographic elements using silver bromide or silver bromoiodide emulsions the color falsification can be analyzed as two distinct concerns. The first concern is the difference between the blue speed of the green or red recording emulsion layer and its green or red speed. The second concern is the difference between the blue speed of each blue recording emulsion layer and the blue speed of the corresponding green or red recording emulsion layer. Generally in preparing a multicolor photographic element intended to record accurately image colors under daylight exposure conditions (e.g., 5500°K.) the aim is to achieve a difference of about an order of magnitude between the blue speed of each blue recording emulsion layer and the blue speed of the corresponding green or red recording emulsion layer. The art has recognized that such aim speed differences are not realized using silver bromide or silver bromoiodide emulsions unless employed in combination with one or more approaches known to ameliorate color falsification. Even then, full order of magnitude speed differences have not always been realized in product. However, even when such aim speed differences are realized, further increasing the separation between blue and minus blue speeds will further reduce the recording of blue exposures by layers intended to record minus blue exposures.

By far the most common approach to reducing exposure of red and green spectrally sensitized silver bromide and silver bromoiodide emulsion layers to blue light, thereby effectively reducing their blue speed, is to locate these emulsion layers behind a yellow (blue absorbing) filter layer. Both yellow filter dyes and yellow colloidal silver are commonly employed for this purpose. In a common multicolor layer format all of the emulsion layers are silver bromide or bromoiodide. The emulsion layers intended to record green and red exposures are located behind a yellow filter while the emulsion layer or layers intended to record blue light are located in front of the filter layer. (For specific examples refer to U.S. Patent and Trademark Office Class 430, Photographic Chemistry, subclass 507.)

This arrangement has a number of art-recognized disadvantages. While blue light exposure of green and red recording emulsion layers is reduced to tolerable levels, a less than ideal layer order arrangement is imposed by the use of a yellow filter. The green and red emulsion layers receive light that has already passed through both the blue emulsion layer or layers and the yellow filter. This light has been scattered to some extent, and image sharpness can therefore be degraded. Since the blue recording emulsion produces by far the least visually important record, its favored location nearest the source of exposing radiation does not contribute to image sharpness to the degree that would be realized by similar placement of the red or green emulsion layer. Further, the yellow filter is itself imperfect and actually absorbs to a slight extent in the green portion of the spectrum, which results in a loss of green speed. The yellow filter material, particularly where it is yellow colloidal silver, increases materials cost and accelerates required replacement of processing solutions, such as bleaching and bleach-fixing solutions.

Still another disadvantages associated with separating the blue emulsion layer or layers of a photographic element from the red and green emulsion layers by interposing a yellow filter is that the speed of the blue emulsion layer is decreased. This is because the yellow filter layer absorbs blue light passing through the blue emulsion layer or layers that might otherwise be reflected to enhance exposure. One approach for increasing speed is to move the yellow filter layer so that it does not lie immediately below the blue emulsion. This is taught by Lohmann et al U.K. Pat. No. 1,560,963; however, the patent admits that blue speed enhancement is achieved only at the price of impaired color reproduction in the green and red sensitized emulsion layers lying above the yellow filter layer.

A number of approaches have been suggested for eliminating yellow filters, but each has produced its own disadvantages. Gaspar U.S. Pat. No. 2,344,084 teaches locating a green or red spectrally sensitized silver chloride or chlorobromide layer nearest the exposing radiation source, since these silver halides exhibit only negligible native blue sensitivity. Since silver bromide possesses high native blue sensitivity, it does not form the emulsion layer nearest the exposing radiation source, but forms an underlying emulsion layer intended to record blue light.

Mannes et al U.S. Pat. No. 2,388,859 and Knott et al U.S. Pat. No. 2,456,954 teach avoiding blue light contamination of the green and red recording emulsion layers by making these layers 50 or 10 times slower, respectively, then the blue recording emulsion layer. The emulsion layers are overcoated with a yellow filter to obtain a match in sensitivities of the blue, green, and red recording emulsion layers to blue, green, and red light, respectively, and to increase the separation of the blue and minus blue speeds of the minus blue recording emulsion layers.

This approach allows the emulsion layers to be coated in any desired layer order arrangement, but retains the disadvantage of employing a yellow filter as well as additional disadvantages. In order to obtain the sensitivity differences in the blue and minus blue recording emulsion layers without the use of a yellow filter layer to implement the teachings of Mannes et al and Knott et al relatively much larger silver bromide or bromoiodide grains are employed in the blue recording emulsion layer. Attempts to obtain the desired sensitivity differences relying on differences in grain size alone cause the blue emulsion layers to be excessively grainy and/or the grain size of the minus blue recording emulsion layers to be excessively small and therefore of relatively low speed. To ameliorate this difficulty it is known to increase the proportion of iodide in the grains of the blue recording emulsion layer, thereby increasing its blue sensitivity without increasing its grain size. Still, if the minus blue recording emulsion layers are to exhibit more than very moderate photographic speeds, obtaining blue recording emulsion layers of at least 10 times greater speed is not possible within normally acceptable levels of grain, even with increased iodide in the blue recording emulsion layer.

While yellow filters are employed to reduce blue light striking underlying emulsion layers, they by no means eliminate the transmission of blue light. Thus, even when yellow filters are employed, additional benefits can be realized by the further separation of blue and minus blue sensitivities of silver bromide and bromoiodide emulsion layers intended to record in the minus blue portion of the spectrum.

Although silver chloride and chlorobromide emulsions can be put to use as minus blue recording layers in multicolor photographic elements without yellow filter protection, as suggested by Gaspar, cited above, it should be realized that these emulsions also absorb blue radiation, albeit at reduced levels. There are applications where even the small levels of absorption in the blue portion of the spectrum (often referred to as "tail absorption") of these silver chloride-containing emulsions can be disadvantageous. For example, if it is desired to imagewise expose a camera speeds a photographic element having at silver chloride emulsion layer to radiation outside of the blue portion of the spectrum (e.g., green, red, or infrared) and thereafter process the photographic element in the presence of blue light, the emulsion layers can exhibit sufficient native blue sensitivity to increase in background density or fog as a result of work area lighting. Although the blue sensitivity of the chloride-containing emulsion is only a small fraction of its sensitivity to the radiation employed during imagewise exposure, the duration of exposure to process light is much, much longer. Hence even silver chloride and chlorobromide emulsions can benefit by reduction of their blue sensitivity in relation to their sensitivity in another spectral region.

d. Tabular silver halide grains

A variety of regular and irregular grain shapes have been observed in silver halide photographic emulsions. Regular grains are often cubic or octahedral. Grain edges can exhibit rounding due to ripening effects, and in the presence of strong ripening agents, such as ammonia, the grains may even be spherical or near spherical thick platelets, as described, for example by Land U.S. Pat. No. 3,894,871 and Zelikman and Levi *Making and Coating Photographic Emulsions,* Focal Press, 1964, pp. 221–223. Rods and tabular grains in varied portions have been frequently observed mixed in among other grain shapes, particularly where the pAg (the negative logarithm of silver ion concentration) of the emulsions has been varied during precipitation, as occurs, for example in single-jet precipitations.

Tabular silver bromide grains have been extensively studied, often in macro-sizes having no photographic utility. Tabular grains are herein defined as those having two substantially parallel crystal faces, each of which is substantially larger than any other single crystal face of the grain. The term "substantially parallel" as used herein is intended to include surfaces that appear parallel on direct or indirect visual inspection at 10,000 times magnification. The aspect ratio—that is, the ratio of diameter to thickness—of tabular grains is substantially greater than 1:1. High aspect ratio tabular grain silver bromide emulsions were reported by de Cugnac and Chateau, "Evolution of the Morphology of Silver Bromide Crystals During Physical Ripening", *Science et Industries Photographiques,* Vol. 33, No. 2 (1962), pp. 121–125.

From 1937 until the 1950's the Eastman Kodak Company sold a Duplitized® radiographic film product under the name No-Screen X-Ray Code 5133. The product contained as coatings on opposite major faces of a film support sulfur sensitized silver bromide emulsions. Since the emulsions were intended to be exposed by X-radiation, they were not spectrally sensitized. The tabular grains had an average aspect ratio in the range of from about 5 to 7:1. The tabular grains accounted for greater than 50% of the projected area while nontabular grains accounted for greater than 25% of the projected area. The emulsion having the highest average aspect ratio, chosen from several remakes, had an average tabular grain diameter of 2.5 microns, an average tabular grain thickness of 0.36 micron, and an average aspect ratio of 7:1. In other remakes the emulsions contained thicker, smaller diameter tabular grains which were of lower average aspect ratio.

Although tabular grain silver bromoiodide emulsions are known in the art, none exhibit a high average aspect ratio. A discussion of tabular silver bromoiodide grains appears in Duffin, *Photographic Emulsion Chemistry,* Focal Press, 1966, pp. 66–72, and Trivelli and Smith, "The Effect of Silver Iodide Upon the Structure of Bromo-Iodide Precipitation Series", *The Photographic Journal,* Vol. LXXX, July 1940, pp. 285–288. Trivelli and Smith observed a pronounced reduction in both grain size and aspect ratio with the introduction of iodide. Gutoff, "Nucleation and Growth Rates During the Precipitation of Silver Halide Photographic Emulsions", *Photographic Sciences and Engineering,* Vol. 14, No. 4, July-August 1970, pp. 248–257, reports preparing silver bromide and silver bromoiodide emulsions of the type prepared by single-jet precipitations using a continuous precipitation apparatus.

Bogg, Lewis, and Maternaghan have recently published procedures for preparing emulsions in which a major proportion of the silver halide is present in the form of tabular grains. Bogg U.S. Pat. No. 4,063,951 discloses forming silver halide crystals of tabular habit bounded by {100} cubic faces and having an aspect ratio (based on edge length) of from 1.5 to 7:1. The tabular grains exhibit square and rectangular major surfaces characteristic of {100} crystal faces. Lewis U.S. Pat. No. 4,067,739 discloses the preparation of silver halide emulsions wherein most of the crystals are of the twinned octahedral type by forming seed crystals, causing the seed crystals to increase in size by Ostwald ripening, and completing grain growth without renucleation or Ostwald ripening while controlling pBr (the negative logarithm of bromide ion concentration). Maternaghan U.S. Pat. Nos. 4,150,994, 4,184,877, and 4,184,878, U.K. Pat. No. 1,570,581, and German OLS publications Nos. 2,905,655 and 2,921,077 teach the formation of silver halide grains of flat twinned octahedral configuration by employing seed crystals which are at least 90 mole percent iodide. Lewis and Maternaghan report increased covering power. Maternaghan states that the emulsions are useful in camera films, both black-and-white and color. Bogg specifically reports an upper limit on aspect ratios to 7:1, but, from the very low aspect ratios obtained by the example (2:1), the 7:1 aspect ratio appears unrealistically high. It is clear from repeating examples and viewing the photomicrographs published that the aspect ratios realized by Lewis and Maternaghan were also less than 7:1. Japanese Pat. Kokai No. 142,329, published Nov. 6, 1980, appears to be essentially cumulative with Maternaghan, but is not restricted to the use of silver iodide seed grains.

SUMMARY OF THE INVENTION

In one aspect this invention is directed to a radiation-sensitive high aspect ratio tubular grain silver halide emulsion comprised of a dispersing medium and silver halide grains, wherein at least 50 percent of the total projected area of the silver halide grains is provided by chemically and spectrally sensitized tubular silver halide grains having a thickness of less than 0.3 micron, a diameter of at least 0.6 micron, and an average aspect ratio of greater than 8:1.

In another aspect, this invention is directed to a photographic element comprised of a support and at least one radiation-sensitive emulsion layer comprised of a radiation-sensitive emulsion as described above.

In still another aspect, this invention is directed to producing a visible photographic image by processing in an aqueous alkaline solution in the presence of a developing agent an imagewise exposed photographic element as described above.

The present invention offers significant improvements over the prior state of the art. Sharpness of photographic images can be improved by employing emulsions according to the present invention, particularly those of large average grain diameters. When spectrally sensitized outside the portion of the spectrum to which they possess native sensitivity, the emulsions of the present invention exhibit a large separation in their sensitivity in the region of the spectrum to which they possess native sensitivity, as compared to the region of the spectrum to which they are spectrally sensitized. Minus blue sensitized silver bromide and silver bromoiodide emulsions according to the invention are much less sensitive to blue light than to minus blue light and do not require filter protection to provide acceptable minus blue exposure records when exposed to neutral light, such as daylight at 5500° K. The emulsions of the present invention, particularly the silver bromide and silver bromoiodide emulsions, exhibit improved speed-granularity relationships as compared to previously known tabular grain emulsions and as compared to the best speed-granularity relationships heretofore achieved with silver halide emulsions of like halide content generally. Very large increases in blue speed of the silver bromide and silver bromoiodide emulsions of the present invention have been realized as compared to their native blue speed when blue spectral sensitizers are employed.

Abbott and Jones U.S. Ser. No. 430,222, filed concurrently herewith and commonly assigned, titled *Radiographic Elements Exhibiting Reduced Crossover,* which is a continuation-in-part of U.S. Ser. No. 320,907, filed Nov. 12, 1981, now abandoned, discloses the use of emulsions according to the present invention in radiographic elements coated on both major surfaces of a radiation transmitting support to control crossover. Comparisons of radiographic elements containing emulsions according to this invention with similar radiographic elements containing conventional emulsions show that reduced crossover can be attributed to the emulsions of the present invention. Alternatively, comparable crossover levels can be achieved with the emulsions of the present invention using reduced silver coverages.

Jones and Hill U.S. Pat. No. 430,092, filed concurrently herewith and commonly assigned, tilted *Photographic Image Transfer Film Unit,* which is a continuation-in-part of U.S. Ser. No. 320,911, filed Nov. 12, 19981, now abandoned, discloses image transfer film units containing emulsions according to the present invention. The image transfer film units are capable of achieving a higher ratio of photographic speed to silver coverage (i.e., silver halide coated per unit area), faster access to a viewable transferred image, and higher contrast of transferred images with less time of development.

Although the invention has been described with reference to certain specific advantages, other advantages will become apparent in the course of the detailed description of preferred embodiments.

DESCRIPTION OF PREFERRED EMBODIMENTS

Figure 1:
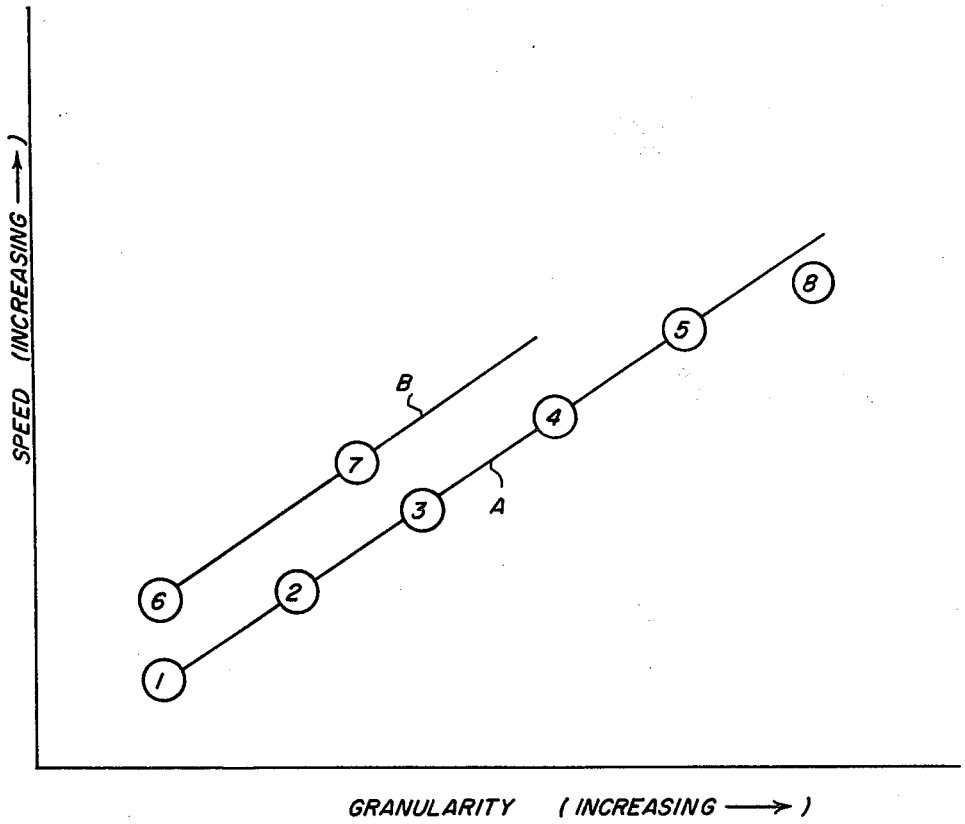
FIGS. 1, 5, 6, 7, 8 and 9 are plots of speed versus granularity.

While subheadings are provided for convenience, to appreciate fully the features of the invention it is intended that the disclosure be read and interpreted as a whole.

a. Tabular emulsions and their preparation

This invention relates to chemically and spectrally sensitized high aspect ratio tabular grain silver halide emulsions, to photographic elements which incorporate these emulsions, and to processes for the use of the photographic elements. As applied to the silver halide emulsions of the present invention the term "high aspect ratio" is herein defined as requiring that the silver halide grains having a thickness of less than 0.3 micron and a diameter of at least 0.6 micron have an average aspect ratio of greater than 8:1 and account for at least 50 percent of the total projected area of the silver halide grains.

The preferred high aspect ratio tabular grain silver halide emulsions of the present invention are those wherein the silver halide grains having a thickness of less than 0.3 micron (optionally less than 0.2 micron) and a diameter of at least 0.6 micron have an average aspect ratio of at least 12:1 and optimally at least 20:1. In a preferred form of the invention these silver halide grains satisfying the above thickness and diameter criteria account for at least 70 percent and optimally at least 90 percent of the total projected area of the silver halide grains.

It is appreciated that the thinner the tabular grains accounting for a given percentage of the projected area, the higher the average aspect ratio of the emulsion. Typically the tabular grains have an average thickness of at least 0.03 micron, although even thinner tabular grains can in principle be employed—e.g., as low as 0.01 micron, depending on halide content. It is recognized that the tabular grains can be increased in thickness to satisfy specialized applications. For example, Jones and Hill, cited above, contemplates the use of tabular grains having thicknesses up to 0.5 micron, since enlargement of transferred images is not normally undertaken. Grain thicknesses of up to 0.5 micron are also discussed below for recording blue light. (For such applications all references to 0.3 micron in reference to aspect ratio determinations should be adjusted to 0.5 micron.) However, to achieve high aspect ratios without unduly increasing grain diameters, it is normally contemplated that the tabular grains of the emulsions of this invention will have an average thickness of less than 0.3 micron.

The grain characteristics described above of the silver halide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each grain and to identify those tabular grains having a thickness of less than 0.3 micron and a diameter of at least 0.6 micron. From this the aspect ratio of each such tabular grain can be calculated, and the aspect ratios of all the tabular grains in the sample meeting the less than 0.3 micron thickness and at least 0.6 micron diameter criteria can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.3 micron and a diameter of at least 0.6 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the tabular silver halide grains meeting the thickness and diameter criteria can be summed, the projected areas of the remaining silver halide grains in the photomicrograph can be summed separately, and from the two sums the percentage of the total projected area of the silver halide grains provided by the tabular grains meeting the thickness and diameter critera can be calculated.

In the above determinations a reference tabular grain thickness of less than 0.3 micron was chosen to distinguish the uniquely thin tabular grains herein contemplated from thicker tabular grains which provide inferior photographic properties. A reference grain diameter of 0.6 micron was chosen, since at lower diameters it is not always possible to distinguish tabular and nontabular grains in micrographs. The term "projected area" is used in the same sense as the terms "projection area" and "projective area" commonly employed in the art; see, for example, James and Higgins, *Fundamentals of Photographic Theory,* Morgan and Morgan, New York, p. 15.

Figure 3:
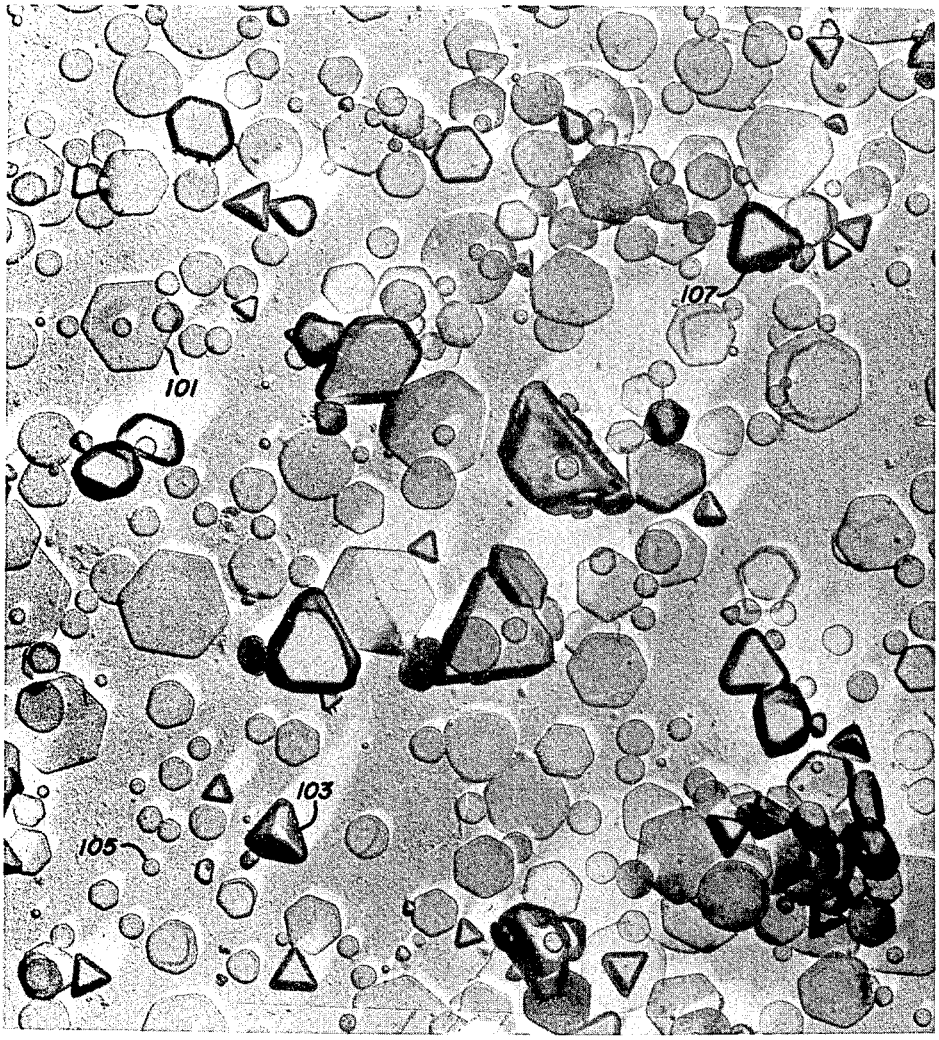
FIG. 3 is a photomicrograph of a high aspect ratio tabular grain emulsion.

FIG. 3 is an exemplary photomicrograph of an emulsion according to the present invention chosen to illustrate the variant grains that can be present. Grain 101 illustrates a tabular grain that satisfies the thickness and diameter criteria set forth above. It is apparent that the vast majority of the grains present in FIG. 3 are tabular grains which satisfy the thickness and diameter critera. These grains exhibit an average aspect ratio of 18:1. Also present in the photomicrograph are a few grains which do not satisfy the thickness and diameter criteria. The grain 103, for example, illustrates a nontabular grain. It is of a thickness greater than 0.3 micron. The grain 105 illustrates a fine grain present that does not satisfy the diameter criterion. The grain 107 illustrates a thick tabular grain that satisfies the diameter criterion, but not the thickness criterion. Depending upon the conditions chosen for emulsion preparation, more specifically discussed below, in addition to the desired tabular silver halide grains satisfying the thickness and diameter criteria, secondary grain populations of largely nontabular grains, fine grains, or thick tabular grains can be present. Occasionally other nontabular grains, such as rods, can be present. While it is generally preferred to maximize the number of tabular grains satisfying the thickness and diameter criteria, the presence of secondary grain populations is specifically contemplated, provided the emulsions remain of high aspect ratio, as defined above.

In a preferred form offering a broad range of observed advantages the present invention employs high aspect ratio silver bromoiodide emulsions. Although the inventors believed that high aspect ratio silver bromoiodide emulsions would be useful in the practice of this invention, such emulsions did not exist in the art. In order to complete this invention in terms of its application to high aspect ratio silver bromoiodide emulsions it was necessary to exercise invention to prepare such emulsions. High aspect ratio silver bromoiodide emulsions and their preparation is the subject of Wilgus and Haefner U.S. Ser. No. 429,420, filed concurrently herewith and commonly assigned, titled *High Aspect Ratio Silver Bromoiodide Emulsions and Processes for Their Preparation,* which is a continuation-in-part of U.S. Ser. No. 320,905, filed Nov. 12, 1981, now abandoned, both of which are here incorporated by reference.

High aspect ratio tabular grain silver bromoiodide emulsions can be prepared by a precipitation process which forms a part of the Wilgus and Haefner invention. Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight based on total weight of the dispersing medium present in the silver bromoiodide emulsion at the conclusion of grain precipitation. Since dispersing medium can be removed from the reaction vessel by ultrafiltration during silver bromoiodide grain precipitation, as taught by Mignot U.S. Pat. No. 4,334,012, here incorporated by reference, it is appreciated that the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introduction of silver and bromide salts favors the formation of thick and nontabular grains. As employed herein, the term "substantially free of iodide ions" as applied to the contents of the reaction vessel means that there are insufficient iodide ions present as compared to bromide ions to precipitate as a separate silver iodide phase. It is preferred to maintain the iodide concentration in the reaction vessel prior to silver salt introduction at less than 0.5 mole percent of the total halide ion concentration present. If the pBr of the dispersing medium is initially too high, the tabular silver bromoiodide grains produced will be comparatively thick and therefore of low aspect ratios. It is contemplated to maintain the pBr of the reaction vessel initially at or below 1.6, preferably below 1.5. On the other hand, if the pBr is too low, the formation of nontabular silver bromoiodide grains is favored. Therefore, it is contemplated to maintain the pBr of the reaction vessel at or above 0.6, preferably above 1.1. (As herein employed, pBr is defined as the negative logarithm of bromide ion concentration. pH, pCl, pI, and pAg are similarly defined for hydrogen, chloride, iodide, and silver ion concentrations, respectively.)

During precipitation silver, bromide, and iodide salts are added to the reaction vessel by techniques well known in the precipitation of silver bromoiodide grains. Typically an aqueous solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the iodide salt. The iodide and bromide salts can be added to the reaction vessel separately or as a mixture.

With the introduction of silver salt into the reaction vessel the nucleation stage of grain formation is initiated. A population of grain nuclei is formed which is capable of serving as precipitation sites for silver bromide and silver iodide as the introduction of silver, bromide, and iodide salts continues. The precipitation of silver bromide and silver iodide onto existing grain nuclei constitutes the growth stage of grain formation. The aspect ratios of the tabular grains formed according to this invention are less affected by iodide and bromide concentrations during the growth stage than during the nucleation stage. It is therefore possible during the growth stage to increase the permissible latitude of pBr during concurrent introduction of silver, bromide, and iodide salts above 0.6, preferably in the range of from about 0.6 to 2.2, most preferably from about 0.8 to about 1.6, the latter being particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing an average aspect ratio of greater than 8:1.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grain size is such that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. (Since bromide and/or iodide is precipitated in preference to chloride, it is also possible to employ silver chlorobromoiodide and silver chlorobromo-iodide grains.) The silver halide grains are preferably very fine—e.g., less than 0.1 micron in mean diameter.

Subject to the pBr requirements set forth above, the concentrations and rates of silver, bromide, and iodide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitschied et al. European Patent Application No. 80102242, and Wey "Growth Mechanism of AgBr Crystals in Gelatin Solution", *Photographic Science and Engineering*, Vol. 21, No. 1, January/February 1977, p. 14, et. seq. By avoiding the formation of additional grain nuclei after passing into the growth stage of precipitation, relatively monodispersed tabular silver bromoiodide grain populations can be obtained. Emulsions having coefficients of variation of less than about 30 percent can be prepared. (As employed herein the coefficient of variation is defined as 100 times the standard deviation of the grain diameter divided by the average grain diameter.) By intentionally favoring renucleation during the growth stage of precipitation, it is, of course, possible to produce polydispersed emulsions of substantially higher coefficients of variation.

The concentration of iodide in the silver bromoiodide emulsions of this invention can be controlled by the introduction of iodide salts. Any conventional iodide concentration can be employed. Even very small amounts of iodide—e.g., as low as 0.05 mole percent—are recognized in the art to be beneficial. In their preferred form the emulsions of the present invention incorporate at least about 0.1 mole percent iodide. Silver iodide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures—e.g., about 30° C. It is generally preferred that precipitation be undertaken at temperatures in the range of from 40° to 80° C. For most photographic applications it is preferred to limit maximum iodide concentrations to about 20 mole percent, with optimum iodide concentrations being up to about 15 mole percent.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Solberg et al. U.S. Ser. No. 431,913, concurrently filed and commonly assigned, titled *Radiation-Sensitive Silver Bromoiodide Emulsions, Photographic Elements, and Processes For Their Use*, which is a continuation-in-part of U.S. Ser. No. 320,909, filed Nov. 12, 1981, now abandoned, has recognized specific photographic advantages to result from increasing the proportion of iodide in annular or otherwise laterally displaced regions of high aspect ratio tabular grain silver bromoiodide emulsions as compared to central regions of the tabular grains. Solberg et al teaches iodide concentrations in the central regions of from 0 to 5 mole percent, with at least one mole percent higher iodide concentrations in the laterally surrounding annular regions up to the solubility limit of silver iodide in silver bromide, preferably up to about 20 mole percent and optimally up to about 15 mole percent. Solberg et al. constitutes a preferred species of the present invention and is here incorporated by reference. In a variant form it is specifically contemplated to terminate iodide or bromide and iodide salt addition to the reaction vessel prior to the termination of silver salt addition so that excess halide reacts with the silver salt. This results in a shell of silver bromide being formed on the tabular silver bromoiodide grains. Thus, it is apparent that the tabular silver bromoiodide grains of the present invention can exhibit substantially uniform or graded iodide concentration profiles and that the gradation can be controlled, as desired, to favor higher iodide concentrations internally or at or near the surfaces of the tabular silver bromoiodide grains.

Although the preparation of the high aspect ratio tabular grain silver bromoiodide emulsions has been described by reference to the process of Wilgus and Haefner, which produces neutral or nonammoniacal emulsions, the emulsions of the present invention and their utility are not limited by any particular process for their preparation. A process of preparing high aspect ratio tabular grain silver bromoiodide emulsions discovered subsequent to that of Wilgus and Haefner is described by Daubendiek and Strong U.S. Ser. No. 429,587, filed concurrently herewith and commonly assigned, titled *Method of Preparing High Aspect Ratio Grains*, which is a continuation-in-part of U.S. Ser. No. 320,906, filed Nov. 12, 1981, now abandoned both the Daubendiek and Strong patent applications being here incorporated by reference. Daubendiek and Strong teaches an improvement over the processes of Maternaghan, cited above, wherein in a preferred form the silver iodide concentration in the reaction vessel is reduced below 0.05 mole per liter and the maximum size of the silver iodide grains initially present in the reaction vessel is reduced below 0.05 micron.

High aspect ratio tabular grain silver bromide emulsions lacking iodide can be prepared by the process described by Wilgus and Haefner modified to exclude iodide. High aspect ratio tabular grain silver bromide emulsions can alternatively be prepared following a procedure similar to that employed by de Cugnac and Chateau, cited above and here incorporated by reference. High aspect ratio silver bromide emulsions containing square and rectangular grains can be prepared as taught by Mignot U.S. Ser. No. 320,912, filed Nov. 12, 1981 and commonly assigned, titled *Silver Bromide Emulsions of Narrow Grain Size Distribution and Processes for Their Preparation.* In this process cubic seed grains having an edge length of less than 0.15 micron are employed. While maintaining the pAg of the seed grain emulsion in the range of from 5.0 to 8.0, the emulsion is ripened in the substantial absence of nonhalide silver ion complexing agents to produce tabular silver bromide grains having an average aspect ratio of at least 8.5:1. Still other preparations of high aspect ratio tabular grain silver bromide emulsions lacking iodide are illustrated in the examples.

Certain of the advantages achieved in the practice of this invention, such as sharpness as well as advantages recognized by Abbott and Jones in radiographic elements and Jones and Hill in image transfer film units, are independent of the halide content of the high aspect ratio tabular grain emulsions. To illustrate the diversity of high aspect ratio tabular grain silver halide emulsions which can be employed in the practice of this invention, attention is directed to Wey U.S. Ser. No. 429,403, filed concurrently herewith and commonly assigned, titled *Improved Double-Jet Precipitation Processes and Products Thereof,* which is a continuation-in-part of U.S. Ser. No. 320,908, filed Nov. 12, 1981, now abandoned both of which are here incorporated by reference and disclose a process of preparing tabular silver chloride grains which are substantially internally free of both silver bromide and silver iodide. Wey employs a double-jet precipitation process wherein chloride and silver salts are concurrently introduced into a reaction vessel containing dispersing medium in the presence of ammonia. During chloride salt introduction the pAg within the dispersing medium is in the range of from 6.5 to 10 and the pH in the range of from 8 to 10. The presence of ammonia at higher temperatures tends to cause thick grains to form, therefore precipitation temperatures are limited to up to 60° C. The process can be optimized to produce high aspect ratio tabular grain silver chloride emulsions.

Maskasky U.S. Ser. No. 431,455, filed concurrently herewith and commonly assigned, titled *Silver Chloride Emulsions of Modified Crystal Habit and Processes for Their Preparation,* which is a continuation-in-part of U.S. Ser. No. 320,898, filed Nov. 12, 1981, now abandoned both of which are here incorporated by reference, discloses a process of preparing tabular grains of at least 50 mole percent chloride having opposed crystal faces lying in {111} crystal planes and, in one preferred form, at least one peripheral edge lying parallel to a <211> crystallographic vector in the plane of one of the major surfaces. Such tabular grain emulsions can be prepared by reacting aqueous silver and chloride-containing halide salt solutions in the presence of a crystal habit modifying amount of an amino-substituted azaindene and a peptizer having a thioether linkage.

Wey and Wilgus U.S. Ser. No. 431,854, filed concurrently herewith and commonly assigned, titled *Novel Silver Chlorobromide Emulsions and Processes for Their Preparation,* which is a continuation-in-part of U.S. Ser. No. 320,899, filed Nov. 12, 1981, now abandoned both of which are here incorporated by reference, discloses tabular grain emulsions wherein the silver halide grains contain chloride and bromide in at least annular grain regions and preferably throughout. The tabular grain regions containing silver, chloride, and bromide are formed by maintaining a molar ratio of chloride and bromide ions of from 1.6:1 to about 260:1 and the total concentration of halide ions in the reaction vessel in the range of from 0.10 to 0.90 normal during introduction of silver, chloride, bromide, and, optionally, iodide salts into the reaction vessel. The molar ratio of silver chloride to silver bromide in the tabular grains can range from 1:99 to 2:3.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be produced. Maximum average aspect ratios have been observed to vary, depending upon the precipitation technique employed and the tabular grain halide composition. The highest observed average aspect ratios, 500:1, for tabular grains with photographically useful average grain diameters, have been achieved by Ostwald ripening preparations of silver bromide grains, with aspect ratios of 100:1, 200:1, or even higher being obtainable by double-jet precipitation procedures. The presence of iodide generally decreases the maximum average aspect ratios realized, but the preparation of silver bromoiodide tabular grain emulsions having average aspect ratios of 100:1 or even 200:1 or more is feasible. Average aspect ratios as high as 50:1 or even 100:1 for silver chloride tabular grains, optionally containing bromide and/or iodide, can be prepared as taught by Maskasky, cited above.

Modifying compounds can be present during tabular grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al. U.S. Pat. No. 1,195,432, Hochstetter U.S. Pat. No. 1,951,933, Trivelli et al. U.S. Pat. No. 2,448,060, Overman U.S. Pat. No. 2,628,167, Mueller et al. U.S. Pat. No. 2,950,972, Sidebotham U.S. Pat. No. 3,488,709, Rosecrants et al. U.S. Pat. No. 3,737,313, Berry et al. U.S. Pat. No. 3,772,031, Atwell U.S. Pat. No. 4,269,927, and *Research Disclosure,* Vol. 134, June 1975, Item 13452.

*Research Disclosure* and its predecessor, *Product Licensing Index,* are publications of Industrial Opportunities Ltd.; Homewell, Havant; Hampshire, P09 1EF, United Kingdom. The tabular grain emulsions can be internally reduction sensitized during precipitation, as illustrated by Moisar et al., *Journal of Photographic Science,* Vol. 25, 1977, pp. 19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al. U.S. Pat. No. 3,821,002, Oliver U.S. Pat. No. 3,031,304 and Claes et al., *Photographische Korrespondenz,* Band 102, Nov. 10, 1967, p. 162. In order to obtain rapid distribution of the reactants within the reaction vessel, specially constructed mixing devices can be employed, as illustrated by Audran U.S. Pat. No. 2,996,287, McCrossen et al. U.S. Pat. No. 3,342,605, Frame et al. U.S. Pat. No. 3,415,650, Porter et al. U.S. Pat. No. 3,785,777, Finnicum et al. U.S. Pat. No. 4,147,551, Verhille et al. U.S. Pat. No. 4,171,224, Calamur U.K. Patent Application No. 2,022,431A, Saito et al. German OLS Nos. 2,555,364 and 2,556,885, and *Research Disclosure,* Volume 166, February 1978, Item 16662.

In forming the tabular grain emulsions a dispersing medium is initially contained in the reaction vessel. In a preferred form the dispersing medium is comprised on an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agaragar, arrowroot, albumin and the like as described in Yutzy et al. U.S. Pat. Nos. 2,614,928 and '929, Lowe et al., U.S. Pat. Nos. 2,691,582, 2,614,930, '931, 2,327,808 and 2,448,534, Gates et al. U.S. Pat. Nos. 2,787,545 and 2,956,880, Himmelmann et al. U.S. Pat. No. 3,061,436, Farrell et al. U.S. Pat. No. 2,816,027, Ryan U.S. Pat. Nos. 3,132,945, 3,138,461 and 3,186,846, Dersch et al. U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al. U.S. Pat. Nos. 2,992,213, 3,157,506, 3,184,312 and 3,539,353, Miller et al. U.S. Pat. No. 3,227,571, Boyer et al. U.S. Pat. No. 3,532,502, Malan U.S. Pat. No. 3,551,151, Lohmer et al. U.S. Pat. No. 4,018,609, Luciani et al. U.K. Pat. No. 1,186,790, Hori et al. U.K. Pat. No. 1,489,080 and Belgian Pat. No. 856,631, U.K. Pat. No. 1,490,644, U.K. Pat. No. 1,483,551, Arase et al. U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al. U.S. Pat. No. 2,725,293, Hilborn U.S. Pat. No. 2,748,022, DePauw et al. U.S. Pat. No. 2,956,883, Ritchie U.K. Pat. No. 2,095, DeStubner U.S. Pat. No. 1,752,069, Sheppard et al. U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al. U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al. U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al. U.S. Pat. Nos. 2,484,456, 2,541,474 and 2,632,704, Perry et al. U.S. Pat. No. 3,425,836, Smith et al. U.S. Pat. Nos. 3,415,653 and 3,615,624, Smith U.S. Pat. No. 3,488,708, Whiteley et al. U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al. U.S. Pat. No. 3,879,205, Nottorf U.S. Pat. No. 3,142,568, Houck et al. U.S. Pat. Nos. 3,062,674 and 3,220,844, Dann et al. U.S. Pat. No. 2,882,161, Schupp U.S. Pat. No. 2,579,016, Weaver U.S. Pat. No. 2,829,053, Alles et al. U.S. Pat. No. 2,698,240, Priest et al. U.S. Pat. No. 3,003,879, Merrill et al. U.S. Pat. No. 3,419,397, Stonham U.S. Pat. No. 3,284,207, Lohmer et al. U.S. Pat. No. 3,167,430, Williams U.S. Pat. Nos. 2,957,767, Dawson et al. U.S. Pat. No. 2,893,867, Smith et al. U.S. Pat. Nos. 2,860,986 and 2,904,539, Ponticello et al. U.S. Pat. Nos. 3,929,482 and 3,860,428, Ponticello U.S. Pat. No. 3,939,130, Dykstra U.S. Pat. No. 3,411,911 and Dykstra et al. Canadian Pat. No. 774,054, Ream et al. U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al. U.S. Pat.

Nos. 2,865,893 and 2,875,059, Rees et al. U.S. Pat. No. 3,536,491, Broadhead et al. U.K. Pat. No. 1,348,815, Taylor et al. U.S. Pat. No. 3,479,186, Merrill et al. U.S. Pat. No. 3,520,857, Bacon et al. U.S. Pat. No. 3,690,888, Bowman U.S. Pat. No. 3,748,143, Dickinson et al. U.K. Pat. Nos. 808,227 and '228, Wood U.K. Pat. No. 822,192 and Iguchi et al. U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of silver halide emulsions according to the present invention, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is a known ripening agent, it is not a preferred ripening agent for the emulsions of this invention exhibiting the highest realized speed-granularity relationships. The preferred emulsions of the present invention are non-ammoniacal or neutral emulsions.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al., U.S. Pat. No. 2,222,264, cited above; Lowe et al. U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al. U.S. Pat. No. 3,737,313, here incorporated by reference, can be employed.

The high aspect ratio tabular grain emulsions of the present invention are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al. U.S. Pat. No. 2,618,556, Yutzy et al. U.S. Pat. No. 2,614,928, Yackel U.S. Pat. No. 2,565,418, Hart et al. U.S. Pat. No. 3,241,969, Waller et al. U.S. Pat. No. 2,489,341, Klinger U.K. Pat. No. 1,305,409 and Dersch et al. U.K. Pat. No. 1,167,159; by centrifugation and decantation of a coagulated emulsion, as illustrated by Murray U.S. Pat. No. 2,463,794, Ujihara et al. U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al. *Soviet Chemical Industry,* Vol. 6, No. 3, 1974, pp. 181–185; by diafiltration with a semipermeable membrane, as illustrated by *Research Disclosure,* Vol. 102, October 1972, Item 10208, Hagemaier et al. *Research Disclosure,* Vol. 131, March 1975, Item 13122, Bonnet *Research Disclosure,* Vol. 135, July 1975, Item 13577, Berg et al. German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular grains after the completion of precipitation to avoid increasing their thickness and reducing their aspect ratio.

Once the high aspect ratio tabular grain emulsions have been formed they can be shelled to produce core-shell emulsions by procedures well known to those skilled in the art. Any photographically useful silver salt can be employed in forming shells on the high aspect ratio tabular grain emulsions prepared by the present process. Techniques for forming silver salt shells are illustrated by Berriman U.S. Pat. No. 3,367,778, Porter et al. U.S. Pat. Nos. 3,206,313 and 3,317,322, Morgan U.S. Pat. No. 3,917,485, and Maternaghan, cited above. Since conventional techniques for shelling do not favor the formation of high aspect ratio tabular grains, as shell growth proceeds the average aspect ratio of the emulsion declines. If conditions favorable for tabular grain formation are present in the reaction vessel during shell formation, shell growth can occur preferentially on the outer edges of the grains so that aspect ratio need not decline. Wey and Wilgus, cited above, specifically teach procedures for shelling tabular grains without necessarily reducing the aspect ratios of the resulting core-shell grains as compared to the tabular grains employed as core grains. Evans, Daubendiek, and Raleigh U.S. Ser. No. 431,912, filed concurrently herewith and commonly assigned, titled *Direct Reversal Emulsions and Photographic Elements Useful in Image Transfer Film Units,* which is a continuation-in-part of U.S. Ser. No. 320,891, filed Nov. 12, 1981, now abandoned, both of which are here incorporated by reference, specifically discloses the preparation of high aspect ratio core-shell tabular grain emulsions for use in forming direct reversal images.

Although the procedures for preparing tabular silver halide grains described above will produce high aspect ratio tabular grain emulsions in which tabular grains satisfying the thickness and diameter criteria for aspect ratio account for at least 50 percent of the total projected area of the total silver halide grain population, it is recognized that further advantages can be realized by increasing the proportion of such tabular grains present. Preferably at least 70 percent (optimally at least 90 percent) of the total projected area is provided by tabular silver halide grains meeting the thickness and diameter criteria. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation techniques—e.g., by using a centrifuge or hydrocyclone. An illustrative teaching of hydrocyclone separation is provided by Audran et al. U.S. Pat. No. 3,326,641.

b. Sensitization

The high aspect ratio tabular grain silver halide emulsions of the present invention are chemically sensitized. These and other silver halide emulsions herein disclosed can be chemically sensitized with active gelatin, as illustrated by T. H. James, *The Theory of the Photographic Process,* 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 120, April 1974, Item 12008, *Research Disclosure,* Vol. 134, June 1975, Item 13452, Sheppard et al. U.S. Pat. No. 1,623,499, Matthies et al U.S. Pat. No. 1,673,522, Waller et al. U.S. Pat. No. 2,399,083, Damschroder et al. U.S. Pat. No. 2,642,361, McVeigh U.S. Pat. No. 3,297,447, Dunn U.S. Pat. No. 3,297,446, McBride U.K. Pat. No. 1,315,755, Berry et al. U.S. Pat. No. 3,772,031, Gilman et al. U.S. Pat. No. 3,761,267, Ohi et al. U.S. Pat. No. 3,857,711, Klinger et al. U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, as described in Damschroder U.S. Pat. No. 2,642,361; sulfur containing compounds of the type disclosed in Lowe et al. U.S. Pat. No. 2,521,926, Williams et al. U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocycli nuclei. Examplary finish modifiers are described in Brooker et al. U.S. Pat. No. 2,131,038, Dostes U.S. Pat. No. 3,411,914, Kuwabara et al. U.S. Pat. No. 3,554,757, Oguchi et al. U.S. Pat. No. 3,565,631, Oftedahl U.S. Pat. No. 3,901,714, Walworth Canadian Pat. No. 778,723, and Duffin *Photographic Emulsion Chemistry,* Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al. U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al. *Research Disclosure,* Vol. 136, August 1975, Item 13654, Lowe et al. U.S. Pat. Nos. 2,518,698 and 2,739,060, Roberts et al. U.S. Pat. Nos. 2,743,182 and '183, Chambers et al. U.S. Pat. No. 3,026,203 and Bigelow et al. U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

Although the high aspect ratio tabular grain silver halide emulsions of the present invention are generally responsive to the techniques for chemical sensitization known in the art in a qualitative sense, in a quantitative sense—that is, in terms of the actual speed increases realized—the tabular grain emulsions require careful investigation to identify the optimum chemical sensitization for each individual emulsion, certain preferred embodiments being more specifically discussed below.

In addition to being chemically sensitized the high aspect ratio tabular grain silver halide emulsions of the present invention are also spectrally sensitized. It is specifically contemplated to employ in combination with the high aspect ratio tabular grain emulsions and other emulsions disclosed herein spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The silver halide emulsions of this invention can be spectrally sensitized with dyes from a variety of classes, including the polymethine dye class, which classes include the cyanines, merocyanines, complex cyanines and merocyanines (i.e., tri-, tetra-, and poly-nuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al. U.S. Pat. No. 2,131,038 and Shiba et al. U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al.), pp. 175–178 (Leubner) and pp. 475–485 (Gilman). Oxidation and reduction potentials can be measured as described by R. F. Large in *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al. U.S. Pat. Nos. 2,165,338, 2,213,238, 2,231,658, 2,493,747, '748, 2,526,632, 2,739,964 (U.S. Pat. No. 24,292), 2,778,823, 2,917,516, 3,352,857, 3,411,916 and 3,431,111, Wilmanns et al. U.S. Pat. No. 2,295,276, Sprague U.S. Pat. Nos. 2,481,698 and 2,503,776, Carroll et al. U.S. Pat. Nos. 2,688,545 and 2,704,714, Larive et al. U.S. Pat. No. 2,921,067, Jones U.S. Pat. No. 2,945,763, Nys et al. U.S. Pat. No. 3,282,933, Schwan et al. U.S. Pat. No. 3,397,060, Riester U.S. Pat. No. 3,660,102, Kampfer et al. U.S. Pat. No. 3,660,103, Taber et al. U.S. Pat. Nos. 3,335,010, 3,352,680 and 3,384,486, Lincoln et al. U.S. Pat. No. 3,397,981, Fumia et al. U.S. Pat. Nos. 3,482,978 and 3,623,881, Spence et al. U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al. U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,211,805; bis-triazinylaminostilbenes, as taught by McFall et al. U.S. Pat. No. 2,933,390; sulfonated aromatic compounds, as taught by Jones et al. U.S. Pat. No. 2,937,089; mercapto-substituted heterocycles, as taught by Riester U.S. Pat. No. 3,457,078; iodide, as taught by U.K. Pat. No. 1,413,826; and still other compounds, such as those disclosed by Gilman, "Rewiew of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the high aspect ratio tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al., "The Adsorption of Sensitizing Dyes in Photographic Emulsions", *Journal of Phys. Chem.,* Vol. 56, p. 1065, 1952; Spence et al., "Desensitization of Sensitizing Dyes", *Journal of Physical and Colloid Chemistry,* Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process,* pp. 1067–1069, cited above.

Although native blue sensitivity of silver bromide or bromoiodide is usually relied upon in the art in emulsion layers intended to record exposure to blue light, it is a specific feature of the present invention that significant advantages can be obtained by the use of spectral sensitizers, even where their principal absorption is in the spectral region to which the emulsions possess native sensitivity. For example, it is specifically recognized that advantages can be realized from the use of blue spectral sensitizing dyes. Even when the emulsions of the invention are high aspect ratio tabular grain silver bromide and silver bromoiodide emulsions, very large increases in speed are realized by the use of blue spectral sensitizing dyes. Where it is intended to expose emulsions according to the present invention in their region of native sensitivity, advantages in sensitivity can be gained by increasing the thickness of the tabular grains. For example, it is preferred to increase grain thicknesses as described above in connection with Jones and Hill, cited above. Specifically, in one preferred form of the invention the emulsions are blue sensitive silver bromide and bromoiodide emulsions in which the tabular grains having a thickness of less than 0.5 micron and a diameter of at least 0.6 micron have an average aspect ratio of greater than 8:1, preferably at least 12:1 and account for at least 50 percent of the total projected area of the silver halide grains present in the emulsion, preferably 70 percent and optimally at least 90 percent. In the foregoing description 0.3 micron can, of course, be substituted for 0.5 micron without departing from the invention.

Useful blue spectral sensitizing dyes for high aspect ratio tabular grain silver bromide and silver bromoiodide emulsions can be selected from any of the dye classes known to yield spectral sensitizers. Polymethine dyes, such as cyanines, merocyanines, hemicyanines, hemioxonols, and merostyryls, are preferred blue spectral sensitizers. Generally useful blue spectral sensitizers can be selected from among these dye classes by their absorption characteristics—i.e., hue. There are, however, general structural correlations that can serve as a guide in selecting useful blue sensitizers. Generally the shorter the methine chain, the shorter the wavelength of the sensitizing maximum. Nuclei also influence absorption. The addition of fused rings to nuclei tends to favor longer wavelengths of absorption. Substituents can also alter absorption characteristics. In the formulae which follow, unless othewise specified, alkyl groups and moieties contain from 1 to 20 carbon atoms, preferably from 1 to 8 carbon atoms. Aryl groups and moieties contain from 6 to 15 carbon atoms and are preferably phenyl or naphthyl groups or moieties.

Preferred cyanine blue spectral sensitizers are monomethine cyanines; however, useful cyanine blue spectral sensitizers can be selected from among those of Formula 1.

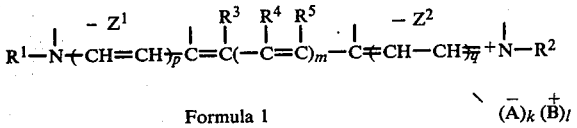

Formula 1 where $Z^1$ and $Z^2$ may be the same or different and each represents the elements needed to complete a cyclic nucleus derived from basic heterocyclic nitrogen compounds such as oxazoline, oxazole, benzoxazole, the naphthoxazoles (e.g., naphth[2,1-d]oxazole, naphth[2,3-d]oxazole, and naphth[1,2-d]oxazole), thiazoline, thiazole, benzothiazole, the naphthothiazoles (e.g., naphtho[2,1-d]thiazole), the thiazoloquinolines (e.g., thiazolo[4,5-b]quinoline), selenazoline, selenazole, benzoselenazole, the naphthoselenazoles (e.g., naphtho[1,2-d]selenazole), 3H-indole (e.g., 3,3-dimethyl-3H-indole), the benzindoles (e.g., 1,1-dimethylbenz[e]indole), imidazoline, imidazole, benzimidazole, the naphthimidazoles (e.g., naphth[2,3-d]imidazole), pyridine, and quinoline, which nuclei may be substituted on the ring by one or more of a wide variety of substituents such as hydroxy, the halogens (e.g., fluoro, chloro, bromo, and iodo), alkyl groups or substituted alkyl groups (e.g., methyl, ethyl, propyl, isopropyl, butyl, octyl, dodecyl, octadecyl, 2-hydroxyethyl, 3-sulfopropyl, carboxymethyl, 2-cyanoethyl, and trifluoromethyl), aryl groups or substituted aryl groups (e.g., phenyl, 1-naphthyl, 2-naphthyl, 4-sulfophenyl, 3-carboxyphenyl, and 4-biphenyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., methylthio and ethylthio), arylthio groups (e.g., phenylthio, p-tolythio, and 2-naphthylthio), methylenedioxy, cyano, 2-thienyl, styryl, amino or substituted amino groups (e.g., anilino, dimethylamino, diethylamino, and morpholino), acyl groups, such as carboxy (e.g., acetyl and benzoyl) and sulfo;

$R^1$ and $R^2$ can be the same or different and represent alkyl groups, aryl groups, alkenyl groups, or aralkyl groups, with or without substituents, (e.g., carboxymethyl, 2-hydroxyethyl, 3-sulfopropyl, 3-sulfobutyl, 4-sulfobutyl, 4-sulfophenyl, 2-methoxyethyl, 2-sulfatoethyl, 3-thiosulfatopropyl, 2-phosphonoethyl, chlorophenyl, and bromophenyl);

$R^3$ represents hydrogen;

$R^4$ and $R^5$ represents hydrogen or alkyl of from 1 to 4 carbon atoms;

p and q are 0 or 1, except that both p and q preferably are not 1;

m is 0 or 1 except that when m is 1 both p and q are 0 and at least one of $Z^1$ and $Z^2$ represents imidazoline, oxazoline, thiazoline, or selenazoline;

A is an anionic group;

B is a cationic group; and k and l may be 0 or 1, depending on whether ionic substituents are present. Variants are, of coure, possible in which $R^1$ and $R^3$, $R^2$ and $R^5$, or $R^1$ and $R^2$ (particularly when m, p, and q are 0) together represent the atoms necessary to complete an alkylene bridge.

Some representative cyanine dyes useful as blue sensitizers are listed in Table I.

Table I 1. 3,3'-Diethylthiacyanine bromide

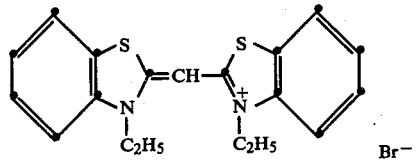

2. 3-Ethyl-3'-methyl-4'-phenylnaphtho[1,2-d]thiazolothiazolinocyanine bromide

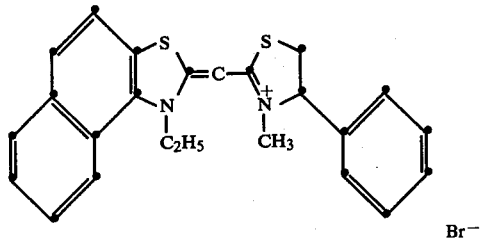

3. 1',3-Diethyl-4-phenyloxazolo-2'-cyanine iodide

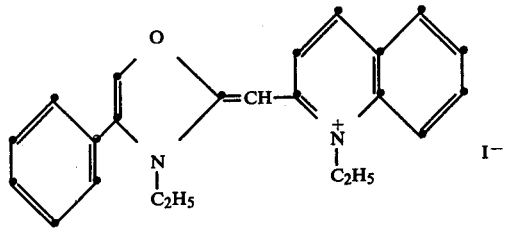

4. Anhydro 5-chloro-5'-methoxy-3,3'-bis-(2-sulfoethyl)thiacyanine hydroxide, triethylamine salt

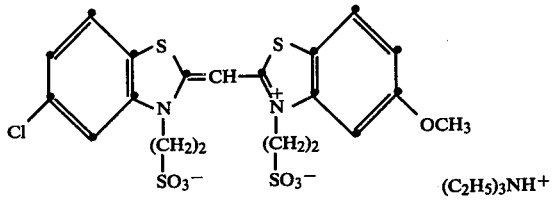

5. 3,3'-Bis(2-carboxyethyl)thiazolinocarbocyanine iodide

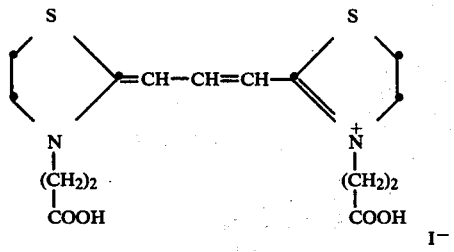

6. 1,1'-Diethyl-3,3'-ethylenebenzimidazolocyanine iodide

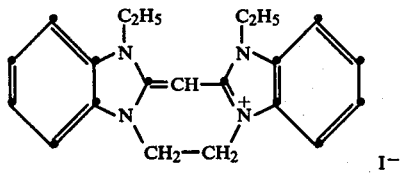

7. 1-(3-Ethyl-2-benzothiazolinylidene)-1,2,3,4-tetrahydro-2-methylpyrido-[2,1-b]-benzothiazolinium iodide

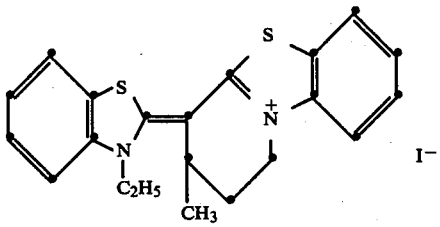

8. Anhydro-5,5'-dimethoxy-3,3'-bis(3-sulfopropyl)-thiacyanine hydroxide, sodium salt

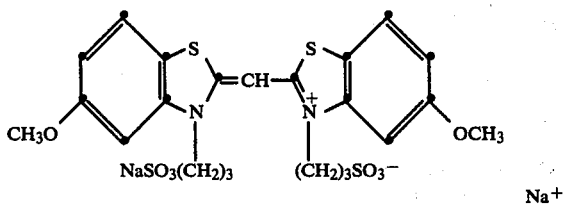

Preferred merocyanine blue spectral sensitizers are zero methine merocyanines; however, useful merocyanine blue spectral sensitizers can be selected from among those of Formula 2.

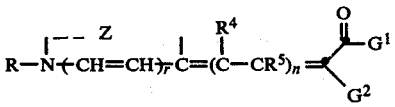

Formula 2 where

Z represents the same elements as either $Z^1$ or $Z^2$ of Formula 1 above;

R represents the same groups as either $R^1$ or $R^2$ of Formula 1 above;

$R^4$ and $R^5$ represent hydrogen, an alkyl group of 1 to 4 carbon atoms, or an aryl group (e.g., phenyl or naphthyl);

$G^1$ represents an alkyl group or substituted alkyl group, an aryl or substituted aryl group, an aralkyl group, an alkoxy group, an aryloxy group, a hydroxy group, an amino group, a substituted amino group wherein specific groups are of the types in Formula 1;

$G^2$ can represent any one of the groups listed for $G^1$ and in addition can represent a cyano group, an alkyl, or arylsulfonyl group, or a group represented by

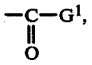

or $G^2$ taken together with $G^1$ can represent the elements needed to complete a cyclic acidic nucleus such as those derived from 2,4-oxazolidinone (e.g., 3-ethyl-2,4-oxazolidindione), 2,4-thiazolidindione (e.g., 3-methyl-2,4-thiazolidindione), 2-thio-2,4-oxazolidindione (e.g., 3-phenyl-2-thio-2,4-oxazolidindione), rhodanine, such as 3-ethylrhodanine, 3-phenylrhodanine, 3-(3-dimethylaminopropyl)rhodanine, and 3-carboxymethylrhodanine, hydantoin (e.g., 1,3-diethylhydantoin and 3-ethyl-1-phenylhydantoin), 2-thiohydantoin (e.g., 1-ethyl-3-phenyl-2-thiohydantoin, 3-heptyl-1-phenyl-2-thiohydantoin, and 1,3-diphenyl-2-thiohydantoin), 2-pyrazolin-5-one, such as 3-methyl-1-phenyl-2-pyrazolin-5-one, 3-methyl-1-(4-carboxybutyl)-2-pyrazolin-5-one, and 3-methyl-2-(4-sulfophenyl)-2-pyrazolin-5-one, 2-isoxazolin-5-one (e.g., 3phenyl-2-isoxazolin-5-one), 3,5-pyrazolidindione (e.g., 1,2-diethyl-3,5-pyrazolidindione and 1,2-diphenyl-3,5-pyrazolidindione), 1,3-indandione, 1,3-dioxane-4,6-dione, 1,3-cyclohexanedione, barbituric acid (e.g., 1-ethylbarbituric acid and 1,3-diethylbarbituric acid), and 2-thiobarbituric acid (e.g., 1,3-diethyl-2-thiobarbituric acid and 1,3-bis(2-methoxyethyl)-2-thiobarbituric acid);

r and n each can be 0 or 1 except that when n is 1 then generally either Z is restricted to imidazoline, oxazoline, selenazoline, thiazoline, imidazoline, oxazole, or benzoxazole, or $G^1$ and $G^2$ do not represent a cyclic system. Some representative blue sensitizing merocyanine dyes are listed below in Table II.

Table II 1. 5-(3-Ethyl-2-benzoxazolinylidene)-3-phenylrhodanine

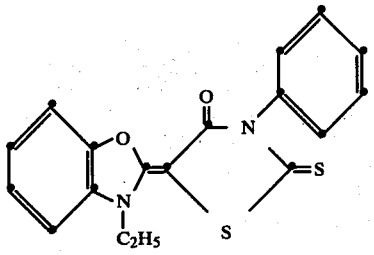

2. 5-[1-(2-Carboxyethyl)-1,4-dihydro-4-pyridinylidene]-1-ethyl-3-phenyl-2-thio-hydantoin.

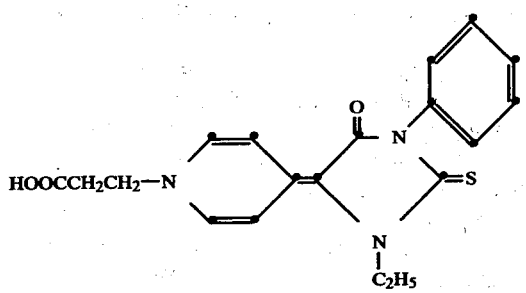

3. 4-(3-Ethyl-2-benzothiazolinylidene)-3-methyl-1-(4-sulfophenyl)-2-pyrazolin-5-one, Potassium Salt

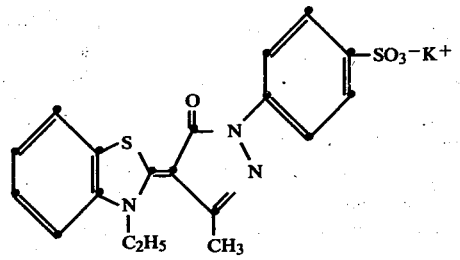

4. 3-Carboxymethyl-5-(5-chloro-3-ethyl-2-benzothiazolinylidene)rhodanine

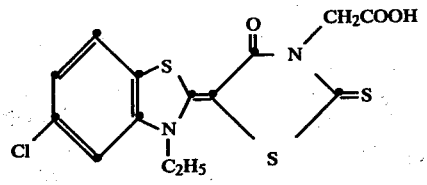

5. 1,3-Diethyl-5-[3,4,4-trimethyloxazolidinylidene)ethylidene]-2-thiobarbituric acid

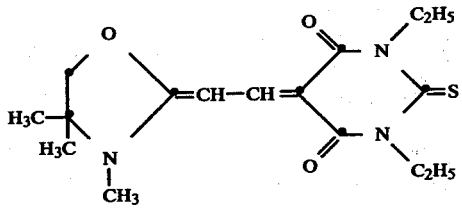

Useful blue sensitizing hemicyanine dyes include those represented by Formula 3.

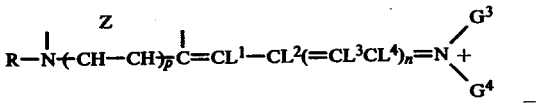

Formula 3 where

Z, R, and p represent the same elements as in Formula 2; $G^3$ and $G^4$ may be the same or different and may represent alkyl, substituted alkyl, aryl, substituted aryl, or aralkyl, as illustrated for ring substituents in Formula 1 or $G^3$ and $G^4$ taken together complete a ring system derived from a cyclic secondary amine, such as pyrrolidine, 3-pyrroline, piperidine, piperazine (e.g., 4-methylpiperazine and 4-phenylpiperazine), morpholine, 1,2,3,4-tetrahydroquinoline, decahydroquinoline, 3-azabicyclo[3,2,2]nonane, indoline, azetidine, and hexahydroazepine;

$L^1$ to $L^4$ represent hydrogen, alkyl of 1 to 4 carbons, aryl, substituted aryl, or any two of $L^1$, $L^2$, $L^3$, $L^4$ can represent the elements needed to complete an alkylene or carbocyclic bridge;

n is 0 or 1; and

A and k have the same definition as in Formula 1.

Some representative blue sensitizing hemicyanine dyes are listed below in Table III.

Table III 1. 5,6-Dichloro-2-[4-(diethylamino)-1,3-butadien-1-yl]-1,3-diethylbenzimidazolium iodide

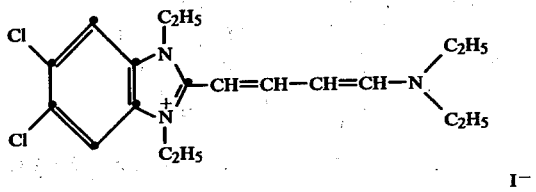

2. 2-{2-[2-(3-Pyrrolino)-1-cyclopentenl-yl]ethenyl}-3-ethylthiazolium perchlorate.

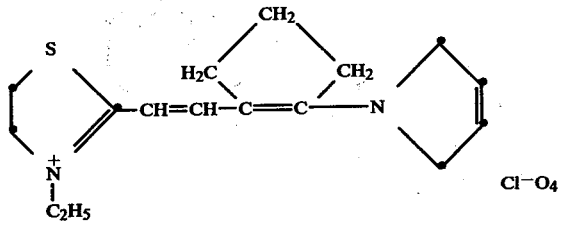

3. 2-(5,5-Dimethyl-3-piperidino-2-cyclohexen-1-yldenemethyl)-3-ethylbenzoxazolium perchlorate

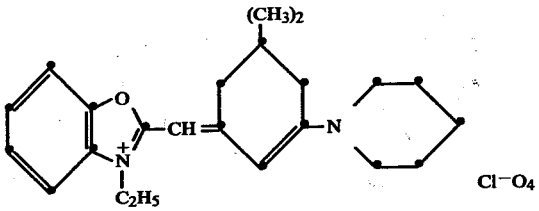

Useful blue sensitizing hemioxonol dyes include those represented by Formula 4.

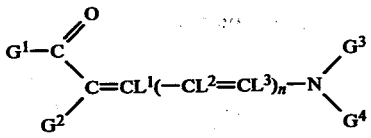

Formula 4 where $G^1$ and $G^2$ represent the same elements as in Formula 2;

$G^3$, $G^4$, $L^1$, $L^2$, and $L^3$ represent the same elements as in Formula 3; and n is 0 or 1.

Some representative blue sensitizing hemioxonol dyes are listed in Table IV.

Table IV 1. 5-(3-Anilino-2-propen-1-ylidene)-1,3-diethyl-2-thiobarbituric acid

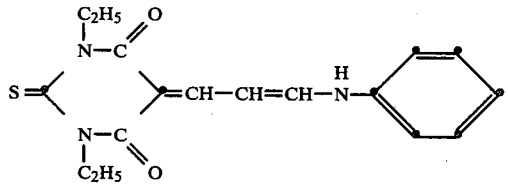

2. 3-Ethyl-5-(3-piperidino-2-propen-1-ylidene)rhodanine

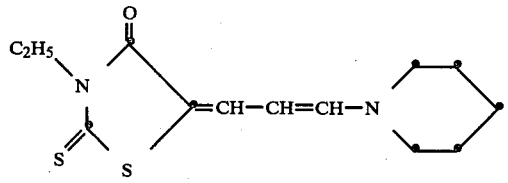

3. 3-Allyl-5-[5,5-dimethyl-3-(3-pyrrolino)-2-cyclohexen-1-ylidene]rhodanine

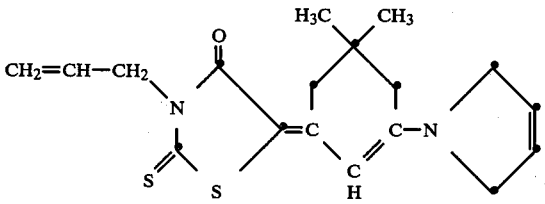

Useful blue sensitizing merostyryl dyes include those represented by Formula 5.

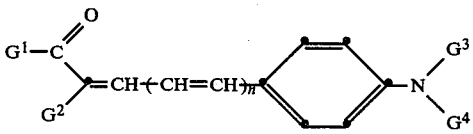

Formula 5 where $G^1$, $G^2$, $G^3$, $G^4$, and n are as defined in Formula 4.

Some representative blue sensitizing merostyryl dyes are listed in Table V.

Table V 1. 1-Cyano-1-(4-dimethylaminobenzylidene)-2-pentanone

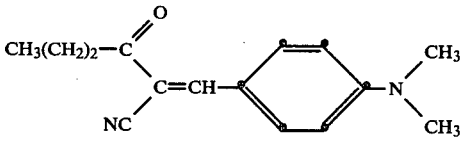

2. 5-(4-Dimethylaminobenzylidene-2,3-diphenylthiazolidin-4-one-1-oxide

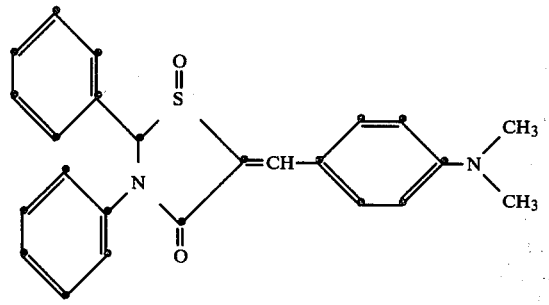

3. 2-(4-Dimethylaminocinnamylidene)thiazolo-[3,2-a]benzimidazol-3-one

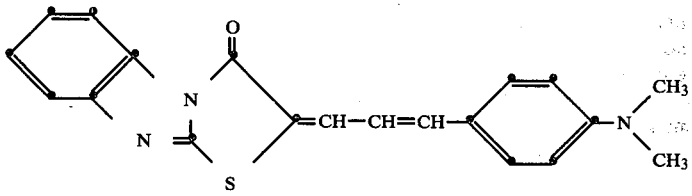

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al. U.S. Pat. No. 3,628,960, and Locker et al. U.S. Pat. No. 4,225,666. As taught by Locker et al., it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al., it is specifically contemplated that the spectral sensitizing dye can be added to the emulsion after 80 percent of the silver halide has been precipitated. Sensitization can be enhanced by pAg adjustment, including variation in pAg which completes one or more cycles, during chemical and/or spectral sensitization. A specific example of pAg adjustment is provided by *Research Disclosure,* Vol. 181, May 1979, Item 18155.

It has been discovered that high aspect ratio tabular grain silver halide emulsions can exhibit better speed-granularity relationships when chemically and spectrally sensitized than have heretofore been achieved using conventional silver halide emulsions of like halide content. It is generally known in the art that silver bromoiodide emulsions produce the best achievable speed-granularity relationships. Therefore, such emulsions are used to satisfy commercial camera-speed photographic applications. Substantially optimally chemically and spectrally sensitized high aspect ratio tabular grain silver bromoiodide emulsions exhibit improved speed-granularity relationships as compared to the best speed-granularity relationships heretofore achieved in the art. More generally, substantially optimally chemically and spectrally sensitized high aspect ratio tabular grain emulsions when exposed within a region of spectral sensitization exhibit improvements in speed-granularity relationships as compared to conventional emulsions of similar halide content. Improved speed-granularity relationships are specifically contemplated for high aspect ratio tabular grain silver bromide and silver bromoiodide emulsions spectrally sensitized and exposed in the green and/or red portions of the spectrum. Improvements in the speed-granularity relationships in the native sensitivity region of the spectrum (e.g., the blue portion of the spectrum) can also be realized using blue spectral sensitizing dyes when the high aspect ratio tabular grains of this invention are compared to similarly sensitized conventional (i.e., low aspect ratio tabular or non-tabular) silver halide grains of comparable individual grain volume.

In one preferred form, spectral sensitizers can be incorporated in the emulsions of the present invention prior to chemical sensitization. Similar results have also been achieved in some instances by introducing other adsorbable materials, such as finish modifiers, into the emulsions prior to chemical sensitization.

Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,642,361, cited above. Other ripening agents can be used during chemical sensitization.

In still a third approach, which can be practiced in combination with one or both of the above approaches or separately thereof, it is preferred to adjust the concentration of silver and/or halide salts present immediately prior to or during chemical sensitization. Soluble silver salts, such as silver acetate, silver trifluoroacetate, and silver nitrate, can be introduced as well as silver salts capable of precipitating onto the grain surfaces, such as silver thiocyanate, silver phosphate, silver carbonate, and the like. Fine silver halide (i.e., silver bromide, iodide, and/or chloride) grains capable of Ostwald ripening onto the tabular grain surfaces can be introduced. For example, a Lippmann emulsion can be introduced during chemical sensitization. Maskasky U.S. Ser. No. 431,855, filed concurrently herewith and commonly assigned, titled *Controlled Site Epitaxial Sensitization,* which is a continuation-in-part of U.S. Ser. No. 320,920, filed Nov. 12, 1981, now abandoned, both of which are here incorporated by reference, discloses the chemical sensitization of spectrally sensitized high aspect ratio tabular grain emulsions at one or more ordered discrete sites of the tabular grains. It is believed that the preferential adsorption of spectral sensitizing dye on the crystallographic surfaces forming the major faces of the tabular grains allows chemical sensitization to occur selectively at unlike crystallographic surfaces of the tabular grains.

The preferred chemical sensitizers for the highest attained speed-granularity relationships are gold and sulfur sensitizers, gold and selenium sensitizers, and gold, sulfur, and selenium sensitizers. Thus, in a preferred form of the invention, the high aspect ratio tabular grain silver bromide and silver bromoiodide emulsions of the present invention contain a middle chalcogen, such as sulfur and/or selenium, which may not be detectable, and gold, which is detectable. The emulsions also usually contain detectable levels of thiocyanate, although the concentration of the thiocyanate in the final emulsions can be greatly reduced by known emulsion washed techniques. In various of the preferred forms indicated above the tabular silver bromide or silver bromoiodide grains can have another silver salt at their surface, such as silver thiocyanate or another silver halide of differing halide content (e.g., silver chloride or silver bromide), although the other silver salt may be present below detectable levels.

Although not required to realize all of their advantages, the emulsions of the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1-log E), where E is measured in meter-candle-seconds at a density of 0.1 above fog. Once the silver halide grains of an emulsion layer have been characterized, it is possible to estimate from further product analysis and performance evaluation whether an emulsion layer of a product appears to be substantially optimally chemically and spectrally sensitized in relation to comparable commercial offerings of other manufacturers. To achieve the sharpness advantages of the present invention it is immaterial whether the silver halide emulsions are chemically or spectrally sensitized efficiently or inefficiently.

c. Silver imaging

Once high aspect ratio tabular grain emulsions have been generated by precipitation procedures, washed, and sensitized, as described above, their preparation can be completed by the incorporation of conventional photographic addenda, and they can be usefully applied to photographic applications requiring a silver image to be produced—e.g., conventional black-and-white photography.

Dickerson U.S. Ser. No. 430,574, filed concurrently herewith and commonly assigned, titled *Forehardened Photographic Elements and Processes for Their Use,* which is a continuation-in-part of U.S. Ser. No. 320,911, filed Nov. 12, 1981, both of which are here incorporated by reference, discloses that hardening photographic elements according to the present invention intended to form silver images to an extent sufficient to obviate the necessity of incorporating additional hardener during processing permits increased silver covering power to be realized as compared to photographic elements similarly hardened and processed, but employing nontabular or less than high aspect ratio tabular grain emulsions. Specifically, it is taught to harden the high aspect ratio tabular grain emulsion layers and other hydrophilic colloid layers of black-and-white photographic elements in an amount sufficient to reduce swelling of the layers to less than 200 percent, percent swelling being determined by (a) incubating the photographic element at 38° C. for 3 days at 50 percent relative humidity, (b) measuring layer thickness, (c) immersing the photographic element in distilled water at 21° C. for 3 minutes, and (d) measuring change in layer thickness. Although hardening of the photographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure,* Vol. 184, August 1979, Item 18431, Paragraph K, relating particularly to the processing of radiographic materials.

Typical useful incorporated hardeners (forehardeners) include formaldehyde and free dialdehydes, such as succinaldehyde and glutaraldehyde, as illustrated by Allen et al. U.S. Pat. No. 3,232,764; blocked dialdehydes, as illustrated by Kaszuba U.S. Pat. No. 2,586,168, Jeffreys U.S. Pat. No. 2,870,013, and Yamamoto et al. U.S. Pat. No. 3,819,608; α-diketones, as illustrated by Allen et al. U.S. Pat. No. 2,725,305; active esters of the type described by Burness et al. U.S. Pat. No. 3,542,558; sulfonate esters, as illustrated by Allen et al. U.S. Pat. Nos. 2,725,305 and 2,726,162; active halogen compounds, as illustrated by Burness U.S. Pat. No. 3,106,468, Silverman et al. U.S. Pat. No. 3,839,042, Ballantine et al. U.S. Pat. No. 3,951,940 and Himmelmann et al. U.S. Pat. No. 3,174,861; s-triazines and diazines, as illustrated by Yamamoto et al. U.S. Pat. No. 3,325,287, Anderau et al. U.S. Pat. No. 3,288,775 and Stauner et al. U.S. Pat. No. 3,992,366; epoxides, as illustrated by Allen et al. U.S. Pat. No. 3,047,394, Burness U.S. Pat. No. 3,189,459 and Birr et al. German Patent No. 1,085,663; aziridines, as illustrated by Allen et al. U.S. Pat. No. 2,950,197, Burness et al. U.S. Pat. No. 3,271,175 and Sato et al. U.S. Pat. No. 3,575,705; active olefins having two or more active vinyl groups (e.g. vinylsulfonyl groups), as illustrated by Burness et al. U.S. Pat. Nos. 3,490,911, 3,539,644 and 3,841,872 (U.S. Pat. No. Re. 29,305), Cohen U.S. Pat. No. 3,640,720, Kleist et al. German Patent No. 872,153 and Allen U.S. Pat. No. 2,992,109; blocked active olefins, as illustrated by Burness et al. U.S. Pat. No. 3,360,372 and Wilson U.S. Pat. No. 3,345,177; carbodiimides, as illustrated by Blout et al. German Patent No. 1,148,446; isoxazolium salts unsubstituted in the 3-position, as illustrated by Burness et al. U.S. Pat. No. 3,321,313; esters of 2-alkoxy-N-carboxydihydroquinoline, as illustrated by Bergthaller et al. U.S. Pat. No. 4,013,468; N-carbamoyl and N-carbamoyloxypyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,019, 'onium substituted acroleins, as illustrated by Tschopp et al. U.S. Pat. No. 3,792,021, and vinyl sulfones containing other hardening functional groups, as illustrated by Sera et al. U.S. Pat. No. 4,028,320; and polymeric hardeners, such as dialdehyde starches, as illustrated by Jeffreys et al. U.S. Pat. No. 3,057,723, and copoly(acrolein-methacrylic acid), as illustrated by Himmelmann et al. U.S. Pat. No. 3,396,029.

The use of forehardeners in combination is illustrated by Sieg et al. U.S. Pat. No. 3,497,358, Dallon et al. U.S. Pat. Nos. 3,832,181 and 3,840,370 and Yamamoto et al. U.S. Pat. No. 3,898,089. Hardening accelerators can be used, as illustrated by Sheppard et al. U.S. Pat. No. 2,165,421, Kleist German Patent No. 881,444, Riebel et al. U.S. Pat. No. 3,628,961 and Ugi et al. U.S. Pat. No. 3,901,708. The patents illustrative of hardeners and hardener combinations are here incorporated by reference.

Instability which increases minimum density in negative type emulsion coatings (i.e., fog) or which increases minimum density or decreases maximum density in direct-positive emulsion coatings can be protected again by incorporation of stabilizers, antifoggants, antikinking agents, latent image stabilizers and similar addenda in the emulsion and contiguous layers prior to coating. Many of the antifoggants which are effective in emulsions can also be used in developers and can be classified under a few general headings, as illustrated by C. E. K. Mees, *The Theory of the Photographic Process,* 2nd Ed., Macmillan, 1954, pp. 677–680.

To avoid such instability in emulsion coatings stabilizers and antifoggants can be employed, such as halide ions (e.g., bromide salts); chloropalladates and chloropalladites, as illustrated by Trivelli et al. U.S. Pat. No. 2,566,263; water-soluble inorganic salts of magnesium, calcium, cadmium, cobalt, manganese and zinc, as illustrated by Jones U.S. Pat. No. 2,839,405 and Sidebotham U.S. Pat. No. 3,488,709; mercury salts, as illustrated by Allen et al. U.S. Pat. No. 2,728,663; selenols and diselenides, as illustrated by Brown et al. U.K. Patent No. 1,336,570 and Pollet et al. U.K. Patent No. 1,282,303; quaternary ammonium salts of the type illustrated by Allen et al. U.S. Pat. No. 2,694,716, Brooker et al. U.S. Pat. No. 2,131,038, Graham U.S. Pat. No. 3,342,596 and Arai et al. U.S. Pat. No. 3,954,478; azomethine desensitizing dyes, as illustrated by Thiers et al. U.S. Pat. No. 3,630,744; isothiourea derivatives, as illustrated by Herz et al. U.S. Pat. No. 3,220,839 and Knott et al. U.S. Pat. No. 2,514,650; thiazolidines, as illustrated by Scavron U.S. Pat. No. 3,565,625; peptide derivatives, as illustrated by Maffet U.S. Pat. No. 3,274,002; pyrimidines and 3-pyrazolidiones, as illustrated by Welsh U.S. Pat. No. 3,161,515 and Hood et al. U.S. Pat. No. 2,751,297; azotriazoles and azotetrazoles, as illustrated by Baldassarri et al. U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure,* Vol. 134, June 1975, Item 13452, and Vol. 148, August 1976, Item 14851, and Nepker et al. U.K. Patent No. 1,338,567; mercaptotetrazoles, -triazoles and -diazoles, as illustrated by Kendall et al. U.S. Pat. No. 2,403,927, Kennard et al U.S. Pat. No. 3,266,897, *Research Disclosure,* Vol. 116, December 1973, Item 11684, Luckey et al. U.S. Pat. No. 3,397,987 and Salesin U.S. Pat. No. 3,708,303; azoles, as illustrated by Peterson et al. U.S. Pat. No. 2,271,229 and *Research Disclosure,* Item 11684, cited above; purines, as illustrated by Sheppard et al. U.S. Pat. No. 2,319,090, Birr et al. U.S. Pat. No. 2,152,460, *Research Disclosure,* Item 13452, cited above, and Dostes et al. French Patent No. 2,296,204 and polymers of 1,3-dihydroxy (and/or 1,3-carbamoxy)-2-methylenepropane, as illustrated by Saleck et al. U.S. Pat. No. 3,926,635.

Among useful stabilizers for gold sensitized emulsions are water-insoluble gold compounds of benzothiazole, benzoxazole, naphthothiazole and certain merocyanine and cyanine dyes, as illustrated by Yutzy et al. U.S. Pat. No. 2,597,915, and sulfinamides, as illustrated by Nishio et al. U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat.

No. 2,716,062, U.K. Patent No. 1,466,024 and Habu et al. U.S. Pat. No. 3,929,486; quaternary ammonium salts of the type illustrated by Piper U.S. Pat. No. 2,886,437; water-insoluble hydroxides, as illustrated by Maffet U.S. Pat. No. 2,953,455; phenols, as illustrated by Smith U.S. Pat. Nos. 2,955,037 and '038; ethylene diurea, as illustrated by Dersch U.S. Pat. No. 3,582,346; barbituric acid derivatives, as illustrated by Wood U.S. Pat. No. 3,617,290; boranes, as illustrated by Bigelow U.S. Pat. No. 3,725,078; 3-pyrazolidinones, as illustrated by Wood U.K. Patent No. 1,158,059 and aldoximines, amides, anilides and esters, as illustrated by Butler et al. U.K. Patent No. 988,052.

The emulsions can be protected from fog and desensitization caused by trace amounts of metals such as copper, lead, tin, iron and the like, by incorporating addenda, such as sulfocatechol-type compounds, as illustrated by Kennard et al. U.S. Pat. No. 3,236,652; aldoximines, as illustrated by Carroll et al. U.K. Pat. No. 623,448 and meta- and poly-phosphates, as illustrated by Draisbach U.S. Pat. No. 2,239,284, and carboxylic acids such as ethylenediamine tetraacetic acid, as illustrated by U.K. Pat. No. 691,715.

Among stabilizers useful in layers containing synthetic polymers of the type employed as vehicles and to improve covering power are monohydric and polyhydric phenols, as illustrated by Forsgard U.S. Pat. No. 3,043,697; saccharides, as illustrated by U.K. Pat. No. 897,497 and Stevens et al. U.K. Pat. No. 1,039,471 and quinoline derivatives, as illustrated by Dersch et al U.S. Pat. No. 3,446,618.

Among stabilizers useful in protecting the emulsion layers against dichroic fog are addenda, such as salts of nitron, as illustrated by Barbier et al. U.S. Pat. Nos. 3,679,424 and 3,820,998; mercaptocarboxylic acids, as illustrated by Willems et al. U.S. Pat. No. 3,600,178, and addenda listed by E. J. Birr, *Stabilization of Photographic Silver Halide Emulsions,* Focal Press, London, 1974, pp. 126–218.

Among stabilizers useful in protecting emulsion layers against development fog are addenda such as azabenzimidazoles, as illustrated by Bloom et al. U.K. Pat. No. 1,356,142 and U.S. Pat. No. 3,575,699, Rogers U.S. Pat. No. 3,473,924 and Carlson et al. U.S. Pat. No. 3,649,267; substituted benzimidazoles, benzothiazoles, benzotriazoles and the like, as illustrated by Brooker et al. U.S. Pat. No. 2,131,038, Land U.S. Pat. No. 2,704,721, Rogers et al. U.S. Pat. No. 3,265,498; mercapto-substituted compounds, e.g., mercaptotetrazoles, as illustrated by Dimsdale et al. U.S. Pat. No. 2,432,864, Rauch et al. U.S. Pat. No. 3,081,170, Weyerts et al. U.S. Pat. No. 3,260,597, Grasshoff et al. U.S. Pat. No. 3,674,478 and Arond U.S. Pat. No. 3,706,557; isothiourea derivatives, as illustrated by Herz et al. U.S. Pat. No. 3,220,839, and thiodiazole derivatives, as illustrated by von Konig U.S. Pat. No. 3,364,028 and von Konig et al. U.K. Pat. No. 1,186,441.

Where hardeners of the aldehyde type are employed, the emulsion layers can be protected with antifoggants, such as monohydric and polyhydric phenols of the type illustrated by Sheppard et al. U.S. Pat. No. 2,165,421; nitro-substituted compounds of the type disclosed by Rees et al. U.K. Pat. No. 1,269,268; poly(alkylene oxides), as illustrated by Valbusa U.K. Pat. No. 1,151,914, and mucohalogenic acids in combination with urazoles, as illustrated by Allen et al. U.S. Pat. Nos. 3,232,761 and 3,232,764, or further in combination with maleic acid hydrazide, as illustrated by Rees et al. U.S. Pat. No. 3,295,980.

To protect emulsion layers coated on linear polyester supports addenda can be employed such as parabanic acid, hydantoin acid hydrazides and urazoles, as illustrated by Anderson et al. U.S. Pat. No. 3,287,135, and piazines containing two symmetrically fused 6-member carbocyclic rings, especially in combination with an aldehyde-type hardening agent, as illustrated in Rees et al. U.S. Pat. No. 3,396,023.

Kink desensitization of the emulsions can be reduced by the incorporation of thallous nitrate, as illustrated by Overman U.S. Pat. No. 2,628,167; compounds, polymeric latices and dispersions of the type disclosed by Jones et al. U.S. Pat. Nos. 2,759,821 and '822; azole and mercaptotetrazole hydrophilic colloid dispersions of the type disclosed by *Research Disclosure,* Vol. 116, December 1973, Item 11684; plasticized gelatin compositions of the type disclosed by Milton et al. U.S. Pat. No. 3,033,680; water-soluble interpolymers of the type disclosed by Rees et al. U.S. Pat. No. 3,536,491; polymeric latices prepared by emulsion polymerization in the presence of poly-(alkylene oxide), as disclosed by Pearson et al. U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions, as illustrated by Abbott et al. U.S. Pat. No. 3,295,976, Barnes et al. U.S. Pat. No. 3,545,971, Salesin U.S. Pat. No. 3,708,303, Yamamoto et al. U.S. Pat. No. 3,615,619, Brown et al. U.S. Pat. No. 3,623,873, Taber U.S. Pat. No. 3,671,258, Abele U.S. Pat. No. 3,791,830, *Research Disclosure,* Vol. 99, July 1972, Item 9930, Florens et al. U.S. Pat. No. 3,843,364, Priem et al. U.S. Pat. No. 3,867,152, Adachi et al. U.S. Pat. No. 3,967,965 and Mikawa et al. U.S. Pat. Nos. 3,947,274 and 3,954,474.

In addition to increasing the pH or decreasing the pAg of an emulsion and adding gelatin, which are known to retard latent image fading, latent image stabilizers can be incorporated, such as amino acids, as illustrated by Ezekiel U.K. Pat. Nos. 1,335,923, 1,378,354, 1,387,654 and 1,391,672, Ezekiel et al. U.K. Pat. No. 1,394,371, Jefferson U.S. Pat. No. 3,843,372, Jefferson et al. U.K. Pat. No. 1,412,294 and Thurston U.K. Pat. No. 1,343,904; carbonyl-bisulfite addition products in combination with hydroxybenzene or aromatic amine developing agents, as illustrated by Seiter et al. U.S. Pat. No. 3,424,583; cycloalkyl-1,3-diones, as illustrated by Beckett et al. U.S. Pat. No. 3,447,926; enzymes of the catalase type, as illustrated by Matejec et al. U.S. Pat. No. 3,600,182; halogen-substituted hardeners in combination with certain cyanine dyes, as illustrated by Kumai et al U.S. Pat. No. 3,881,933; hydrazides, as illustrated by Honig et al. U.S. Pat. No. 3,386,831; alkenylbenzothiazolium salts, as illustrated by Arai et al. U.S. Pat. No. 3,954,478; soluble and sparingly soluble mercaptides, as illustrated by Herz U.S. Pat. No. 4,374,196, commonly assigned and here incorporated by reference; hydroxy-substituted benzylidene derivatives, as illustrated by Thurston U.K. Pat. No. 1,308,777 and Ezekiel et al. U.K. Pat. Nos. 1,347,544 and 1,353,527; mercapto-substituted compounds of the type disclosed by Sutherns U.S. Pat. No. 3,519,427; metal-organic complexes of the type disclosed by Matejec et al. U.S. Pat. No. 3,639,128; penicillin derivatives, as illustrated by Ezekiel U.K. Pat. No. 1,389,089; propynylthio derivatives of benzimidazoles, pyrimidines, etc., as illustrated by von Konig et al. U.S. Pat. No. 3,910,791; combinations of iridium and rhodium compounds, as disclosed by Yamasue et al. U.S. Pat. No. 3,901,713; sydnones or sydnone imines, as illustrated by Noda et al. U.S. Pat. No. 3,881,939; thiazolidine derivatives, as illustrated by Ezekiel U.K. Pat. No. 1,458,197 and thioether-substituted imidazoles, as illustrated by *Research Disclosure,* Vol. 136, August 1975, Item 13651.

In addition to sensitizers, hardeners, and antifoggants and stabilizers, a variety of other conventional photographic addenda can be present. The specific choice of addenda depends upon the exact nature of the photographic application and is well within the capability of the art. A variety of useful addenda are disclosed in *Research Disclosure,* Vol. 176, December 1978, Item 17643, here incorporated by reference. Optical brighteners can be introduced, as disclosed by Item 17643 at Paragraph V. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Method of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

In accordance with established practices within the art it is specifically contemplated to blend the high aspect ratio tabular grain emulsions of the present invention with each other or with conventional emulsions to satisfy specific emulsion layer requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape intermediate its toe and shoulder. To accomplish this the emulsions of this invention can be blended with conventional silver halide emulsions, such as those described in Item 17643, cited above, Paragraph I. It is specifically contemplated to blend the emulsions as described in sub-paragraph F of Paragraph I. When a relatively fine grain silver chloride emulsion is blended with or coated adjacent the emulsions of the present invention, particularly the silver bromoiodide emulsions, a further increase in the contrast and/or sensitivity—i.e., speed-granularity relationship—of the emulsion can result, as taught by Russell U.S. Pat. No. 3,140,179 and Godowsky U.S. Pat. No. 3,152,907.

In their simplest form photographic elements according to the present invention employ a single silver halide emulsion layer containing a high aspect ratio tabular grain emulsion according to the present invention and a photographic support. It is, of course, recognized that more than one silver halide emulsion layer as well as overcoat, subbing, and interlayers can be usefully included. Instead of blending emulsions as described above the same effect can usually by achieved by coating the emulsions to be blended as separate layers. Coating of separate emulsion layers to achieve exposure latitude is well known in the art, as illustrated by Zelikman and Levi, *Making and Coating Photographic Emulsions,* Focal Press, 1964, pp. 234–238; Wyckoff U.S. Pat. No. 3,663,228; and U.K. Pat. No. 923,045. It is further well known in the art that increased photographic speed can be realized when faster and slower silver halide emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamides, homo- and co-polymers of vinyl chloride, poly(vinyl acetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al. U.S. Pat. No. 3,478,128, are preferably employed as resin coatings over paper, as illustrated by Crawford et al. U.S. Pat. No. 3,411,908 and Joseph et al. U.S. Pat. No. 3,630,740, over polystyrene and polyester film supports, as illustrated by Crawford et al. U.S. Pat. No. 3,630,742, or can be employed as unitary flexible reflection supports, as illustrated by Venor et al. U.S. Pat. No. 3,973,963.

Preferred cellulose ester supports are cellulose triacetate supports, as illustrated by Fordyce et al. U.S. Pat. Nos. 2,492,977, '978 and 2,739,069, as well as mixed cellulose ester supports, such as cellulose acetate propionate and cellulose acetate butyrate, as illustrated by Fordyce et al. U.S. Pat. No. 2,739,070.

Preferred polyester film supports are comprised of linear polyester, such as illustrated by Alles et al. U.S. Pat. No. 2,627,088, Wellman U.S. Pat. No. 2,720,503, Alles U.S. Pat. No. 2,779,684 and Kibler et al. U.S. Pat. No. 2,901,466. Polyester films can be formed by varied techniques, as illustrated by Alles, cited above, Czerkas et al. U.S. Pat. No. 3,663,683 and Williams et al. U.S. Pat. No. 3,504,075, and modified for use as photographic film supports, as illustrated by Van Stappen U.S. Pat. No. 3,227,576, Nadeau et al. U.S. Pat. No. 3,501,301, Reedy et al. U.S. Pat. No. 3,589,905, Babbitt et al. U.S. Pat. No. 3,850,640, Bailey et al. U.S. Pat. No. 3,888,678, Hunter U.S. Pat. No. 3,904,420 and Mallinson et al. U.S. Pat. No. 3,928,697.

The photographic elements can employ supports which are resistant to dimensional change at elevated temperatures. Such supports can be comprised of linear condensation polymers which have glass transition temperatures above about 190° C., preferably 220° C., such as polycarbonates, polycarboxylic esters, polyamides, polysulfonamides, polyethers, polyimides, polysulfonates and copolymer variants, as illustrated by Hamb U.S. Pat. Nos. 3,634,089 and 3,772,405; Hamb et al. U.S. Pat. Nos. 3,725,070 and 3,793,249; Wilson *Research Disclosure,* Vol. 118, February 1974, Item 11833, and Vol. 120, April 1974, Item 12046; Conklin et al. *Research Disclosure,* Vol. 120, April 1974, Item 12012; *Product Licensing Index,* Vol. 92, December 1971, Items 9205 and 9207; *Research Disclosure,* Vol. 101, September 1972, Items 10119 and 10148; *Research Disclosure,* Vol. 106, February 1973, Item 10613; *Research Disclosure,* Vol. 117, January 1974, Item 11709, and *Research Disclosure,* Vol. 134, June 1975, Item 13455.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application No. W080/01614, published Aug. 7, 1980, (Belgian Patent No. 881,513, Aug. 1, 1980, corresponding), Blazey et al. U.S. Pat. No. 4,307,165 and Gilmour et al. U.S. Ser. No. 293,080, filed Aug. 17, 1981, here incorporated by reference. Microcells can range from 1 to 200 microns in width and up to 1000 microns in depth. It is generally preferred that the microcells be at least 4 microns in width and less than 200 microns in depth, with optimum dimensions being about 10 to 100 microns in width and depth for ordinary black-and-white imaging applications—particularly where the photographic image is intended to be enlarged.

The photographic elements of the present invention can be imagewise exposed in any conventional manner. Attention is directed to *Research Disclosure* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography—Materials, Processes and Systems,* VanNostrand Reinhold Company, 7th Ed ., 1977.

Included among the processing methods are web processing, as illustrated by Tregillus et al. U.S. Pat. No. 3,179,517; stabilization processing, as illustrated by Herz et al. U.S. Pat. No. 3,220,839, Cole U.S. Pat. No. 3,615,511, Shipton et al. U.K. Pat. No. 1,258,906 and Haist et al. U.S. Pat. No. 3,647,453; monobath processing as described in Haist, *Monobath Manual,* Morgan and Morgan, Inc., 1966, Schuler U.S. Pat. No. 3,240,603, Haist et al. U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al. U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al. U.S. Pat. No. 3,232,761; roller transport processing, as illustrated by Russell et al. U.S. Pat. Nos. 3,025,779 and 3,515,556, Masseth U.S. Pat. No. 3,573,914, Taber et al. U.S. Pat. No. 3,647,459 and Rees et al. U.K. Pat. No. 1,269,268; alkaline vapor processing, as illustrated by *Product Licensing Index,* Vol. 97, May 1972, Item 9711, Goffe et al. U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; reversal processing, as illustrated by Henn et al. U.S. Pat. No. 3,576,633; and surface application processing, as illustrated by Kitze U.S. Pat. No. 3,418,132.

Once a silver image has been formed in the photographic element, it is conventional practice to fix the undeveloped silver halide. The high aspect ratio tubular grain emulsions of the present invention are particularly advantageous in allowing fixing to be accomplished in a shorter time period. This allows processing to be accelerated.

d. Dye Imaging

The photographic elements and the techniques described above for producing silver images can be readily adapted to provide a colored image through the use of dyes. In perhaps the simplest approach to obtaining a projectable color image a conventional dye can be incorporated in the support of the photographic element, and silver image formation undertaken as described above. In areas where a silver image is formed the element is rendered substantially incapable of transmitting light therethrough, and in the remaining areas light is transmitted corresponding in color to the color of the support. In this way a colored image can be readily formed. The same effect can also be achieved by using a separate dye filter layer or element with a transparent support element.

The silver halide photographic elements can be used to form dye images therein through the selective destruction or formation of dyes. The photographic elements described above for forming silver images can be used to form dye images by employing developers containing dye image formers, such as color couplers, as illustrated by U.K. Pat. No. 478,984, Yager et al. U.S. Pat. No. 3,113,864, Vittum et al. U.S. Pat. Nos. 3,002,836, 2,271,238 and 2,362,598, Schwan et al. U.S. Pat. No. 2,950,970, Carroll et al. U.S. Pat. No. 2,592,243, Porter et al. U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al. U.S. Pat. Nos. 2,115,394, 2,252,718 and 2,108,602, and Pilato U.S. Pat. No. 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al., *Die Chemie,* Vol. 57, 1944, p. 113, Mannes et al. U.S. Pat. No. 2,304,940, Martinez U.S. Pat. No. 2,269,158, Jelley et al. U.S. Pat. No. 2,322,027, Frolich et al. U.S. Pat. No. 2,376,679, Fierke et al. U.S. Pat. No. 2,801,171, Smith U.S. Pat. No. 3,748,141, Tong U.S. Pat. No. 2,772,163, Thirtle et al. U.S. Pat. No. 2,835,579, Sawdey et al. U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930. The dye-forming couplers can be incorporated in different amounts to achieve differing photographic effects. For example, U.K. Pat. No. 923,045 and Kumai et al. U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al. U.S. Pat. Nos. 2,423,730, 2,772,162, 2,895,826, 2,710,803, 2,407,207, 3,737,316 and 2,367,531, Loria et al. U.S. Pat. Nos. 2,772,161, 2,600,788, 3,006,759, 3,214,437 and 3,253,924, McCrossen et al. U.S. Pat. No. 2,875,057, Bush et al. U.S. Pat. No. 2,908,573, Gledhill et al. U.S. Pat. No. 3,034,892, Weissberger et al. U.S. Pat. Nos. 2,474,293, 2,407,210, 3,062,653, 3,265,506 and 3,384,657, Porter et al. U.S. Pat. No. 2,343,703, Greenhalgh et al. U.S. Pat. No. 3,127,269, Feniak et al. U.S. Pat. Nos. 2,865,748, 2,933,391 and 2,865,751, Bailey et al. U.S. Pat. No. 3,725,067, Beavers et al. U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al. U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al. U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al. U.K. Pat. No. 1,248,924 and Whitmore et al. U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al. U.S. Pat. No. 3,148,062, Barr et al. U.S. Pat. No. 3,227,554, Barr U.S. Pat. No. 3,733,201, Sawdey U.S. Pat. No. 3,617,291, Groet et al. U.S. Pat. No. 3,703,375, Abbott et al. U.S. Pat. No. 3,615,506, Weissberger et al. U.S. Pat. No. 3,265,506, Seymour U.S. Pat. No. 3,620,745, Marx et al. U.S. Pat. No. 3,632,345, Mader et al. U.S. Pat. No. 3,869,291, U.K. Pat. No. 1,201,110, Oishi et al. U.S. Pat. No. 3,642,485, Verbrugghe U.K. Pat. No. 1,236,767, Fujiwhara et al. U.S. Pat. No. 3,770,436 and Matsuo et al. U.S. Pat. No. 3,808,945. Dye-forming couplers and nondye-forming compounds which upon coupling release a variety of photographically useful groups are described by Lau U.S. Pat. No. 4,248,962. DIR compounds which do not form dye upon reaction with oxidized color-developing agents can be employed, as illustrated by Fujiwhara et al. German OLS No. 2,529,350 and U.S. Pat. Nos. 3,928,041, 3,958,993 and 3,961,959, Odenwalder et al. German OLS No. 2,448,063, Tanaka et al. German OLS No. 2,610,546, Kikuchi et al. U.S. Pat. No. 4,049,455 and Credner et al. U.S. Pat. No. 4,052,213. DIR compounds which oxidatively cleave can be employed, as illustrated by Porter et al. U.S. Pat. No. 3,379,529, Green et al. U.S. Pat. No. 3,043,690, Barr U.S. Pat. No. 3,364,022, Duennebier et al. U.S. Pat. No. 3,297,445 and Rees et al. U.S. Pat. No. 3,287,129. Silver halide emulsions which are relatively light insensitive, such as Lippmann emulsions, have been utilized as interlayers and overcoat layers to prevent or control the migration of development inhibitor fragments as described in Shiba et al. U.S. Pat. No. 3,892,572.

The photographic elements can incorporate colored dye-forming couplers, such as those employed to form integral masks for negative color images, as illustrated by Hanson U.S. Pat. No. 2,449,966, Glass et al. U.S. Pat. No. 2,521,908, Gledhill et al. U.S. Pat. No. 3,034,892, Loria U.S. Pat. No. 3,476,563, Lestina U.S. Pat. No. 3,519,429, Friedman U.S. Pat. No. 2,543,691, Puschel et al. U.S. Pat. No. 3,028,238, Menzel et al. U.S. Pat. No. 3,061,432 and Greenhalgh U.K. Pat. No. 1,035,959, and/or competing couplers, as illustrated by Murin et al. U.S. Pat. No. 3,876,428, Sakamoto et al. U.S. Pat. No. 3,580,722, Puschel U.S. Pat. No. 2,998,314, Whitmore U.S. Pat. No. 2,808,329, Salminen U.S. Pat. No. 2,742,832 and Weller et al. U.S. Pat. No. 2,689,793.

The photographic elements can include image dye stabilizers. Such image dye stabilizers are illustrated by U.K. Pat. No. 1,326,889, Lestina et al. U.S. Pat. Nos. 3,432,300 and 3,698,909, Stern et al. U.S. Pat. No. 3,574,627, Brannock et al. U.S. Pat. No. 3,573,050, Arai et al. U.S. Pat. No. 3,764,337 and Smith et al. U.S. Pat. No. 4,042,394.

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette *Research Disclosure,* Vol. 148, August 1976, Items 14836, 14846 and 14847. The photographic elements can be particularly adapted to form dye images by such processes, as illustrated by Dunn et al. U.S. Pat. No. 3,822,129, Bissonette U.S. Pat. Nos. 3,834,907 and 3,902,905, Bissonette et al. U.S. Pat. No. 3,847,619 and Mowrey U.S. Pat. No. 3,904,413.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al. U.S. Pat. No. 3,754,923, Piller et al. U.S. Pat. No. 3,749,576, Yoshida et al. U.S. Pat. No. 3,738,839, Froelich et al. U.S. Pat. No. 3,716,368, Piller U.S. Pat. No. 3,655,388, Williams et al. U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al. U.S. Pat. Nos. 3,202,511 and 3,178,291 and Anderau et al. U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al. U.S. Pat. No. 3,684,513, Watanabe et al. U.S. Pat. No. 3,615,493, Wilson et al. U.S. Pat. No. 3,503,741, Boes et al. U.S. Pat. No. 3,340,059, Gompf et al. U.S. Pat. No. 3,493,372 and Puschel et al. U.S. Pat. No. 3,561,970, can be employed.

It is common practice in forming dye images in silver halide photographic elements to remove the developed silver by bleaching. Such removal can be enhanced by incorporation of a bleach accelerator or a precursor thereof in a processing solution or in a layer of the element. In some instances the amount of silver formed by development is small in relation to the amount of dye produced, particularly in dye image amplification, as described above, and silver bleaching is omitted without substantial visual effect. In still other applications the silver image is retained and the dye image is intended to enhance or supplement the density provided by the image silver. In the case of dye enhanced silver imaging it is usually preferred to form a neutral dye or a combination of dyes which together produce a neutral image. Neutral dye-forming couplers useful for this purpose are disclosed by Pupo et al. *Research Disclosure,* Vol. 162, October 1977, Item 16226. The enhancement of silver images with dyes in photographic elements intended for thermal processing is disclosed in *Research Disclosure,* Vol. 173, September 1973, Item 17326, and Houle U.S. Pat. No. 4,137,079. It is also possible to form monochromatic or neutral dye images using only dyes, silver being entirely removed from the image-bearing photographic elements by bleaching and fixing, as illustrated by Marchant et al. U.S. Pat. No. 3,620,747.

The photographic elements can be processed to form dye images which correspond to or are reversals of the silver halide rendered selectively developable by imagewise exposure. Reversal dye images can be formed in photographic elements having differentially spectrally sensitized silver halide layers by black-and-white development followed by (i) where the elements lack incorporated dye image formers, sequential reversal color development with developers containing dye image formers, such as color couplers, as illustrated by Mannes et al. U.S. Pat. No. 2,252,718, Schwan et al. U.S. Pat. No. 2,950,970 and Pilato U.S. Pat. No. 3,547,650; (ii) where the elements contain incorporated dye image formers, such as color couplers, a single color development step, as illustrated by the Kodak Ektachrome E4 and E6 and Agfa processes described in *British Journal of Photography Annual,* 1977, pp. 194–197, and *British Journal of Photography,* Aug. 2, 1974, pp. 668–669; and (iii) where the photographic elements contain bleachable dyes, silver-dye-bleach processing, as illustrated by the Cibachrome P-10 and P-18 processes described in the *British Journal of Photography Annual,* 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al. U.S. Pat. No. 3,647,452, Puschel et al. German Pat. No. 1,257,570 and U.S. Pat. Nos. 3,457,077 and 3,467,520, Accary-Venet et al. U.K. Pat. No. 1,132,736, Schranz et al. German Pat. No. 1,259,700, Marx et al. German Pat. No. 1,259,701 and Muller-Bore German OLS No. 2,005,091.

Dye images which correspond to the silver halide rendered selectively developable by imagewise exposure, typically negative dye images, can be produced by processing, as illustrated by the Kodacolor C-22, the Kodak Flexicolor C-41 and the Agfacolor processes described in *British Journal of Photography Annual,* 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206, such processes being particularly suited to processing color print materials, such as resin-coated photographic papers, to form positive dye images.

e. Partial grain development

It has been recognized and reported in the art that some photodetectors exhibit detective quantum efficiencies which are superior to those of silver halide photographic elements. A study of the basic properties of conventional silver halide photographic elements shows that this is largely due to the binary, on-off nature of individual silver halide grains, rather than their low quantum sensitivity. This is discussed, for example, by Shaw, "Multilevel Grains and the Ideal Photographic Detector", *Photographic Science and Engineering,* Vol. 16, No. 3, May/June 1972, pp. 192–200. What is meant by the on-off nature of silver halide grains is that once a latent mage center is formed on a silver halide grain, the grain becomes entirely developable. Ordinarily development is independent of the amount of light which has struck the grain above a threshold, latent image forming amount. The silver halide grain produces exactly the same product upon development whether it has absorbed many photons and formed several latent image centers or absorbed only the minimum number of photons to produce a single latent image center.

Upon exposure by light, for instance, latent image centers are formed in and on the silver halide grains of the high aspect ratio tabular grain emulsions of this invention. Some grains may have only one latent image center, some many and some none. However, the number of latent image centers formed is related to the amount of exposing radiation. Because the tabular grains can be relatively large in diameter and since their speed-granularity relationship can be high, particularly when formed of substantially optimally chemically and spectrally sensitized silver bromoiodide, their speed can be relatively high. Because the number of latent image centers in or on each grain is directly related to the amount of exposure that the grain has received, the potential is present for a high detective quantum efficiency, provided this information is not lost in development.

In a preferred form each latent image center is developed to increase its size without completely developing the silver halide grains. This can be undertaken by interrupting silver halide development at an earlier than usual stage, well before optimum development for ordinary photographic applications has been achieved. Another approach is to employ a DIR coupler and a color developing agent. The inhibitor released upon coupling can be relied upon to prevent complete development of the silver halide grains. In a preferred form of practicing this step self-inhibiting developers are employed. A self-inhibiting developer is one which initiates development of silver halide grains, but itself stops development before the silver halide grains have been entirely developed. Preferred developers are self-inhibiting developers containing p-phenylenediamines, such as disclosed by Neuberger et al., "Anomalous Concentration Effect: An inverse Relationship Between the Rate of Development and Developer Concentration of Some p-Phenylenediamines", *Photographic Science and Engineering,* Vol. 19, No. 6, November–December 1975, pp. 327–332. Whereas with interrupted development or development in the presence of DIR couplers silver halide grains having a longer development induction period than adjacent developing grains can be entirely precluded from development, the use of a self-inhibiting developer has the advantage that development of an individual silver halide grain is not inhibited until after some development of that grain has occurred.

Development enhancement of the latent image centers produces a plurality of silver specks. These specks are proportional in size and number to the degree of exposure of each grain. Inasmuch as the preferred self-inhibiting developers contain color developing agents, the oxidized developing agent produced can be reacted with a dye-forming coupler to create a dye image. However, since only a limited amount of silver halide is developed, the amount of dye which can be formed in this way is also limited. An approach which removes any such limitation on maximum dye density formation, but which retains the proportionality of dye density to the degree of exposure is to employ a silver catalyzed oxidation-reduction reaction using a peroxide or transition metal ion complex as an oxidizing agent and a dye-image-generating reducing agent, such as a color developing agent, as illustrated by the patents cited above of Bissonette, Travis, Dunn et al, Matejec, and Mowrey and the accompanying publications. In these patents it is further disclosed that where the silver halide grains form surface latent image centers the centers can themselves provide sufficient silver to catalyze a dye image amplification reaction. Accordingly, the step of enhancing the latent image by development is not absolutely essential, although it is preferred. In the preferred form any visible silver remaining in the photographic element after forming the dye image is removed by bleaching, as is conventional in color photography.

The resulting photographic image is a dye image which exhibits a point-to-point dye density which is proportional to the amount of exposing radiation. The result is that the detective quantum efficiency of the photographic element is quite high. High photographic speeds are readily obtainable, although oxidation reduction reactions as described above can contribute in increased levels of graininess.

Graininess can be reduced by employing a microcellular support as taught by Whitmore PCT application W080/01614, cited above. The sensation of graininess is created not just by the size of individual image dye clouds, but also by the randomness of their placement. By coating the emulsions in a regular array of microcells formed by the support and smearing the dye produced in each microcell so that it is uniform throughout, a reduced sensation of graininess can be produced.

Although partial grain development has been described above with specific reference to forming dye images, it can be applied to forming silver images as well. In developing to produce a silver image for viewing the graininess of the silver image can be reduced by terminating development before grains containing latent image sites have been completely developed. Since a greater number of silver centers or specks can be produced by partial grain development than by whole grain development, the sensation of graininess at a given density is reduced. (A similar reduction in graininess can also be achieved in dye imaging using incorporated couplers by limiting the concentration of the coupler so that it is present in less than its normally employed stoichiometric relationship to silver halide.) Although silver coverages in the photographic element must be initially higher to permit partial grain development to achieve maximum density levels comparable to those of total grain development, the silver halide that is not developed can be removed by fixing and recovered; hence the net consumption of silver need not be increased.

By employing partial grain development in silver imaging of photographic elements having microcellular supports it is possible to reduce silver image graininess similarly as described above in connection with dye imaging. For example, if a silver halide emulsion according to the present invention is incorporated in an array of microcells on a support and partially developed after imagewise exposure, a plurality of silver specks are produced proportional to the quanta of radiation received on exposure and the number of latent image sites formed. Although the covering power of the silver specks is low in comparison to that achieved by total grain development, it can be increased by fixing out undeveloped silver halide, rehalogenating the silver present in the microcells, and then physically developing the silver onto a uniform coating of physical development nuclei contained in the microcells. Since silver physically developed onto fine nuclei can have a much higher density than chemically developed silver, a much higher maximum density is readily obtained. Further, the physically developed silver produces a uniform density within each microcell. This produces a reduction in graininess, since the random occurrence of the silver density is replaced by the regularity of the microcell pattern.

f. Sensitivity as a function of spectral region

When the high aspect ratio tabular grain emulsions of the present invention are substantially optimally sensitized as described above within a selected spectral region and the sensitivity of the emulsion within that spectral region is compared to a spectral region to which the emulsion would be expected to possess native sensitivity by reason of its halide composition, it has been observed that a much larger sensitivity difference exists than has heretofore been observed in conventional emulsions. Inadequate separation of blue and green or red sensitivities of silver bromide and silver bromoiodide emulsions has long been a disadvantage in multicolor photography. The advantageous use of the spectral sensitivity differences of the silver bromide and bromoiodide emulsions of this invention are illustrated below with specific reference to multicolor photographic elements. It is to be recognized, however, that this is but an illustrative application. The increased spectral sensitivity differences exhibited by the emulsions of the present invention are not limited to multicolor photography or to silver bromide or bromoiodide emulsions. It can be appeciated that the spectral sensitivity sensitivity differences of the emulsions of this invention can be observed in single emulsion layer photographic elements. Further, advantages of increased spectral sensitivity differences can in varied applications be realized with emulsions of any halide composition known to be useful in photography. For example, while silver chloride and chlorobromide emulsions are known to possess sufficiently low native blue sensitivity that they can be used to record green or red light in multicolor photography without protection from blue light exposure, there are advantages in other applications for increasing the sensitivity difference between different spectral regions. For example, if a high aspect ratio tabular grain silver chloride emulsion is sensitized to infrared radiation and imagewise exposed in the spectral region of sensitization, it can thereafter be processed in light with less increase in minimum density levels because of the reduced sensitivity of the emulsions according to the invention in spectral regions free of spectral sensitization. From the foregoing other applications for the high aspect ratio tabular grain emulsions of the present invention permitting their large differences in sensitivity as a function of spectral region to be advantageously employed will be readily suggested to those skilled in the art.

g. Multicolor photography

The present invention can be employed to produce multicolor photographic images. Generally any conventional multicolor imaging element containing at least one silver halide emulsion layer can be improved merely by adding or substituting a high aspect ratio tabular grain emulsion according to the present invention. The present invention is fully applicable to both additive multicolor imaging and subtractive multicolor imaging.

To illustrate the application of this invention to additive multicolor imaging, a filter array containing interlaid blue, green, and red filter elements can be employed in combination with a photographic element according to the present invention capable of producing a silver image. A high aspect ratio tabular grain emulsion of the present invention which is panchromatically sensitized and which forms a layer of the photographic element is imagewise exposed through the additive primary filter array. After processing to produce a silver image and viewing through the filter array, a multicolor image is seen. Such images are best viewed by projection. Hence the photographic element and the filter array both have or share in common a transparent support.

Significant advantages can also be realized by the application of this invention to multicolor photographic elements which produce multicolor images from combinations of subtractive primary imaging dyes. Such photographic elements are comprised of a support and typically at least a triad of superimposed silver halide emulsion layers for separately recording blue, green, and red exposures as yellow, magenta, and cyan dye images, respectively. Although the present invention generally embraces any multicolor photographic element of this type including at least one high aspect ratio tabular grain silver halide emulsion, additional advantages can be realized when high aspect ratio tabular grain silver bromide and bromoiodide emulsions are employed. Consequently, the following description is directed to certain preferred embodiments incorporating silver bromide and bromoiodide emulsions, but high aspect ratio tabular grain emulsions of any halide composition can be substituted, if desired. Except as specifically otherwise described, the multicolor photographic elements can incorporate the features of the photographic elements described previously.

In a specific preferred form of the invention a minus blue sensitized high aspect ratio tabular grain silver bromide or bromoiodide emulsion according to the invention forms at least one of the emulsion layer intended to record green or red light in a triad of blue, green, and red recording emulsion layers of a multicolor photographic element and is positioned to receive during exposure of the photographic element to neutral light at 5500° K. blue light in addition to the light the emulsion is intended to record. The relationship of the blue and minus blue light the layer receives can be expressed in terms of Δ log E, where $$\Delta \log E = \log E_T - \log E_B$$

log $E_T$ being the log of exposure to green or red light the tabular grain emulsion is intended to record and log $E_B$ being the log of concurrent exposure to blue light the tabular grain emulsion also receives.

(In each occurrence exposure, E, is in meter-candle-seconds, unless otherwise indicated.)

In the practice of the present invention Δ log E can be less than 0.7 (preferably less than 0.3) while still obtaining acceptable image replication of a multicolor subject. This is surprising in view of the high proportion of grains present in the emulsions of the present invention having an average diameter of greater than 0.7 micron. If a comparable nontabular or lower aspect ratio tabular grain emulsion of like halide composition and average grain diameter is substituted for a high aspect ratio tabular grain silver bromide or bromoiodide emulsion of the present invention a higher and usually unacceptable level of color falsification will result. It is known in the art that color falsification by green or red sensitized silver bromide and bromoiodide emulsions can be reduced by reduction of average grain diameters, but this results in limiting maximum achievable photographic speeds as well. The present invention achieves not only advantageous separation in blue and minus blue speeds, but is able to achieve this advantage without any limitation on maximum realizable minus blue photographic speeds. In a specific preferred form of the invention at least the minus blue recording emulsion layers of the triad of blue, green, and red recording emulsion layers are silver bromide or bromoiodide emulsions according to the present invention. It is specifically contemplated that the blue recording emulsion layer of the triad can advantageously also be a high aspect ratio tabular grain emulsion according to the present invention. In a specific preferred form of the invention the tabular grains present in each of the emulsion layers of the triad having a thickness of less than 0.3 micron have an average grain diameter of at least 1.0 micron, preferably at least 2.0 microns. In a still further preferred form of the invention the multicolor photographic elements can be assigned on ISO speed index of at least 180.

The multicolor photographic elements of the invention need contain no yellow filter layer positioned between the exposure source and the high aspect ratio tabular grain green and/or red emulsion layers to protect these layers from blue light exposure, or the yellow filter layer, if present, can be reduced in density to less than any yellow filter layer density heretofore employed to protect from blue light exposure red or green recording emulsion layers of photographic elements intended to be exposed in daylight. In one specifically preferred form of the invention no blue recording emulsion layer is interposed between the green and/or red recording emulsion layers of the triad and the source of exposing radiation. Therefore the photographic element is substantially free of blue absorbing material between the green and/or red emulsion layers and incident exposing radiation. If, in this instance, a yellow filter layer is interposed between the green and/or red recording emulsion layers and incident exposing radiation, it accounts for all of the interposed blue density.

Although only one green or red recording high aspect ratio tabular grain silver bromide or bromoiodide emulsion as described above is required, the multicolor photographic element contains at least three separate emulsions for recording blue, green, and red light, respectively. The emulsions other than the required high aspect ratio tabular grain green or red recording emulsion can be of any convenient conventional form. Various conventional emulsions are illustrated by *Research Disclosure,* Item 17643, cited above, Paragraph I, Emulsion preparation and types, here incorporated by reference. In a preferred form of the invention all of the emulsion layers contain silver bromide or bromoiodide grains. In a particularly preferred form of the invention at least one green recording emulsion layer and at least one red recording emulsion layer is comprised of a high aspect ratio tabular grain emulsion according to this invention. If more than one emulsion layer is provided to record in the green and/or red portion of the spectrum, it is preferred that at least the faster emulsion layer contain high aspect ratio tabular grain emulsion as described above. It is, of course, recognized that all of the blue, green, and red recording emulsion layers of the photographic element can advantageously be tabular as described above, if desired, although this is not required for the practice of this invention.

The present invention is fully applicable to multicolor photographic elements as described above in which the speed and contrast of the blue, green, and red recording emulsion layers vary widely. The relative blue insensitivity of green or red spectrally sensitized high aspect ratio tabular grain silver bromide or silver bromoiodide emulsion layers employed in this invention allow green and/or red recording emulsion layers to be positioned at any location within a multicolor photographic element independently of the remaining emulsion layers and without taking any conventional precautions to prevent their exposure by blue light.

The present invention is particularly applicable to multicolor photographic elements intended to replicate colors accurately when exposed in daylight. Photographic elements of this type are characterized by producing blue, green, and red exposure records of substantially matched contrast and limited speed variation when exposed to a 5500° K. (daylight) source. The term "substantially matched contrast" as employed herein means that the blue, green, and red records differ in contrast by less than 20 (preferably less than 10) percent, based on the contrast of the blue record. The limited speed variation of the blue, green, and red records can be expressed as a speed variation ($\Delta$ log E) of less than 0.3 log E, where the speed variation is the larger of the differences between the speed of the green or red record and the speed of the blue record.

Both contrast and log speed measurements necessary for determining these relationships of the photographic elements of the invention can be determined by exposing a photographic element at a color temperature of 5500° K. through a spectrally nonselective (neutral density) step wedge, such as a carbon test object, and processing the photographic element, preferably under the processing conditions contemplated in use. By measuring the blue, green, and red densities of the photographic element to transmission of blue light of 435.8 nm in wavelength, green light of 546.1 nm in wavelength, and red light of 643.8 nm in wavelength, as described by American Standard PH2.1-1952, published by American National Standards Institute (ANSI), 1430 Broadway, New York, N.Y. 10018, blue, green, and red characteristic curves can be plotted for the photographic element. If the photographic element has a reflective support rather than a transparent support, reflection densities can be substituted for transmission densities. From the blue, green, and red characteristic curves speed and contrast can be ascertained by procedures well known to those skilled in the art. The specific speed and contrast measurement procedure followed is of little significance, provided each of the blue, green, and red records are identically measured for purposes of comparison. A variety of standard sensitometric measurement procedures for multicolor photographic elements intended for differing photographic applications have been published by ANSI. The following are representative: American Standard PH2.21-1979, PH2.47-1979, and PH2.27-1979.

The multicolor photographic elements of this invention capable of replicating accurately colors when exposed in daylight offer significant advantages over conventional photographic elements exhibiting these characteristics. In the photographic elements of the invention the limited blue sensitivity of the green and red spectrally sensitized tabular silver bromide or bromoiodide emulsion layers can be relied upon to separate the blue speed of the blue recording emulsion layer and the blue speed of the minus blue recording emulsion layers. Depending upon the specific application, the use of tabular grains in the green and red recording emulsion layers can per se provide a desirably large separation in the blue response of the blue and minus blue recording emulsion layers.

In some applications it may be desirable to increase further blue speed separations of blue and minus blue recording emulsion layers by employing conventional blue speed separation techniques to supplement the blue speed separations obtained by the presence of the high aspect ratio tabular grains. For example, if a photographic element places the fastest green recording emulsion layer nearest the exposing radiation source and the fastest blue recording emulsion layer farthest from the exposing radiation source, the separation of the blue speeds of the blue and green recording emulsion layers, though a full order of magnitude (1.0 log E) different when the emulsions are separately coated and exposed, may be effectively reduced by the layer order arrangement, since the green recording emulsion layer receives all of the blue light during exposure, but the green recording emulsion layer and other overlying layers may absorb or reflect some of the blue light before it reaches the blue recording emulsion layer. In such circumstance employing a higher proportion of iodide in the blue recording emulsion layer can be relied upon to supplement the tabular grains in increasing the blue speed separation of the blue and minus blue recording emulsion layers. When a blue recording emulsion layer is nearer the exposing radiation source than the minus blue recording emulsion layer, a limited density yellow filter material coated between the blue and minus blue recording emulsion layers can be employed to increase blue and minus blue separation. In no instance, however, is it necessary to make use of any of these conventional speed separation techniques to the extent that they in themselves provide an order of magnitude difference in the blue speed separation or an approximation thereof, as has heretofore been required in the art (although this is not precluded if exceptionally large blue and minus blue speed separation is desired for a specific application). Thus, the present invention achieves the objectives for multicolor photographic elements intended to replicate accurately image colors when exposed under balanced lighting conditions while permitting a much wider choice in element construction than has heretofore been possible.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from an adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al. U.S. Pat. No. 2,937,086 and/or in interlayers between adjacent color-forming layer units, as illustrated by Weissberger et al. U.S. Pat. No. 2,336,327.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three), blue, green, and/or red recording color-forming layer units in a single photographic element.

It is a unique feature of this invention that at least one green or red recording emulsion layer containing tabular silver bromide or bromoiodide grains as described above is located in the multicolor photographic element to receive an increased proportion of blue light during imagewise exposure of the photographic element. The increased proportion of blue light reaching the high aspect ratio tabular grain emulsion layer can result from reduced blue light absorption by an overlying yellow filter layer or, preferably, elimination of overlying yellow filter layers entirely. The increased proportion of blue light reaching the high aspect ratio tabular emulsion layer can result also from repositioning the color-forming layer unit in which it is contained nearer to the source of exposing radiation. For example, green and red recording color-forming layer units containing green and red recording high aspect ratio tabular grain emulsions, respectively, can be positioned nearer to the source of exposing radiation than a blue recording color-forming layer unit.

The multicolor photographic elements of this invention can take any convenient form consistent with the requirements indicated above. Any of the six possible layer arrangements of Table 27a, p. 221, disclosed by Gorokhovskii, *Spectral Studies of the Photographic Process,* Focal Press, New York, can be employed. To provide a simple, specific illustration, it is contemplated to add to a conventional multicolor silver halide photographic element during its preparation one or more high aspect ratio tabular grain emulsion layers sensitized to the minus blue portion of the spectrum and positioned to receive exposing radiation prior to the remaining emulsion layers. However, in most instances it is preferred to substitute one or more minus blue recording high aspect ratio tabular grain emulsion layers for conventional minus blue recording emulsion layers, optionally in combination with layer order arrangement modifications. The invention can be better appreciated by reference to the following preferred illustrative forms.

| Layer Order Arrangement I |
|---|
| Exposure |
| ↓ |
| B |
| IL |
| TG |
| IL |
| TR |

| Layer Order Arrangement II |
|---|
| Exposure |
| ↓ |
| TFB |
| IL |
| TFG |

-continued

| |
|---|
| IL |
| TFR |
| IL |
| SB |
| IL |
| SG |
| IL |
| SR |

Layer Order Arrangement III

| |
|---|
| Exposure |
| ↓ |
| TG |
| IL |
| TR |
| IL |
| B |

Layer Order Arrangement IV

| |
|---|
| Exposure |
| ↓ |
| TFG |
| IL |
| TFR |
| IL |
| TSG |
| IL |
| TSR |
| IL |
| B |

Layer Order Arrangement V

| |
|---|
| Exposure |
| ↓ |
| TFG |
| IL |
| TFR |
| IL |
| TFB |
| IL |
| TSG |
| IL |
| TSR |
| IL |
| SB |

Layer Order Arrangement VI

| |
|---|
| Exposure |
| ↓ |
| TFR |
| IL |
| TB |
| IL |
| TFG |
| IL |
| TFR |
| IL |
| SG |
| IL |
| SR |

Layer Order Arrangement VII

| |
|---|
| Exposure |
| ↓ |
| TFR |
| IL |
| TFG |
| IL |
| TB |
| IL |
| TFG |
| IL |
| TSG |
| IL |
| TFR |
| IL |
| TSR |

Layer Order Arrangement VIII

| |
|---|
| Exposure |
| ↓ |
| TFR |

-continued

| |
|---|
| IL |
| FB |
| SB |
| IL + YF |
| FG |
| SG |
| IL |
| FR |
| SR |

where

B, G, and R designate blue, green, and red recording color-forming layer units, respectively;

T appearing before the color-forming layer unit B, G, or R indicates that the emulsion layer or layers contain a high aspect ratio tabular grain silver bromide or bromiodide emulsion, as more specifically described above, F appearing before the color-forming layer unit B, G, or R indicates that the color-forming layer unit is faster in photographic speed than at least one other color-forming layer unit which records light exposure in the same third of the spectrum in the same Layer Order Arrangement;

S appearing before the color-forming layer unit B, G, or R indicates that the color-forming layer unit is slower in photographic speed than at least one other color-forming layer unit which records light exposure in the same third of the spectrum in the same Layer Order Arrangement;

YF designates a yellow filter material; and

IL designates an interlayer containing a scavenger, but substantially free of yellow filter material. Each faster or slower color-forming layer unit can differ in photographic speed from another color-forming layer unit which records light exposure in the same third of the spectrum as a result of its position in the Layer Order Arrangement, its inherent speed properties, or a combination of both.

In Layer Order Arrangements I through VII, the location of the support is not shown. Following customary practice, the support will in most instances be positioned farthest from the source of exposing radiation—that is, beneath the layers as shown. If the support is colorless and specularly transmissive—i.e., transparent, it can be located between the exposure source and the indicated layers. Stated more generally, the support can be located between the exposure source and any color-forming layer unit intended to record light to which the support is transparent.

Turning first to Layer Order Arrangement I, it can be seen that the photographic element is substantially free of yellow filter material. However, following conventional practice for elements containing yellow filter material, the blue recording color-forming layer unit lies nearest the source of exposing radiation. In a simple form each color-forming layer unit is comprised of a single silver halide emulsion layer. In another form each color-forming layer unit can contain two, three, or more different silver halide emulsion layers. When a triad of emulsion layers, one of highest speed from each of the color-forming layer units, are compared, they are preferably substantially matched in contrast and the photographic speed of the green and red recording emulsion layers differ from the speed of the blue recording emulsion layer by less than 0.3 log E. When there are two, three, or more different emulsion layers differing in speed in each color-forming layer unit, there are preferably two, three, or more triads of emulsion layers in Layer Order Arrangement I having the stated contrast and speed relationship. The absence of yellow filter material beneath the blue recording color-forming unit increases the photographic speed of this unit.

It is not necessary that the interlayers be substantially free of yellow filter material in Layer Order Arrangement I. Less than conventional amounts of yellow filter material can be located between the blue and green recording color-forming units without departing from the teachings of this invention. Further, the interlayer separating the green and red recording color-forming layer units can contain up to conventional amounts of yellow filter material without departing from the invention. Where conventional amounts of yellow filter material are employed, the red recording color-forming unit is not restricted to the use of tabular silver bromide or bromoiodide grains, as described above, but can take any conventional form, subject to the contrast and speed considerations indicated.

To avoid repetition, only features that distinguish Layer Order Arrangements II through VIII from Layer Order Arrangement I are specifically discussed. In Layer Order Arrangement II, rather than incorporate faster and slower blue, red, or green recording emulsion layers in the same color-forming layer unit, two separate blue, green, and red recording color-forming layer units are provided. Only the emulsion layer or layers of the faster color-forming units need contain tabular silver bromide or bromoiodide grains, as described above. The slower green and red recording color-forming layer units because of their slower speeds as well as the overlying faster blue recording color-forming layer unit, are adequately protected from blue light exposure without employing a yellow filter material. The use of high aspect ratio tabular grain silver bromide or bromoiodide emulsions in the emulsion layer or layers of the slower green and/or red recording color-forming layer units is, of course, not precluded. In placing the faster red recording color-forming layer unit above the slower green recording color-forming layer unit, increased speed can be realized, as taught by Eeles et al. U.S. Pat. No. 4,184,876, Ranz et al. German OLS No. 2,704,797, and Lohman et al. German OLS Nos. 2,622,923, 2,622,924, and 2,704,826.

Layer Order Arrangement III differs from Layer Order Arrangement I in placing the blue recording color-forming layer unit farthest from the exposure source. This then places the green recording color-forming layer unit nearest and the red recording color-forming layer unit nearer the exposure source. This arrangement is highly advantageous in producing sharp, high quality multicolor images. The green recording color-forming layer unit, which makes the most important visual contribution to multicolor imaging, as a result of being located nearest the exposure source is capable of producing a very sharp image, since there are no overlying layers to scatter light. The red recording color-forming layer unit, which makes the next most important visual contribution to the multicolor image, receives light that has passed through only the green recording color-forming layer unit and has therefore not been scattered in a blue recording color-forming layer unit. Though the blue recording color-forming layer unit suffers in comparison to Layer Order Arrangement I, the loss of sharpness does not offset the advantages realized in the green and red recording color-forming layer units, since the blue recording color-forming layer unit makes by far the least significant visual contribution to the mulicolor image produced.

Layer Order Arrangement IV expands Layer Order Arrangement III to include separate faster and slower high aspect ratio tabular grain emulsion containing green and red recording color-forming layer units. Layer Order Arrangement V differs from Layer Order Arrangement IV in providing an additional blue recording color-forming layer unit above the slower green, red, and blue recording color-forming layer units. The faster blue recording color-forming layer unit employs high aspect ratio tabular grain silver bromide or bromoiodide emulsion, as described above. The faster blue recording color-forming layer unit in this instance acts to absorb blue light and therefore reduces the proportion of blue light reaching the slower green and red recording color-forming layer units. In a variant form, the slower green and red recording color-forming layer units need not employ high aspect ratio tabular grain emulsions.

Layer Order Arrangement VI differs from Layer Order Arrangement IV in locating a tabular grain blue recording color-forming layer unit between the green and red recording color-forming layer units and the source of exposing radiation. As is pointed out above, the tabular grain blue recording color-forming layer unit can be comprised of one or more tabular grain blue recording emulsion layers and, where multiple blue recording emulsion layers are present, they can differ in speed. To compensate for the less favored position the red recording color-forming layer units would otherwise occupy, Layer Order Arrangement VI also differs from Layer Order Arrangement IV in providing a second fast red recording color-forming layer unit, which is positioned between the tabular grain blue recording color-forming layer unit and the source of exposing radiation. Because of the favored location which the second tabular grain fast red recording color-forming layer unit occupies it is faster than the first fast red recording layer unit if the two fast red-recording layer units incorporate identical emulsions. It is, of course, recognized that the first and second fast tabular grain red recording color-forming layer units can, if desired, be formed of the same or different emulsions and that their relative speeds can be adjusted by techniques well known to those skilled in the art. Instead of employing two fast red recording layer units, as shown, the second fast red recording layer unit can, if desired, be replaced with a second fast green recording color-forming layer unit. Layer Order Arrangement VII can be identical to Layer Order Arrangement VI, but differs in providing both a second fast tabular grain red recording color-forming layer unit and a second fast tabular grain green recording color-forming layer unit interposed between the exposing radiation source and the tabular grain blue recording color-forming layer unit.

Layer Order Arrangement VIII illustrates the addition of a high aspect ratio tabular grain red recording color-forming layer unit to a conventional multicolor photographic element. Tabular grain emulsion is coated to lie nearer the exposing radiation source than the blue recording color-forming layer units. Since the tabular grain emulsion is comparatively insensitive to blue light, the blue light striking the tabular grain emulsion does not unacceptably degrade the red record formed by the tabular grain red recording color-forming layer unit. The tabular grain emulsion can be faster than the silver halide emulsion present in the conventional fast red recording color-forming layer unit. The faster speed can be attributable to an intrinsically faster speed, the tabular grain emulsion being positioned to receive red light prior to the fast red recording color-forming layer unit in the conventional portion of the photographic element, or a combination of both. The yellow filter material in the interlayer beneath the blue recording color-forming layer units protects the conventional minus blue (green and red) color-forming layer units from blue exposure. Whereas in a conventional multicolor photographic element the red recording color-forming layer units are often farthest removed from the exposing radiation source and therefore tend to be slower and/or less sharp than the remaining color-forming layer units, in Arrangement VIII the red record receives a boost in both speed and sharpness from the additional tabular grain red recording color-forming layer unit. Instead of an additional tabular grain red recording color-forming layer unit, an additional tabular grain green recording color-forming unit can alternatively be added, or a combination of both tabular grain red and green recording color-forming layer units can be added. Although the conventional fast red recording layer unit is shown positioned between the slow green recording layer unit, it is appreciated that the relationship of these two units can be inverted, as illustrated in Layer Order Arrangement VI, for example.

There are, of course, many other advantageous layer order arrangements possible, Layer Order Arrangements I through VIII being merely illustrative. In each of the various Layer Order Arrangements corresponding green and red recording color-forming layer units can be interchanged—i.e., the faster red and green recording color-forming layer units can be interchanged in position in the various layer order arrangements and additionally or alternatively the slower green and red recording color-forming layer units can be interchanged in position.

Although photographic emulsions intended to form multicolor images comprised of combinations of subtractive primary dyes normally take the form of a plurality of superimposed layers containing incorporated dye-forming materials, such as dye-forming couplers, this is by no means required. Three color-forming components, normally referred to as packets, each containing a silver halide emulsion for recording light in one third of the visible spectrum and a coupler capable of forming a complementary subtractive primary dye, can be placed together in a single layer of a photographic element to produce multicolor images. Exemplary mixed packet multicolor photographic elements are disclosed by Godowsky U.S. Pat. Nos. 2,698,794 and 2,843,489. Although discussion is directed to the more common arrangement in which a single color-forming layer unit produces a single subtractive primary dye, relevance to mixed packet multicolor photographic elements will be readily apparent.

It is the relatively large separation in the blue and minus blue sensitivities of the green and red recording color-forming layer units containing tabular grain silver bromide or bromoiodide emulsions that permits reduction or elimination of yellow filter materials and/or the employment of novel layer order arrangements. One technique that can be employed for providing a quantitative measure of the relative response of green and red recording color-forming layer units to blue light in multicolor photographic elements is to expose through a step tablet a sample of a multicolor photographic element according to this invention employing first a neutral exposure source—i.e., light at 5500° K.—and thereafter to process the sample. A second sample is then identically exposed, except for the interposition of a Wratten 98 filter, which transmits only light between 400 and 490 nm, and thereafter identically processed. Using blue, green, and red transmission densities determined according to American Standard PH2.1-1952, as described above, three dye characteristic curves can be plotted for each sample. The difference in blue speed of the blue recording color-forming layer unit(s) and the blue speed of the green or red recording color-forming layer unit(s) can be determined from the relationship:

$$(B_{W98}-G_{W98})-(B_N-G_N) \quad \text{(A)}$$

or $$(B_{W98}-R_{W98})-(B_N-R_N) \quad \text{(B)}$$

where $B_{W98}$ is the blue speed of the blue recording color-forming layer unit(s) exposed through the Wratten 98 filter;

$G_{W98}$ is the blue speed of the green recording color-forming layer unit(s) exposed through the Wratten 98 filter;

$R_{W98}$ is the blue speed of the red recording color-forming layer unit(s) exposed through the Wratten 98 filter;

$B_N$ is the blue speed of the blue recording color-forming layer unit(s) exposed to neutral (5500° K.) light;

$G_N$ is the green speed of the green recording color-forming layer unit(s) exposed to neutral (5500° K.) light; and $R_N$ is the red speed of the red recording color-forming layer unit(s) exposed to neutral (5500° K.) light.

(The above description imputes blue, green, and red densities to the blue, green, and red recording color-forming layer units, respectively, ignoring unwanted spectral absorption by the yellow, magenta, and cyan dyes. Such unwanted spectral absorption is rarely of sufficient magnitude to affect materially the results obtained for the purposes they are here employed.)

The multicolor photographic elements of the present invention in the absence of any yellow filter material exhibit a blue speed by the blue recording color-forming layer units which is at least 6 times, preferably at least 8 times, and optimally at least 10 times the blue speed of green and/or red recording color-forming layer units containing high aspect ratio tabular grain emulsions, as described above. By way of comparison, an example below demonstrates that a conventional multicolor photographic element lacking yellow filter material exhibits a blue speed difference between the blue recording color-forming layer unit and the green recording color-forming layer unit(s) of less than 4 times (0.55 log E) as compared to nearly 10 times (0.95 log E) for a comparable multicolor photographic element according to the present invention. This comparison illustrates the advantageous reduction in blue speed of green recording color-forming layer units that can be achieved using high aspect ratio tabular grain silver bromide or bromoiodide emulsions.

Another measure of the large separation in the blue and minus blue sensitivities of multi-color photographic elements of the present invention is to compare the green speed of a green recording color-forming layer unit or the red speed of a red recording color-forming layer unit to its blue speed. The same exposure and processing techniques described above are employed, except that the neutral light exposure is changed to a minus blue exposure by interposing a Wratten 9 filter, which transmits only light beyond 490 nm. The quantitative difference being determined is $$G_{W9}-G_{W98} \quad (C)$$

or $$R_{W9}-R_{W98} \quad (D)$$

where $G_{W98}$ and $R_{W98}$ are defined above;

$G_{W9}$ is the green speed of the green recording color-forming layer unit(s) exposed through the Wratten 9 filter; and $R_{W9}$ is the red speed of the red recording color-forming layer unit(s) exposed through the Wratten 9 filter. (Again unwanted spectral absorption by the dyes is rarely material and is ignored.)

Red and green recording color-forming layer units containing tabular silver bromide or bromoiodide emulsions, as described above, exhibit a difference between their speed in the blue region of the spectrum and their speed in the portion of the spectrum to which they are spectrally sensitized (i.e., a difference in their blue and minus blue speeds) of at least 10 times (1.0 log E), preferably at least 20 times (1.3 log E). In an example below the difference is greater than 20 times (1.35 log E) while for the comparable conventional multicolor photographic element lacking yellow filter material this difference is less than 10 times (0.95 log E).

In comparing the quantitative relationships A to B and C to D for a single layer order arrangement, the results will not be identical, even if the green and red recording color-forming layer units are identical (except for their wavelengths of spectral sensitization). The reason is that in most instances the red recording color-forming layer unit(s) will be receiving light that has already passed through the corresponding green recording color-forming layer unit(s). However, if a second layer order arrangement is prepared which is identical to the first, except that the corresponding green and red recording color-forming layer units have been interchanged in position, then the red recording color-forming layer unit(s) of the second layer order arrangement should exhibit substantially identical values for relationships B and D that the green recording color-forming layer units of the first layer order arrangement exhibit for relationships A and C, respectively. Stated more succinctly, the mere choice of green spectral sensitization as opposed to red spectral sensitization does not significantly influence the values obtained by the above quantitative comparisons. Therefore, it is common practice not to differentiate green and red speeds in comparison to blue speed, but to refer to green and red speeds generically as minus blue speeds.

h. Reduced high-angle scattering

Figure 2:
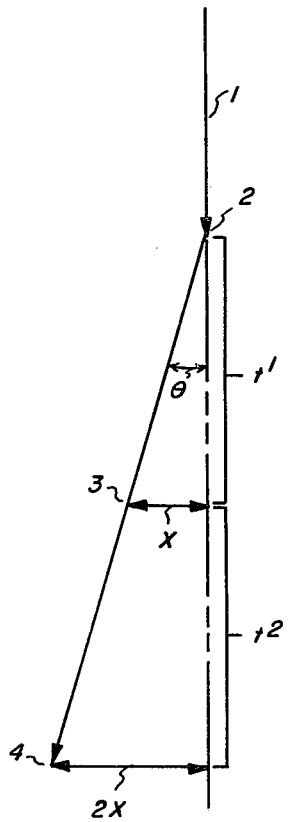
FIGS. 2 and 4 are schematic diagrams related to scattering.

The high aspect ratio tabular grain silver halide emulsions of the present invention are advantageous because of their reduced high angle light scattering as compared to nontabular and lower aspect ratio tabular grain emulsions. As discussed above with reference to FIG. 2, the art has long recognized that image sharpness decreases with increasing thickness of one or more silver halide emulsion layers. However from FIG. 2 it is also apparent that the lateral component of light scattering (x and 2x) increases directly with the angle $\theta$. To the extent that the angle $\theta$ remains small, the lateral displacement of scattered light remains small and image sharpness remains high.

Figure 4:
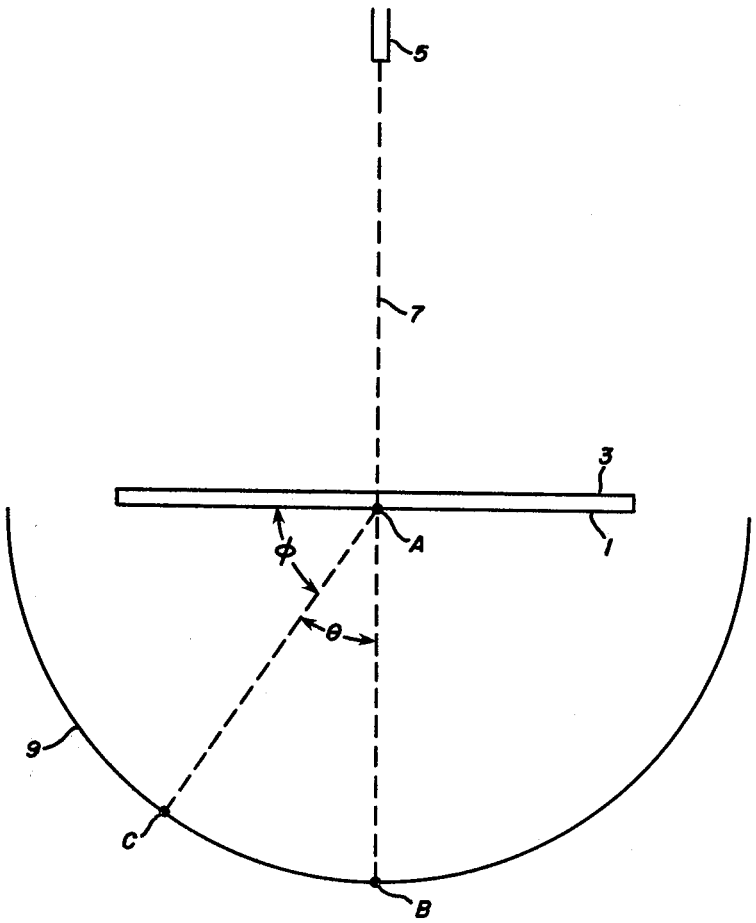

Advantageous sharpness characteristics obtainable with high aspect ratio tabular grain emulsions of the present invention are attributable to the reduction of high angle scattering. This can be quantitatively demonstrated. Referring to FIG. 4, a sample of an emulsion 1 according to the present invention is coated on a transparent (specularly transmissive) support 3 at a silver coverage of 1.08 g/m$^2$. Although not shown, the emulsion and support are preferably immersed in a liquid having a substantially matched refractive index to minimize Fresnel reflections at the surfaces of the support and the emulsion. The emulsion coating is exposed perpendicular to the support plane by a collimated light source 5. Light from the source following a path indicated by the dashed line 7, which forms an optical axis, strikes the emulsion coating at point A. Light which passes through the support and emulsion can be sensed at a constant distance from the emulsion at a hemispherical detection surface 9. At a point B, which lies at the intersection of the extension of the initial light path and the detection surface, light of a maximum intensity level is detected.

An arbitrarily selected point C is shown in FIG. 4 on the detection surface. The dashed line between A and C forms an angle $\phi$ with the emulsion coating. By moving point C on the detection surface it is possible to vary $\phi$ from 0° to 90°. By measuring the intensity of the light scattered as a function of the angle $\phi$ it is possible (because of the rotational symmetry of light scattering about the optical axis 7) to determine the cumulative light distribution as a function of the angle $\phi$. (For a background description of the cumulative light distribution see DePalma and Gasper, "Determining the Optical Properties of Photographic Emulsions by the Monte Carlo Method", *Photographic Science and Engineering*, Vol. 16, No. 3, May-June 1971, pp. 181–191.).

After determining the cumulative light distribution as a function of the angle $\phi$ at values from 0° to 90° for the emulsion 1 according to the present invention, the same procedure is repeated, but with a conventional emulsion of the same average grain volume coated at the same silver coverage on another portion of support 3. In comparing the cumulative light distribution as a function of the angle $\phi$ for the two emulsions, for values of $\phi$ up to 70° (and in some instances up to 80° and higher) the amount of scattered light is lower with the emulsions according to the present invention. In FIG. 4 the angle $\theta$ is shown as the complement of the angle $\phi$. The angle of scattering is herein discussed by reference to the angle $\theta$. Thus, the high aspect ratio tabular grain emulsions of this invention exhibit less high-angle scattering. Since it is high-angle scattering of light that contributes disproportionately to reduction in image sharpness, it follows that the high aspect ratio tabular grain emulsions of the present invention are in each instance capable of producing sharper images.

As herein defined the term "collection angle" is the value of the angle $\theta$ at which half of the light striking the detection surface lies within an area subtended by a cone formed by rotation of line AC about the polar axis at the angle $\theta$ while half of the light striking the detection surface strikes the detection surface within the remaining area.

While not wishing to be bound by any particular theory to account for the reduced high angle scattering properties of high aspect ratio tabular grain emulsions according to the present invention, it is believed that the large flat major crystal faces presented by the high aspect ratio tabular grains as well as the orientation of the grains in the coating account for the improvements in sharpness observed. Specifically, it has been observed that the tabular grains present in a silver halide emulsion coating are substantially aligned with the planar support surface on which they lie. Thus, light directed perpendicular to the photographic element striking the emulsion layer tends to strike the tabular grains substantially perpendicular to one major crystal face. The thinness of tabular grains as well as their orientation when coated permits the high aspect ratio tabular grain emulsion layers of this invention to be substantially thinner than conventional emulsion coatings, which can also contribute to sharpness. However, the emulsion layers of this invention exhibit enhanced sharpness even when they are coated to the same thicknesses as conventional emulsion layers.

In a specific preferred form of the invention the high aspect ratio tabular grain emulsion layers exhibit a minimum average grain diameter of at least 1.0 micron, most preferably at least 2 microns. Both improved speed and sharpness are attainable as average grain diameters are increased. While maximum useful average grain diameters will vary with the graininess that can be tolerated for a specific imaging application, the maximum average grain diameters of high aspect ratio tabular grain emulsions according to the present invention are in all instances less than 30 microns, preferably less than 15 microns, and optimally no greater than 10 microns.

In addition to producing the sharpness advantages indicated above at the average diameters indicated it is also noted that the high aspect ratio tabular grain emulsions avoid a number of disadvantages encountered by conventional emulsions in these large average grain diameters. First, it is difficult to prepare conventional, nontabular emulsions with average grain diameters above 2 microns. Second, referring to Farnell, cited above, it is noted that Farnell pointed to reduced speed performance at average grain diameters above 0.8 micron. Further, in employing conventional emulsions of high average grain diameters a much larger volume of silver is present in each grain as compared to tabular grains of comparable diameter. Thus, unless conventional emulsions are coated at higher silver coverages, which, of course, is a very real practical disadvantage, the graininess produced by the conventional emulsions of large average grain diameters is higher than the emulsions of this invention having the same average grain diameters. Still further, if large grain diameter conventional emulsions are employed, with or without increased silver coverages, then thicker coatings are required to accommodate the corresponding large thicknesses of the larger diameter grains. However, tabular grain thicknesses can remain very low even while diameters are above the levels indicated to obtain sharpness advantages. Finally, the sharpness advantages produced by tabular grains are in part a distinct function of the shape of the grains as distinguished from merely their average diameters and therefore capable of rendering sharpness advantages over conventional nontabular grains.

Although it is possible to obtain reduced high angle scattering with single layer coatings of high aspect ratio tabular grain emulsions according to the present invention, it does not follow that reduced high angle scattering is necessarily realized in multicolor coatings. In certain multicolor coating formats enhanced sharpness can be achieved with the high aspect ratio tabular grain emulsions of this invention, but in other multicolor coating formats the high aspect ratio tabular grain emulsions of this invention can actually degrade the sharpness of underlying emulsion layers.

Referring back to Layer Order Arrangement I, it can be seen that the blue recording emulsion layer lies nearest to the exposing radiation source while the underlying green recording emulsion layer is a tabular emulsion according to this invention. The green recording emulsion layer in turn overlies the red recording emulsion layer. If the blue recording emulsion layer contains grains having an average diameter in the range of from 0.2 to 0.6 micron, as is typical of many nontabular emulsions, it will exhibit maximum scattering of light passing through it to reach the green and red recording emulsion layers. Unfortunately, if light has already been scattered before it reaches the high aspect ratio tabular grain emulsion forming the green recording emulsion layer, the tabular grains can scatter the light passing through to the red recording emulsion layer to an even greater degree than a conventional emulsion. Thus, this particular choice of emulsions and layer arrangement results in the sharpness of the red recording emulsion layer being significantly degraded to an extent greater than would be the case if no emulsions according to this invention were present in the layer order arrangement.

In order to realize fully the sharpness advantages of the present invention in an emulsion layer that underlies a high aspect ratio tabular grain emulsion layer according to the present invention it is preferred that the the tabular grain emulsion layer be positioned to receive light that is free of significant scattering (preferably positioned to receive substantially specularly transmitted light). Stated another way, in the photographic elements of this invention improvements in sharpness in emulsion layers underlying tabular grain emulsion layers are best realized only when the tabular grain emulsion layer does not itself underlie a turbid layer. For example, if a high aspect ratio tabular grain green recording emulsion layer overlies a red recording emulsion layer and underlies a Lippmann emulsion layer and/or a high aspect ratio tabular grain blue recording emulsion layer according to this invention, the sharpness of the red recording emulsion layer will be improved by the presence of the overlying tabular grain emulsion layer or layers. Stated in quantitative terms, if the collection angle of the layer or layers overlying the high aspect ratio tabular grain green recording emulsion layer is less than about 10°, an improvement in the sharpness of the red recording emulsion layer can be realized. It is, of course, immaterial whether the red recording emulsion layer is itself a high aspect ratio tabular grain emulsion layer according to this invention insofar as the effect of the overlying layers on its sharpness is concerned.

In a multicolor photographic element containing superimposed color-forming units it is preferred that at least the emulsion layer lying nearest the source of exposing radiation be a high aspect ratio tabular grain emulsion in order to obtain the advantages of sharpness offered by this invention. In a specifically preferred form of the invention each emulsion layer which lies nearer the exposing radiation source than another image recording emulsion layer is a high aspect ratio tabular grain emulsion layer. Layer Order Arrangements II, III, IV, V, VI, VII, and VIII described above, are illustrative of multicolor photographic element layer arrangements according to the invention which are capable of imparting significant increases in sharpness to underlying emulsions layers.

Although the advantageous contribution of high aspect ratio tabular grain emulsions t image sharpness in multicolor photographic elements has been specifically described by reference to multicolor photographic elements, sharpness advantages can also be realized in multilayer black-and-white photographic elements intended to produce silver images. It is conventional practice to divide emulsions forming black-and-white images into faster and slower layers. By employing high aspect ratio tabular grain emulsions according to this invention in layers nearest the exposing radiation source the sharpness of underlying emulsion layers will be improved.

The invention is further illustrated by the following examples:

Examples to Illustrate Speed/Granularity Relationships of Silver Bromoiodides

A series of silver bromoiodide emulsions of varying aspect ratio were prepared as described below. In each of the examples under this and subsequent headings the contents of the reaction vessel were stirred vigorously throughout silver and halide salt introductions; the term "percent" means percent by weight, unless otherwise indicated; and the term "M" stands for a molar concentration, unless otherwise indicated. All solutions, unless otherwise stated are aqueous solutions. The physical descriptions of the emulsions are given in Table VI following the preparation of Emulsion No. 7.

A. Emulsion Preparation and Sensitization Emulsion 1 (Example)

To 5.5 liters of a 1.5 percent gelatin, 0.17 M potassium bromide solution at 80° C., were added with stirring and by double-jet, 2.2 M potassium bromide and 2.0 M silver nitrate solutions over a two minute period, while maintaining a pBr of 0.8 (consuming 0.56 percent of the total silver used). The bromide solution was stopped and the silver solution continued for 3 minutes (consuming 5.52 percent of the total silver used). The bromide and silver solutions were then run concurrently maintaining pBr 1.0 in an accelerated flow (2.2X from start to finish—i.e., 2.2 times faster at the end than at the start) over 13 minutes (consuming 34.8 percent of the total silver used). The bromide solution was stopped and the silver solution run for 1.7 minutes (consuming 6.44 percent of the total silver used). A 1.8 M potassium bromide solution which was also 0.24 M in potassium iodide was added with the silver salt solution for 15.5 minutes by double-jet in an accelerated flow (1.6X from start to finish), consuming 45.9 percent of the total silver used, maintaining a pBr of 1.6. The delayed introduction of iodide salts in this and subsequent examples reflect the teachings of Solberg et al., cited above). Both solutions were stopped and a 5 minute digest using 1.5 g sodium thiocyanate/Ag mole was carried out. A 0.18 M potassium iodide solution and the silver solution were double-jetted at equal flow rates until a pBr of 2.9 was reached (consuming 6.8 percent of the total silver used). A total of approximately 11 moles of silver were used. The emulsion was cooled to 30° C., and washed by the coagulation method of Yutzy and Russell U.S. Pat. No. 2,614,929. To the emulsion at 40° C. were added 464 mg/Ag mole of the green spectral sensitizer, anhydro-5-chloro-9-ethyl-5'-phenyl-3'-(3-sulfobutyl)-3-(3-sulfopropyl)-oxacarbocyanine hydroxide, sodium salt, and the pAg adjusted to 8.4 after a 20 minute hold. To the emulsion was added 3.5 mg/Ag mole of sodium thiosulfate pentahydrate and 1.5 mg/Ag mole of potassium tetrachloroaurate. The pAg was adjusted to 8.1 and the emulsion was then heated for 5 minutes at 65° C.

Emulsion 2 (Example)

To 5.5 liters of a 1.5 percent gelatin, 0.17 M potassium bromide solution at 80° C., pH 5.9, were added with stirring and by double-jet 2.1 M potassium bromide and 2.0 M silver nitrate solutions over a two minute period while maintaining a pBr of 0.8 (consuming 0.53 percent of the total silver used). The bromide solution was stopped and the silver solution continued for 4.6 minutes at a rate consuming 8.6 percent of the total silver used. The bromide and silver solutions were then run concurrently for 13.3 minutes, maintaining a pBr of 1.2 in an accelerated flow (2.5X from start to finish), consuming 43.6 percent of the total silver used. The bromide solution was stopped and the silver solution run for one minute (consuming 4.7 percent of the total silver used).

A 2.0 M potassium bromide solution which was also 0.30 M in potassium iodide was double-jetted with the silver solution for 13.3 minutes in an accelerated flow (1.5X from start to finish), maintaining a pBr of 1.7, and consuming 35.9 percent of the total silver used. To the emulsion was added 1.5 g/Ag mole of sodium thiocyanate and the emulsion was held for 25 minutes. A 0.35 M potassium iodide solution and the silver solution were double-jetted at a constant equal flow rate for approximately 5 minutes until a pBr of 3.0 was reached (consuming approximately 6.6 percent of the total silver used). The total silver consumed was approximately 11 moles. A solution of 350 g of phthalated gelatin in 1.2 liters of water was then added, the emulsion cooled to 30° C., and washed by the coagulation method of Example 1. The emulsion was then optimally spectrally and chemically sensitized in a manner similar to that described for Emulsion 1. Phthalated gelatin is described in Yutzy et al. U.S. Pat. Nos. 2,614,928 and '929.

Emulsion 3 (Example)

To 30.0 liters of a 0.8 percent gelatin, 0.10 M potassium bromide solution at 75° C. were added with stirring and by double-jet, 1.2 M potassium bromide and 1.2 M silver nitrate solution over a 5 minute period while maintaining a pBr of 1.0 (consuming 2.1 percent of the total silver used). A 5.0 liter solution containing 17.6 percent phthalated gelatin was then added, and the emulsion held for one minute. The silver nitrate solution was then run into the emulsion until a pBr of 1.35 was attained, consuming 5.24 percent of the total silver used. A 1.06 M potassium bromide solution which was also 0.14 M in potassium iodide was double-jetted with the silver solution in an accelerated flow (2X from start to finish) consuming 92.7 percent of the total silver used, and maintaining pBr 1.35. A total of approximately 20 moles of silver was used. The emulsion was cooled to 35° C., coagulation washed, and optimally spectrally and chemically sensitized in a manner similar to that described for Emulsion 1.

Emulsion 4 (Example)

To 4.5 liters of a 1.5 percent gelatin, 0.17 M potassium bromide solution at 55° C., pH 5.6, were added with stirring and by double-jet, 1.8 M potassium bromide and 2.0 M silver nitrate solutions at a constant equal rate over a period of one minute at a pBr of 0.8 (consuming 0.7 percent of the total silver used). The bromide, silver, and a 0.26 M potassium iodide solution were then run concurrently at an equal constant rate over 7 minutes, maintaining pBr 0.8, and consuming 4.8 percent of the total silver used. The triple run was then continued over an additional period of 37 minutes maintaining pBr 0.8 in an accelerated flow (4X from start to finish), consuming 94.5 percent of the total silver used. A total of approximately 5 silver moles was used. The emulsion was cooled to 35° C., 1.0 liter of water containing 200 g of phthalated gelatin was added, and the emulsion was coagulation washed. The emulsion was then optimally spectrally and chemically sensitized in a manner similar to that described in Emulsion 1.

Emulsion 5 (Control)

This emulsion was precipitated in the manner described in U.S. Pat. No. 4,184,877 of Maternaghan.

To a 5 percent solution of gelatin in 17.5 liters of water at 65° C. were added with stirring and by double-jet 4.7 M ammonium iodide and 4.7 M silver nitrate solutions at a constant equal flow rate over a 3 minute period while maintaining a pI of 2.1 (consuming approximately 22 percent of the silver used in the seed grain preparation). The flow of both solutions was then adjusted to a rate consuming approximately 78 percent of the total silver used in the seed grain preparation over a period of 15 minutes. The run of the ammonium iodide solution was then stopped, and the addition of the silver nitrate solution continued to a pI of 5.0. A total of approximately 56 moles of silver was used in the preparation of the seed grains. The emulsion was cooled to 30° C. and used as a seed grain emulsion for further precipitation as described hereinafter. The average grain diameter of the seed grains was 0.24 micron.

A 15.0 liter 5 percent gelatin solution containing 4.1 moles of the 0.24 μm AgI emulsion (as prepared above) was heated to 65° C. A 4.7 M ammonium bromide solution and a 4.7 M silver nitrate solution were added by double-jet at an equal constant flow rate over a period of 7.1 minutes while maintaining a pBr of 4.7 (consuming 40.2 percent of the total silver used in the precipitation of the seed grains). Addition of the ammonium bromide solution alone was then continued until a pBr of approximately 0.9 was attained at which time it was stopped. A 2.7 liter solution of 11.7 M ammonium hydroxide was then added, and the emulsion was held for 10 minutes. The pH was adjusted to 5.0 with sulfuric acid, and the double-jet introduction of the ammonium bromide and silver nitrate solution was resumed for 14 minutes maintaining a pBr of approximately 0.9 and at a rate consuming 56.8 percent of the total silver consumed. The pBr was then adjusted to 3.3 and the emulsion cooled to 30° C. A total of approximately 87 moles of silver was used. 900 g of phthalated gelatin were added, and the emulsion was coagulation washed.

The pAg of the emulsion was adjusted to 8.8 and to the emulsion was added 4.2 mg/Ag mole of sodium thiosulfate pentahydrate and 0.6 mg/Ag mole of potassium tetrachloroaurate. The emulsion was then heated finished for 16 minutes at 80° C., cooled to 40° C., 387 mg/Ag mole of the green spectral sensitizer, anhydro-5-chloro-9-ethyl-5'-phenyl-3'-(3-sulfobutyl)-3-(3-sulfopropyl)oxacarbocyanine hydroxide, sodium salt, was added and the emulsion was held for 10 minutes. Chemical and spectral sensitization was optimum for the sensitizers employed.

Emulsion No. 6 (Control)

This emulsion is of the type described in Illingsworth U.S. Pat. No. 3,320,069.

To 42.0 liters of a 0.050 M potassium bromide, 0.012 M potassium iodide and 0.051 M potassium thiocyanate solution at 68° C. containing 1.25 percent phthalated gelatin, were added by double-jet with stirring at equal flow rates a 1.32 M potassium bromide solution which was also 0.11 M in potassium iodide and a 1.43 M silver nitrate solution, over a period of approximately 40 minutes. The precipitation consumed 21 moles of silver. The emulsion was then cooled to 35° C. and coagulation washed by the method of Yutzy and Frame U.S. Pat. No. 2,614,928.

The pAg of the emulsion was adjusted to 8.1 and to the emulsion was added 5.0 mg/Ag mole of sodium thiosulfate pentahydrate and 2.0 mg/Ag mole of potassium tetrachloroaurate. The emulsion was then heat finished at 65° C., cooled to 40° C., 464 mg/Ag mole of the green spectral sensitizer, anhydro-5-chloro-9-ethyl-5'-phenyl-3'-(3-sulfobutyl)-3-(3-sulfopropyl)oxacarbocyanine hydroxide, sodium salt, was added and the emulsion was held for 10 minutes. Chemical and spectral sensitization was optimum for the sensitizers employed.

Emulsion No. 7 (Control)

This emulsion is of the type described in Illingsworth U.S. Pat. No. 3,320,069.

To 42.0 liters of a 0.050 M potassium bromide, 0.012 M potassium iodide, and 0.051 M potassium thiocyanate solution at 68° C. containing 1.25 percent phthalated gelatin, were added by double-jet with stirring at equal flow rates a 1.37 M potassium bromide solution which was also 0.053 M in potassium iodide, and a 1.43 M silver nitrate solution, over a period of approximately 40 minutes. The precipitation consumed 21 moles of silver. The emulsion was then cooled to 35° C. and coagulation washed in the same manner as Emulsion 6.

The pAg of the emulsion was adjusted to 8.8 and to the emulsion was added 10 mg/Ag mole of sodium thiosulfate pentahydrate and 2.0 mg/Ag mole of potassium tetrachloroaurate. The emulsion was then heat finished at 55° C., cooled to 40° C., 387 mg/Ag mole of the green spectral sensitizer, anhydro-5-chloro-9-ethyl-5'-phenyl-3'-(3-sulfobutyl)-3-(3-sulfopropyl)oxacarbocyanine hydroxide, sodium salt, was added and the emulsion was held for 10 minutes. Chemical and spectral sensitization was optimum for the sensitizers employed.

TABLE VI

PHYSICAL DESCRIPTIONS OF BROMOIODIDE EMULSION 1-7

| Emulsion No. | Iodide Content (M % I) | Tabular Grain Diameter (μm) | Tabular Grain Thickness (μm) | Average Aspect Ratio | % of Projected Area |
|---|---|---|---|---|---|
| Example 1 | 6 | ≅3.8 | 0.14 | 27:1 | >50 |
| Example 2 | 1.2 | ≅3.8 | 0.14 | 27:1 | 75 |
| Example 3 | 12.0 | 2.8 | 0.15 | 19:1 | >90 |
| Example 4 | 12.3 | 1.8 | 0.12 | 15:1 | >50 |
| Control 5 | 4.7 | 1.4 | 0.42 | 3.3:1 | — |
| Control 6 | 10 | 1.1 | ≅0.40 | 2.8:1 | — |
| Control 7 | 5 | 1.0 | ≅0.40 | 2.5:1 | — |

Emulsions 1 through 4 were high aspect ratio tabular grain emulsions within the definition limits of this patent application. Although some tabular grains of less than 0.6 micron in diameter were including in computing the tabular grain average diameters and percent projected area in these and subsequent example emulsions, except where this exclusion is specifically noted, insufficient small diameter tabular grains were present to alter significantly the numbers reported.

To obtain a representative average aspect ratio for the grains of the control emulsions the average grain diameter was compared to the average grain thickness. Although not measured, the projected area that could be attributed to the few tabular grains meeting the less than 0.3 micron thickness and at least 0.6 micron diameter criteria was in each instance estimated by visual inspection to account for very little, if any, of the total projected area of the total grain population of the control emulsions.

B. Speed/Granularity of Single Layer Incorporated Coupler Photographic Materials The chemically and spectrally sensitized emulsions (Emulsion Nos. 1–7) were separately coated in a single-layer magenta format on a cellulose triacetate film support. Each coated element comprised silver halide emulsions at 1.07 g/m$^2$ silver, gelatin at 2.14 g/m$^2$, a solvent dispersion of the magenta image-forming coupler 1-(2,4-dimethyl-6-chlorophenyl)-3-[α-(3-n-pentadecylphenoxy)-butyramido]-5-pyrazolone at 0.75 g/m$^2$ coupler, the antistain agent 5-sec-octadecylhydroquinone-2-sulfonate, potassium salt at 3.2 g/Ag mole, and the antifoggant 4-hydroxy-6-methyl-1,3,3a,7-tetraazaindene at 3.6 g/Ag mole. An overcoat layer, comprising gelatin at 0.88 g/m$^2$ and the hardener bis(-vinylsulfonylmethyl)ether at 1.75 percent based on total gelatin weight, was applied.

The resulting photographic elements were exposed for 1/100 of a second through a 0–3.0 density step tablet plus a Wratten No. 9 filter and 1.26 neutral density filter, to a 600W, 3000° K. tungsten light source. Processing was accomplished at 37.7° C. in a color process of the type described in the *British Journal of Photography Annual,* 1979, pp. 204–206. The development times were varied to produce fog densities of about 0.10. The relative green sensitivity and the rms granularity were determined for each of the photographic elements. (The rms granularity is measured by the method described by H. C. Schmitt, Jr. and J. H. Altman, *Applied Optics,* 9, pp. 871–874, April 1970.)

Figure 5:
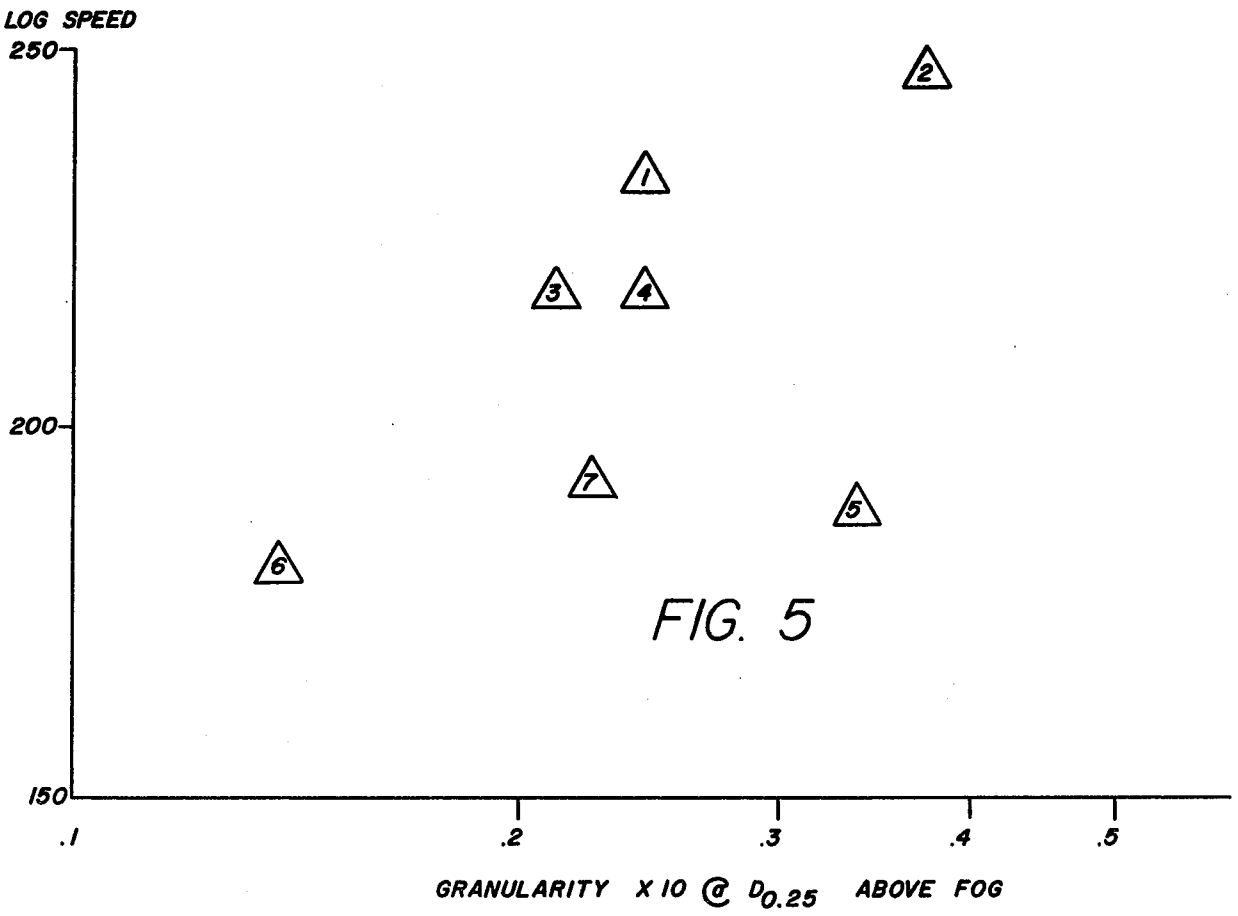

The speed-granularity relationship for these coatings is conveniently shown on a plot of Log Green Speed vs. rms Granularity X 10 in FIG. 5. It is clearly shown in FIG. 5 that optimally chemically and spectrally sensitized silver bromoiodide emulsions having high aspect ratios exhibit a much better speed-granularity relationship than do the low aspect ratio silver bromoiodide emulsions.

It should be noted that the use of a single-layer format, where all the silver halide emulsions are coated at equal silver coverage and with a common silver/coupler ratio, is the best format to illustrate the speed-granularity performance of a silver halide emulsion without introducing complicating interactions. For example, it is well known to those skilled in the photographic art that there are many methods of improving the speed-granularity relationship of a color photographic element. Such methods include multiple-layer coating of the silver halide emulsion units sensitive to a given region of the visible spectrum. This technique allows control of granularity by controlling the silver/-coupler ratio in each of the layers of the unit. Selecting couplers on the basis of reactivity is also known as a method of modifying granularity. The use of competing couplers, which react with oxidized color developer to either form a soluble dye or a colorless compound, is a technique often used. Another method of reducing granularity is the use of development inhibitor releasing couplers and compounds.

C. Speed/Granularity Improvement in a Multilayer Incorporated Coupler Photographic Element A multicolor, incorporated coupler photographic element was prepared by coating the following layers on a cellulose triacetate film support in the order recited:

| | |
|---|---|
| Layer 1 | Slow Cyan Layer -- comprising red-sensitized silver bromoiodide grains, gelatin, cyan image-forming coupler, colored coupler, and DIR coupler. |
| Layer 2 | Fast Cyan Layer -- comprising faster red-sensitized silver bromoiodide grains, gelatin, cyan image-forming coupler, colored coupler, and DIR coupler. |
| Layer 3 | Interlayer -- comprising gelatin and 2,5-di-sec-dodecylhydroquinone antistain agent. |
| Layer 4 | Slow Magenta Layer -- comprising green-sensitized silver bromoiodide grains (1.48 g/m$^2$ silver), gelatin (1.21 g/m$^2$), the magenta coupler 1-(2,4,6-trichlorophenyl)-3-[3-(2,4-diamylphenoxyacetamido)-benzamido]- 5-pyrazolone (0.88 g/m$^2$), the colored coupler 1-(2,4,6-trichlorophenyl)-3-[α-(3-tert-butyl-4-hydroxyphenoxy)tetradecanamido-2-chloroanilino]-4-(3,4-dimethoxy)- phenylazo-5-pyrazolone (0.10 g/m$^2$), the DIR coupler 1-{4-[α-(2,4-di-tert-amylphenoxy)butyramido]-phenyl}-3-pyrrolidino-4-(1-phenyl-5-tetrazolylthio)-5-pyrazolone (0.02 g/m$^2$) and the antistain agent 5-sec-octadecylhydroquinone-2-sulfonate, potassium salt (0.09 g/m$^2$) |
| Layer 5 | Fast Magenta Layer -- comprising faster green-sensitized silver bromoiodide grains (1.23 g/m$^2$ silver), gelatin (0.88 g/m$^2$), the magenta coupler 1-(2,4,6-trichlorophenyl)-3-[3-(2,4-diamylphenoxyacetamido)-benzamido]-5-pyrazolone (0.12 g/m$^2$), the colored coupler 1-(2,4,6-trichlorophenyl)-3-[α-(3-tert-butyl-4-hydroxyphenoxy)tetradecanamido-2-chloroanilino]-4-(3,4-dimethoxy)phenylazo-5-pyrazolone (0.03 g/m$^2$), and the antistain agent 5-sec-octadecylhydroquinone-2-sulfonate, potassium salt (0.05 g/m$^2$). |
| Layer 6 | Interlayer -- comprising gelatin and |

-continued

| | |
|---|---|
| | 2,5-di-sec-dodecylhydroquinone antistain agent. |
| Layer 7 | Yellow Filter Layer -- comprising yellow colloidal silver and gelatin. |
| Layer 8 | Slow Yellow Layer -- comprising blue-sensitized silver bromoiodide grains, gelatin, a yellow dye-forming coupler, and the antistain agent 5-sec-octadecylhydroquinone-2-sulfonate, potassium salt. |
| Layer 9 | Fast Yellow Layer -- comprising faster blue-sensitized silver bromoiodide grains, gelatin, a yellow-forming coupler and the antistain agent 5-sec-octadecylhydroquinone-2-sulfonate, potassium salt. |
| Layer 10 | UV Absorbing Layer -- comprising the UV absorber 3-(di-n-hexylamino)allylidenemalononitrile and gelatin. |
| Layer 11 | Protective Overcoat Layer -- comprising gelatin and bis(vinylsulfonylmethyl)ether. |

The silver halide emulsions in each color image-forming layer of this coating contained polydisperse, low aspect ratio grains of the type described in Illingsworth U.S. Pat. No. 3,320,069. The emulsions were all optimally sensitized with sulfur and gold in the presence of thiocyanate and were spectrally sensitized to the appropriate regions of the visible spectrum. The emulsion utilized in the Fast Magenta Layer was a polydisperse (0.5 to 1.5 μm) low aspect ratio (≃3:1) silver bromoiodide (12 M% iodide) emulsion which was prepared in a manner similar to Emulsion No. 6 described above.

A second multicolor image-forming photographic element was prepared in the same manner, except the Fast Magenta Layer utilized a tabular grain silver bromoiodide (8.4 M% iodide) emulsion in place of the low aspect ratio emulsion described above. The emulsion had an average tabular grain diameter of about 2.5 μm, a tabular grain thickness of less than or equal to 0.12 μm, and an average tabular grain aspect ratio of greater than 20:1, and the projected area of the tabular grains was greater than 75 percent, measured as described above. The high and low aspect ratio emulsions were both similarly optimally chemically and spectrally sensitized according to the teachings of this invention.

Both photographic elements were exposed for 1/50 second through a multicolor 0–3.0 density step tablet (plus 0.60 neutral density) to a 600W 5500° K. tungsten light source. Processing was for 3¼ minutes in a color developer of the type described in the *British Journal of Photography Annual,* 1979, pp. 204–206. Sensitometric results are given in Table VII below.

TABLE VII

Comparison of Tabular (High Aspect Ratio) and Three-Dimensional (Low Aspect Ratio) Grain Emulsions in Multilayer, Multicolor Image-Forming Elements

| Fast Magenta Layer | Red Log Speed | Green Log Speed | Green rms.* Gran. | Blue Log Speed |
|---|---|---|---|---|
| Control | 225 | 220 | 0.011 | 240 |
| Example | 225 | 240 | 0.012 | 240 |

*Measured at a density of 0.25 above fog; 48 μm aperture.

The results in the above Table VII illustrate that the tabular grains of the present invention provided a substantial increase in green speed with very little increase in granularity.

D. Speed/Granularity of Black-and-White Photographic Materials

To illustrate speed/granularity advantage in black-and-white photographic materials five of the chemically and spectrally sensitized emulsions described above, Emulsions. 1, 4, 5, 6, and 7, were coated on a poly(ethylene terephthalate) film support. Each coated element comprised a silver halide emulsion at 3.21 g/m$^2$ silver and gelatin at 4.16 g/m$^2$ to which had been added the antifoggant 4-hydroxy-6-methyl-1,3,3a-7-tetraazaindene at 3.6 g/silver mole. An overcoat layer, comprising gelatin at 0.88 g/m$^2$ and the hardener bis(vinylsulfonylmethyl)ether at 1.75 percent based on total gelatin content, was applied.

Figure 6:
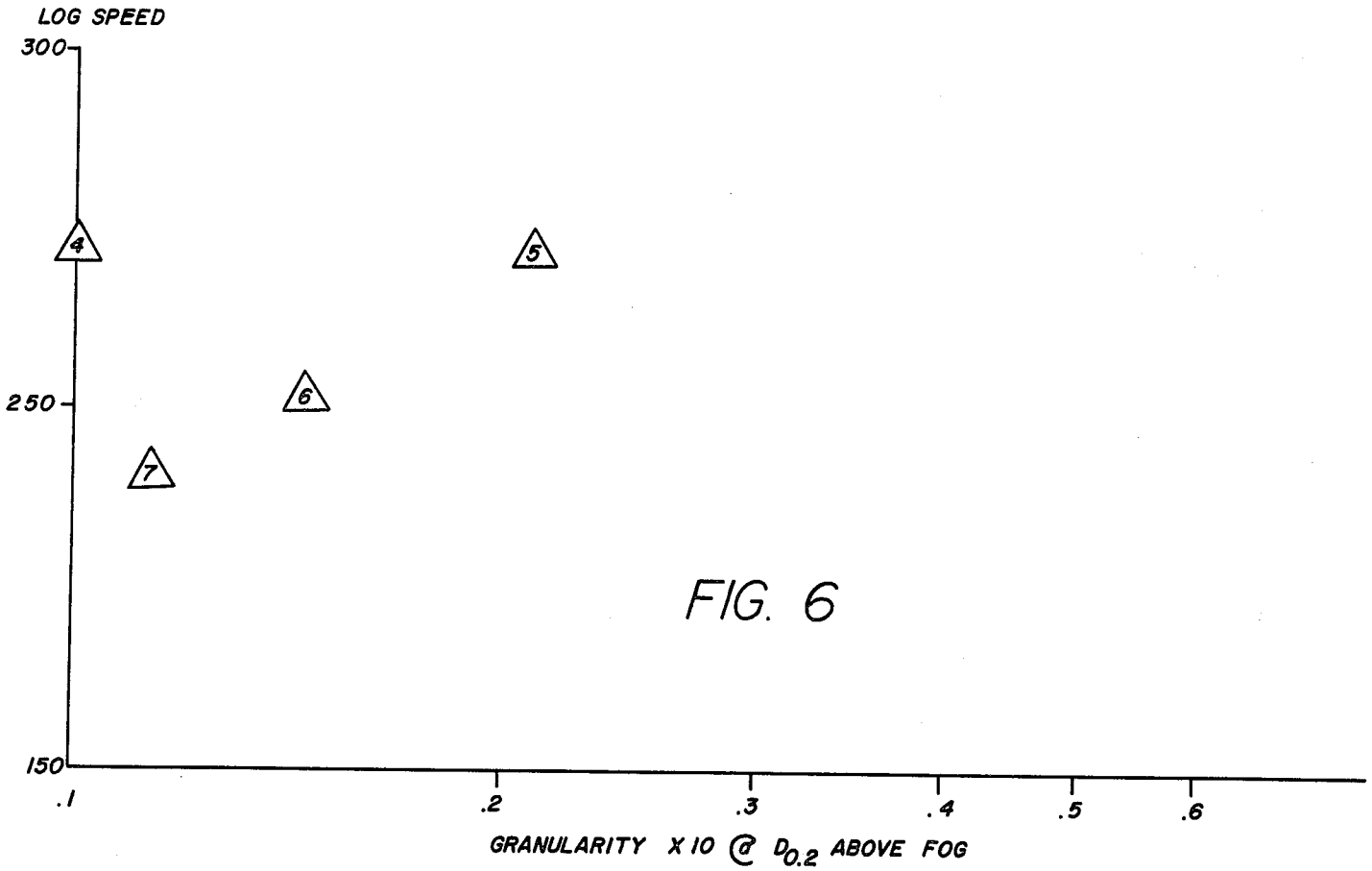

The resulting photographic elements were exposed for 1/100 of a second through a 0–3.0 density step tablet plus a Wratten No. 9 filter and a 1.26 neutral density filter, to a 600W, 3000° K. tungsten light source. The exposed elements were then developed in an N-methyl-p-aminophenol sulfate-hydroquinone (Kodak DK-50®) developer at 20° C., the low aspect ratio emulsions were developed for 5 minutes while the high aspect ratio emulsions were developed for 3½ minutes to achieve matched curve shape for the comparison. The resulting speed and granularity measurements are shown on a plot of Log Green Speed vs. rms granularity X 10 in FIG. 6. The speed-granularity relationships of Control Emulsions 5, 6, and 7 were clearly inferior to those of Emulsions 1 and 4 of this invention.

Example Relating to Group VIII Noble Metal Doped Tabular Grain Emulsion

Emulsion A

An 0.8 μm average grain size low aspect ratio (<3:1) AgBrI (1 mole percent iodide) emulsion was prepared by a double-jet precipitation technique similar to that described in Illingsworth U.S. Pat. No. 3,320,069, and had 0.12 mg/silver mole ammonium hexachlororhodate(III) present during the formation of the silver halide crystals. The emulsion was then chemically sensitized with 4.4 mg/silver mole sodium thiosulfate pentahydrate, 1.75 mg/silver mole potassium tetrachloroaurate, and 250 mg/silver mole 4-hydroxy-6-methyl-1,3-3a,7-tetraazaindene for 23 mins at 60° C. Following chemical sensitization, the emulsion was spectrally sensitized with 87 mg/silver mole anhydro-5,6-dichloro-1,3′-diethyl-3-(3-sulfopropyl)benzimidazoloxacarbocyanine hydroxide.

The low aspect ratio AgBrI emulsion was coated at 1.75 g/m$^2$ silver and 4.84 g/m$^2$ gelatin over a titanium dioxide-gelatin (10:1) layer on a paper support. The emulsion layer contained 4.65 g/silver mole 4-hydroxy-6-methyl-1,3,3a,7-tetraazaindene. An overcoat was placed on the emulsion layer, consisting of 0.85 g/m$^2$ gelatin.

Emulsion B

To 4.5 liters of a 1.5 percent gelatin, 0.17 M potassium bromide solution at 55° C., were added with stirring and by double-jet 2.34 M potassium bromide and 2.0 M silver nitrate solutions over a period of two minutes while maintaining a pBr of 0.8 (consuming 1.6 percent of the total silver used). The bromide solution was stopped and the silver solution continued for approximately 11 minutes at a rate consuming 8.5 percent of the total silver used until a pBr of 1.1 was attained. At 8 minutes into the run 0.1 mg/Ag mole (based on final weight of silver) of ammonium hexachlororhodate was added to the reaction vessel. When the pBr of 1.1 was attained, a 2.14 M potassium bromide solution which was also 0.022 M in potassium iodide was double-jetted with the silver solution for approximately 22 minutes while maintaining pBr at 1.1, in an accelerated flow (4.3X from start to finish) and consuming 77.9 percent of the total silver used. To the emulsion was added a 2.0 M $AgNO_3$ solution until a pBr of 2.7 was attained (consuming 12.0 percent of the total silver used). The total silver consumed was approximately 5 moles. The emulsion was cooled to 35° C., a solution of 200 g of phthalated gelatin in 1.0 liter of water was added and the emulsion was washed by the coagulation method.

The resulting tabular grain silver bromoiodide (1 M% iodide) emulsion had an average tabular grain diameter of 1.5 μm, an average tabular grain thickness of 0.08 μm. The tabular grains exhibited an average aspect ratio of 19:1 and accounted for 90 percent of the projected area of the total grain population, measured as described above. The tabular grain emulsion was then chemically sensitized with 5 mg/silver mole sodium thiosulfate pentahydrate and 5 mg/silver mole potassium tetrachloroaurate for 30 minutes at 65° C. to obtain an optimum finish. Following chemical sensitization, the tabular grain emulsion was spectrally sensitized with 150 mg/silver mole anhydro-5,6-dichloro-1,3'-diethyl-3-(3-sulfopropyl)-benzimidazoloxacarbocyanine hydroxide. The tabular grain emulsion, Emulsion B, was then coated in the same manner as described above for Emulsion A.

Exposure and Process

The two coatings described above were exposed on an Edgerton, Germeshausen, and Grier sensitometer at $10^{-4}$ sec using a graduated density step tablet and a 0.85 neutral density filter. The step tablet had 0–3.0 density with 0.15 density steps.

The exposed coatings were then developed in a hydroquinone-1-phenyl-3-pyrazolidone type black-and-white developer. Folllowing fixing and washing, the coatings were submitted for densitometry, the results are shown in Table VIII below:

TABLE VIII

Rhodium-Doped Tabular Grain AgBrI Emulsion versus Rhodium-Doped AgBrI Emulsion of Low Aspect Ratio

| Emulsion | Silver Coverage ($g/m^2$) | Relative Speed | Contrast | $D_{max}$ | $D_{min}$ |
|---|---|---|---|---|---|
| A Control | 1.72 | 100 | 2.28 | 1.52 | 0.06 |
| B Tabular Grain | 1.61 | 209 | 2.20 | 1.75 | 0.10 |

As illustrated in Table III, the rhodium-doped AgBrI tabular grain emulsion coated at a lower silver coverage exhibited 0.23 higher maximum density and was faster than the control by 109 relative speed units (0.32 log E). Contrast of the two coatings was nearly equivalent.

Examples Illustrating Increased Speed Separation of Spectrally Sensitized and Native Sensitivity Regions of Silver Bromoiodides Four multicolor photographic elements were prepared, hereinafter referred to as Structures I through IV. Except for the differences specifically identified below, the elements were substantially identical in structure.

| Structure I | Structure II | Structure III | Structure IV |
|---|---|---|---|
| Exposure | Exposure | Exposure | Exposure |
| ↓ | ↓ | ↓ | ↓ |
| OC | OC | OC | OC |
| B | B | B | B |
| IL + YF | IL | IL | IL + YF |
| FG | FG | TFG | TFG |
| IL | IL | IL | IL |
| FR | FR | TFR | TFR |
| IL | IL | IL | IL |
| SG | SG | SG | SG |
| IL | IL | IL | IL |
| SR | SR | SR | SR |

OC is a protective gelatin overcoat, YF is yellow colloidal silver coated at 0.69 $g/m^2$ serving as a yellow filter material, and the remaining terms are as previously defined in connection with Layer Order Arrangements I through V. The blue (B), green (G), and red (R) recording color-forming layer units lacking the T prefix contained low aspect ratio silver bromoiodide emulsions prepared as taught by Illingsworth U.S. Pat. No. 3,320,069. Corresponding layers in the separate structures were of the same iodide content, except as noted.

The faster tabular grain green-sensitive emulsion layer contained a tabular grain silver bromoiodide emulsion which had an average tabular grain diameter of 5.0μ and an average tabular grain thickness of about 0.11 μm. The tabular grains accounted for about 90 percent of the total grain projected area and exhibited an average aspect ratio of about 45:1, measured as described above. The faster green- and red-sensitive emulsion layer of Structures I and II contained 9 mole percent iodide while the faster tabular grain green- and red-sensitive emulsion layers of Structures III and IV contained 1.5 and 1.2 mole percent iodide, respectively.

The faster tabular grain green-sensitive emulsion was then optimally spectrally and chemically sensitized through the addition of 350 mg/Ag mole of anhydro-5-chloro-9-ethyl-5'-phenyl-3'-(3-sulfobutyl)-3-(3-sulfopropyl)oxacarbocyanine hydroxide, sodium salt, 101 mg/Ag mole of anhydro-11-ethyl-1,1'-bis(3-sulfopropyl)naphth[1,2-d]oxazolocarbocyanine hydroxide, sodium salt, 800 mg/Ag mole of sodium thiocyanate, 6 mg/ag mole of sodium thiosulfate pentahydrate and 3 mg/Ag mole of potassium tetrachloroaurate.

The faster tabular grain red-sensitive emulsion layer contained a tabular grain silver bromoiodide emulsion prepared and optimally sensitized in a manner similar to the tabular grain green-sensitized silver bromoiodide emulsion described directly above, differing only in that 144 mg/Ag mole of anhydro-5,6-dichloro-1-ethyl-3-(3-sulfobutyl)-3'-(3-sulfopropyl)benzimidazolonaphtho[1,2-d]-thiazolocarbocyanine hydroxide and 224 mg/Ag mole of anhydro-5,5'-dichloro-3,9-diethyl-3'-(3-sulfobutyl)thiazarbocyanine hydroxide were utilized as spectral sensitizers.

Other details relating to Structures I through IV will be readily apparent from Eeles et al U.S. Pat. No. 4,184,876.

Structures I through IV were identically neutrally exposed with a 600 watt 2850° K. source at 1/100 second using a Daylight 5 filter and a 0 to 4 density step tablet having 0.20 density steps. Separate samples of Structures I through IV were exposed as described above, but with the additional interposition of a Wratten 98 filter to obtain blue exposures. Separate samples of Structures I through IV were exposed as described above, but with the additional interposition of a Wratten 9 filter to obtain minus blue exposures. All samples were identically processed using the C-41 Color Negative Process described in *British Journal of Photography Annual,* 1979, p. 204. Development was for 3 minutes 15 seconds at 38° C. Yellow, magenta, and cyan characteristic curves were plotted for each sample. Curves from different samples were compared by matching minimum density levels—that is, by superimposing the minimum density portions of the curves.

Results are summarized in Table IX.

Table IX

| | Structures | | | |
|---|---|---|---|---|
| | I | II | III | IV |
| Green Structure Differences | FG | FG | TFG | TFG |
| Red Structure Differences | FR | FR | TFR | TFR |
| Yellow Filter | Yes | No | No | Yes |
| Log E Blue/Minus Blue Speed Differences | | | | |
| A | 1.3 | 0.55 | 0.95 | 1.75 |
| B | 1.9 | 0.95 | 1.60 | >2.40 |
| C | 1.8 | 0.95 | 1.35 | 2.25 |
| D | 2.5 | 1.55 | 2.20 | >3.10 |

A is the difference in the log of the blue speed of the blue recording color-forming unit and the log of the blue speed of the green recording color-forming unit, as determined by Equation (A) above;

$$(B_{W98}-G_{W98})-(B_N-G_N);$$

B is the difference in the log of the blue speed of the blue recording color-forming unit and the log of the blue speed of the red recording color-forming unit, as determined by Equation (B) above;

$$(B_{W98}-R_{W98})-(B_N-R_N);$$

C is the difference in the log of the green speed of the green recording color-forming unit and the log of the blue speed of the green recording color-forming unit, as determined by Equation (C) above;

$$G_{W9}-G_{W98};$$

and

D is the difference in the log of the red speed of the red recording color-forming unit and the log of the blue speed of the red recording color-forming unit, as determined by Equation (D) above, $$R_{W9}-R_{W98}.$$

In comparing Structures II and III, it can be seen that superior speed separations are obtained with Structure III employing tabular grains according to the present invention. Although Structure III did not attain the speed separations of Structure I, Structure III did not employ a yellow filter material and therefore did not encounter the disadvantages already discussed attendant to the use of such materials. Although Structure IV employed larger amounts of yellow filter material than necessary for use in the photographic elements of this invention, Structure IV does show that the speed separations of Structure III could be increased, if desired, by employing even small yellow filter densities.

A monochrome element was prepared by coating the faster green-sensitized tabular grain emulsion layer composition, described above, on a film support and overcoating with a gelatin protective layer. The blue to minus blue speed separation of the element was then determined using the exposure and processing techniques described above. The quantitative difference determined by Equation (C), $G_{W9}-G_{W98}$, was 1.28 Log E. This illustrates that adequate blue to minus blue speed separation can be achieved according to the present invention when the high aspect ratio tabular grain minus blue recording emulsion layer lies nearest the exposing radiation source and is not protected by any overlying blue absorbing layer.

Examples Relating to Improved Image Sharpness in Multilayer Photographic Elements Containing Tabular Grain Emulsions The following three examples illustrate the improved image sharpness which is achieved by the use of high aspect ratio tabular grain emulsions in photographic materials. In these examples the control elements utilize low aspect ratio silver bromoiodide emulsions of the type described in Illingsworth U.S. Pat. No. 3,320,069. For the purpose of these examples the low aspect ratio emulsions will be identified as conventional emulsions, their physical properties being described in Table X.

TABLE X

| Conventional Emulsion No. | Average Grain Diameter | Average Aspect Ratio |
|---|---|---|
| C1 | 1.1 μm | 3:1 |
| C2 | 0.4–0.8 μm | 3:1 |
| C3 | 0.8 μm | 3:1 |
| C4 | 1.5 μm | 3:1 |
| C5 | 0.4–0.5 μm | 3:1 |
| C6 | 0.4–0.8 μm | 3:1 |

Four tabular grain (high aspect ratio) silver bromoiodide emulsions were prepared by methods similar to those described in relation to speed/granularity improvements. The physical descriptions of these emulsions are described in Table XI.

TABLE XI

| Tabular Emulsion No. | Tabular Grain | | | Tabular Grain Percentage of Projected Area |
|---|---|---|---|---|
| | Average Diameter | Thickness | Average Aspect Ratio | |
| T1 | 7.0–8.0 μm | ≅0.19 μm | 35–45:1 | ≅65 |
| T2 | 3.0 μm | ≅0.07 μm | 35–45:1 | >50 |
| T3 | 2.4 μm | ≅0.09 μm | 25–30:1 | >70 |
| T4 | 1.5–1.8 μm | ≅0.06 μm | 25–30:1 | >70 |

The silver bromoiodide emulsions described above (C1–C6 and T1–T4) were then coated in a series of multilayer elements. The specific variations are shown in the tables containing the results. Although the emulsions were chemically and spectrally sensitized, sensitization is not essential to produce the sharpness results observed.

| Common Structure A |
|---|
| Overcoat Layer |
| Fast Blue-Sensitive, Yellow Dye-Forming Layer |
| Slow Blue-Sensitive, Yellow Dye-Forming Layer |
| Interlayer (Yellow Filter Layer) |
| Fast Green-Sensitized, Magenta Dye-Forming Layer |
| Interlayer |
| Fast Red-Sensitized, Cyan Dye-Forming Layer |
| Interlayer |
| Slow Green-Sensitized, Magenta Dye-Forming Layer |
| Interlayer |
| Slow Red-Sensitized, Cyan Dye-Forming Layer |
| support |

Exposure and Process

The samples were exposed and developed as described hereinafter. The sharpness determinations were made by determining the Modulation Transfer Functions (MTF) by the procedure described in *Journal of Applied Photographic Engineering,* 6 (1):1–8, 1980.

Modulation Transfer Functions for red light were obtained by exposing the multilayer coatings for 1/15 sec at 60 percent modulation using a Wratten 29 and an 0.7 neutral density filter. Green MTF's were obtained by exposing for 1/15 sec at 60 percent modulation in conjunction with a Wratten 99 filter.

Processing was through the C-41 Color Negative Process as described in *British Journal of Photography Annual* 1979, p. 204. Development time was 3½ min at 38° C. (100° F.). Following process, Cascaded Modulation Transfer (CMT) Acutance Ratings at 16 mm magnification were determined from the MTF curves.

Results

The composition of the control and experimental coatings along with CMT acutance values for red and green exposures are shown in Table XII.

TABLE XII

Sharpness of Structure A Varied in Conventional and Tabular Grain Emulsion Layer Content

| Coating No. | 1 | 2 | 3 | 4 | 5 | 6 | 7 |
|---|---|---|---|---|---|---|---|
| FY | C1 | C1 | T-1 | T-1 | T-1 | T-1 | T-1 |
| SY | C2 | C2 | T-2 | T-2 | T-2 | T-2 | T-2 |
| FM | C3 | T-3 | T-3 | T-3 | C3 | T-2 | T-2 |
| FC | C4 | C4 | C4 | C4 | C4 | C4 | T-2 |
| SM | C5 | T-4 | T-4 | C5 | C5 | C5 | C5 |
| SC | C6 | C6 | C6 | C6 | C6 | C6 | C6 |
| Red CMT Acutance | 79.7 | 78.7 | 82.7 | 84.0 | 83.1 | 85.3 | 86.3 |
| Δ CMT Units | — | −1.0 | +3.0 | +4.3 | +3.4 | +5.6 | +6.6 |
| Green CMT Acutance | 86.5 | 87.8 | 93.1 | 92.8 | 90.1 | 92.8 | 92.1 |
| Δ CMT Units | — | +2.3 | +6.6 | +6.3 | +3.6 | +6.3 | +5.6 |

Unexpectedly, as shown in Table XII, placing tabular grain emulsions in multilayer color coatings can lead to a *decrease* in sharpness. Considering Red CMT Acutance, one observes that Coating 2, containing *two* tabular grain layers, is less sharp (−1.0 CMT units) than control Coating 1, an all conventional emulsion structure. Similarly, Coating 3 (four tabular grain layers) is less sharp than Coating 4 (three tabular grain layers) by 1.3 CMT units and less sharp than Coating 5 (two tabular grain layers) by 0.4 CMT units. However, Coatings 6 and 7 demonstrate that by proper placement of specific tabular grain emulsions (note that Coating 6 is sharper in Red CMT Acutance than Coating 4 by 1.3 units) in layers nearest the source of exposing radiation, very significant improvements can be obtained over the control coating containing all conventional emulsions. As seen in the above table, Coating 6 is 6.3 green CMT units sharper than Coating 1, and Coating 7 is 6.6 Red CMT units sharper than Coating 1.

| Common Structure B |
|---|
| Overcoat Layer |
| Fast Blue-Sensitive, Yellow Dye-Forming Layer |
| Slow Blue-Sensitive, Yellow Dye-Forming Layer |
| Interlayer (Yellow Filter Layer) |
| Fast Green-Sensitized, Magenta Dye-Forming Layer |
| Slow Green-Sensitized, Magenta Dye-Forming Layer |
| Interlayer |
| Fast Red-Sensitized, Cyan Dye-Forming Layer |
| Slow Red-Sensitized, Cyan Dye-Forming Layer |
| Interlayer |
| SUPPORT |

After coating, the multicolor photographic elements of Common Structure B were exposed and processed according to the procedure described in the preceding example. The composition variations of the control and experimental coatings along with CMT acutance ratings are shown in Table XIII.

TABLE XIII

Sharpness of Structure B Varied in Conventional and Tabular Grain Emulsion Layer Content

| Coating No. | 1 | 2 | 3 | 4 |
|---|---|---|---|---|
| FY | C1 | C1 | T-1 | T-1 |
| SY | C2 | C2 | T-2 | T-2 |
| FM | C3 | T-3 | T-3 | C3 |
| SM | C5 | T-4 | T-4 | C5 |
| FC | C4 | C4 | C4 | C4 |
| SC | C6 | C6 | C6 | C6 |
| Red CMT Acutance | 80.0 | 78.4 | 83.9 | 82.8 |
| Δ CMT Units | — | −1.6 | +3.9 | +2.8 |
| Green CMT Acutance | 87.3 | 88.9 | 94.3 | 92.3 |
| Δ CMT Units | — | +1.6 | +7.0 | +5.0 |

The data presented in Table XIII illustrates beneficial changes in sharpness in photographic materials which can be obtained through the use of tabular grain emulsions lying nearest the source of exposing radiation and detrimental changes when the tabular grain emulsions in intermediate layers underlie light scattering emulsion layers.

| Common Structure C |
|---|
| Fast Magenta |
| Slow Magenta |
| ///// SUPPORT ///// |

Two monochrome elements, A (Control) and B (Example), were prepared by coating fast and slow magenta layer formulations on a film support.

TABLE XIV

| Emulsions | | |
|---|---|---|
| Element A | Element B | Layer |
| C3 | T3 | Fast Magenta |

TABLE XIV-continued

| Emulsions | | |
|---|---|---|
| Element A | Element B | Layer |
| C5 | T4 | Slow Magenta |

The monochrome elements were then evaluated for sharpness according to the method described for the previous examples, with the following results.

TABLE XV

| Element | CMT Acutance (16 mm) |
|---|---|
| A (Control) | 93.9 |
| B (Tabular Grain Emulsion) | 97.3 |

Example Illustrating Reduced High-Angle Scattering by High Aspect Ratio Tabular Grain Emulsions To provide a specific illustration of the reduced high-angle scattering of high aspect ratio tabular grain emulsions according to this invention as compared to non-tabular emulsions of the same average grain volume, the quantitative angular light scattering detection procedure described above with reference to FIG. 5 was employed. The high aspect ratio tabular grain emulsion according to the present invention consisted essentially of dispersing medium and tabular grains having an average diameter of 5.4 microns, an average thickness of 0.22 micron, and an average aspect ratio of 23.5:1. The tabular grains accounted for more than 90% of the total projected area of the grains present. The average grain volume was 5.61 cubic microns. A control nontabular emulsion was employed having an average grain volume of 5.57 cubic microns. (When resolved into spheres of the same volume—i.e., equivalent spheres—both emulsions had nearly equal grain diameters.) Both emulsions had a total transmittance of 90 percent when they were immersed in a liquid having a matching refractive index. Each emulsion was coated on a transparent support at a silver coverage of 1.08 g/m$^2$.

As more specifically set forth below in Table XVI, lower percentages of total transmitted light were received over the detection surface areas subtended by $\phi$ up to values of $\phi$ of 84° with the high aspect ratio tabular grain emulsion of this invention as compared to the control emulsion of similar average grain volume. From Table XVI it is also apparent that the collection angle for both emulsions was substantially below 6°. Thus neither emulsion would be considered a turbid emulsion in terms of its light scattering characteristics. When $\phi$ was 70° the emulsion of the present invention exhibited only half of the high-angle scattering of the control emulsion.

TABLE XVI

| | Percent of Transmitted Light Contained Within Angle Phi | | |
|---|---|---|---|
| $\phi$ | Tabular Emulsion (Example) | Nontabular Emulsion (Control) | Percent Reduction |
| 30° | 2% | 6% | 67% |
| 50° | 5% | 15% | 67% |
| 70° | 12% | 24% | 50% |
| 80° | 25% | 33% | 24% |
| 84° | 40% | 40% | 0% |

Example Illustrating Blue Spectral Sensitization of A Tabular Grain Emulsion

A tabular grain silver bromoiodide emulsion (3 M% iodide) was prepared in the following manner:

To 3.0 liters of a 1.5 percent gelatin, 0.17 M potassium bromide solution at 60° C. were added to with stirring and by double-jet, 4.34 M potassium bromide in a 3 percent gelatin solution and 4.0 M silver nitrate solution over a period of 2.5 minutes while maintaining a pBr of 0.8 and consuming 4.8 percent of the total silver used. The bromide solution was then stopped and the silver solution continued for 1.8 minutes until a pBr of 1.3 was attained consuming 4.3 percent of the silver used. A 6 percent gelatin solution containing 4.0 M potassium bromide and 0.12 M potassium iodide was then run concurrently with the silver solution for 24.5 minutes maintaining pBr 1.3 in an accelerated flow (2.0X from start to finish) (consuming 87.1 percent of the total silver used). The bromide solution was stopped and the silver solution run for 1.6 minutes at a rate consuming 3.8 percent of the total silver used, until a pBr of 2.7 was attained. The emulsion was then cooled to 35° C., 279 g of phthalated gelatin dissolved in 1.0 liters of distilled water was added and the emulsion was coagulation washed. The resulting silver bromoiodide emulsion (3 M% iodide) had an average grain diameter of about 1.0 $\mu$m, a average thickness of about 0.10 $\mu$m, yielding an aspect ratio of about 10:1. The tabular grains accounted for greater than 85% of the total projected area of the silver halide grains present in the emulsion layer. The emulsion was chemically sensitized with sodium thiocyanate, sodium thiosulfate, and potassium tetrachloroaurate.

Coating 1—A portion of the chemically sensitized emulsion was coated on a cellulose triacetate film support. This emulsion coating was comprised of tabular silver bromoiodide grains (1.08 g Ag/m$^2$) and gelatin (2.9 g/m$^2$) to which had been added the magenta dye-forming coupler 1-(6-chloro-2,4-dimethylphenyl)-3-[$\alpha$-(m-pentadecylphenoxy)-butyramido]-5-pyrazolone (0.79 g/m$^2$), 2-octadecyl-5-sulfohydroquinone (1.69 g/mole Ag), and 4-hydroxy-6-methyl-1,3,3a,7-tetraazaindene (3.62 g/Ag mole).

Coating 2—A second portion of the tabular grain silver bromoiodide emulsion was spectrally sensitized to blue light by the addition of $3\times10^{-4}$ mole/mole of silver of anhydro-5,6-dimethoxy-5-methylthio-3,3'-di(3-sulfopropyl)thiacyanine hydroxide, triethylamine salt ($\lambda$max 490 nm). The spectrally sensitized emulsion was then constituted and coated as above.

The coatings were exposed for 1/25 second through a 0–3.0 density step tablet to a 500 W 5400° K. tungsten light source. Processing was for 3 minutes in a color developer of the type described in the *British Journal of Photography Annual,* 1979, Pages 204–206.

Coating 2 exhibited a photographic speed 0.42 log E faster than Coating 1, showing an effective increase in speed attributable to blue sensitization.

Example Illustrating the Sensitization of a High Aspect Ratio Tabular Grain Silver Chloride Emulsion A high aspect ratio tabular grain silver chloride emulsion was prepared according to the teachings of Maskasky, *Silver Chloride Emulsions of Modified Crystal Habit and Processes for Their Preparation,* cited above, as follows:

In a reaction vessel was placed 2.0 liters of a solution containing 0.63 percent poly(3-thiapentylmethacrylate-co-acrylic acid-co-2-methacryloyloxyethyl-1-sulfonic acid, sodium salt) and 0.35 percent adenine. The solution was also 0.5 M in calcium chloride, and 0.0125 M in sodium bromide. The pH was adjusted to 2.6 at 55° C. To the reaction vessel were added a 2.0 M calcium chloride solution and a 2.0 M silver nitrate solution by double-jet over a period of one minute at a constant flow rate consuming 1.2 percent of the total silver used. The addition of solution was then continued for 15 minutes in an accelerated flow (2.33X from start to finish) while consuming 28.9 percent of the total silver used. The pCl was maintained throughout the preparation at the value read in the reaction vessel one minute after beginning the addition. The solutions were then added for a further 26 minutes at a constant flow rate consuming 70.0 percent of the total silver used. A 0.2 M sodium hydroxide solution was added slowly during the first one-third of the precipitation to maintain the pH at 2.6 at 55° C. A total of 2.6 moles of silver were consumed during the precipitation.

The tabular grains of the emulsion had average diameters of 4.0 to 4.5 microns, an average thickness of 0.28 micron, an approximate average aspect ratio of 15:1, and accounted for greater than 80 percent of the total projected area. The tabular grains appeared dodecahedral, suggesting the presence of {110} and {111} edges.

The tabular grain AgCl emulsion was divided into four parts. Part A was not chemically or spectrally sensitized and coated on a polyester film support at 1.07 $g/m^2$ silver and 4.3 $g/m^2$ gelatin.

Part B was sensitized in the following manner. Gold sulfide (1.0 mg/Ag mole) was added and the emulsion was held for 5 minutes at 65° C. The emulsion was spectrally sensitized with anhydro-5-chloro-9-ethyl-5'-phenyl-3,3'-bis(3-sulfopropyl)oxacarbocyanine hydroxide, sodium salt (0.75 millimole/Ag mole) for 10 minutes at 40° C. and then coated like Part A. Chemical and spectral sensitization was optimum for the sensitizers employed.

Part C and D were substantially optimally sensitized. To Part C, 0.75 millimole/Ag mole of anhydro-5-chloro-9-ethyl-5'-phenyl-3,3'-bis(3-sulfopropyl)oxacarbocyanine hydroxide, sodium salt were added and the emulsion was held for 10 minutes at 40° C. Then 3.0 mole percent NaBr was added based on total silver halide and the emulsion was held for 5 minutes at 40° C. Then $Na_2S_2O_3.5H_2O$ (5 mg/Ag mole), NaSCN (1600 mg/Ag mole), and $KAuCl_4$ (5 mg/Ag mole) were added and the emulsion was held for 5 minutes at 65° C. prior to coating. Part D was sensitized the same as Part C except that 10 mg/Ag mole of $Na_2S_2O_3.5H_2O$ were used.

The coatings were exposed for 1/50 second to a 600 W 5500° K. tungsten light source and processed for 10 minutes at 20° C. in an N-methyl-p-aminophenol sulfate (®Elon)-ascorbic acid surface developer. Sensitometric results are reported below.

TABLE XVII

| | Sensitization | Relative Speed | $D_{min}$ |
|---|---|---|---|
| Part A | None | —* | 0.05 |
| Part B | $Au_2S$ + Dye | —* | 0.05 |
| Part C | Dye + NaBr + [S + SCN + Au] | 277 | 0.06 |
| Part D | Dye + NaBr + [S + SCN + Au] | 298 | 0.13 |

TABLE XVII-continued

*Under the conditions of this experiment maximum density failed to reach the speed threshold level of 0.1 above fog. However, under varied exposure and processing conditions imaging was obtained with Parts A and B. At 365 nm exposures Parts A and B were about 2 log E (200 relative speed units) slower than Parts C and D.

Table XVII illustrates the superior speed of the emulsions substantially optimally sensitized according to the teachings of this invention.

Example Illustrating Internal Latent Image Tabular Grain Emulsion

To 5.0 liters of a 0.9 percent gelatin solution at 80° C., adjusted to a pBr of 1.3 with sodium bromide, and containing $2.44\times10^{-4}$ moles of a 0.026 μm silver iodide seed grain emulsion, were added with stirring and by double-jet a 1.25 M sodium bromide solution and a 1.25 M silver nitrate solution over a period of one minute at a rate consuming 0.1 percent of the total silver used in this precipitation. While maintaining the pBr 1.3, the sodium bromide and silver nitrate were then added over a period of 10.9 minutes in an accelerated flow (29.4X from start to finish), consuming 17.2 percent of the total silver used. While maintaining pBr 1.3, a 5.0 M sodium bromide solution and a 5.0 M silver nitrate solution where then added by double-jet for 13.9 minutes, utilizing accelerated flow (2.2X from start to finish) and consuming 68.8 percent of the total silver used. The pBr was then adjusted to 2.8 by addition of 5.0 M silver nitrate solution over a period of 4 minutes, consuming 11.0 percent of the total silver used. The emulsion was cooled to 35° C. and the pBr adjusted to 3.0, consuming 2.9 percent of the total silver used. Approximately 4 moles of silver were used in the precipitation of these grains.

The resultant tabular grain silver bromoiodide emulsion had an average grain diameter of 2.8 μm, an average thickness of 0.09 μm, and an average aspect ratio of about 31:1.

The emulsion was then chemically sensitized in the following manner. The pH was adjusted to 4.0 and the pAg to 6.0 at 35° C. Then 3.0 mg/Ag of sodium thiosulfate pentahydrate and 3.0 mg/Ag mole of potassium tetrachloroaurate were added and the emulsion was heated to 80° C. and held for 20 minutes.

At 35° C., 2.5 liters of 0.4 percent gelatin containing 0.20 silver mole of the tabular grain emulsion described above was adjusted to pH 6.0. The temperature was then increased to 80° C. and the pBr adjusted to 1.6. While maintaining this pBr, a 2.5 M sodium bromide solution and a 2.5 M silver nitrate solution were added by double-jet over a period of 28 minutes in an accelerated flow (6.6X from start to finish), consuming 78.7 percent of the total silver used during this precipitation. The silver nitrate solution was then added at a constant rate over a period of 9.5 minutes until a pBr of 3.0 was attained, consuming 21.3 percent of the total silver used. A total of approximately 0.8 mole of silver was added in this precipitation. The emulsion was cooled to 35° C., 30 grams of phthalated gelatin was added and the emulsion was coagulation washed two times.

The resultant internally sensitized tabular grain AgBrI emulsion had an average grain diameter of 5.5 μm, an average thickness of 0.14 μm, and an average aspect ratio of approximately 40:1. The tabular grains accounted for 85% of the total projected area of the silver halide grains.

The emulsion was then spectrally sensitized by the addition of 502 mg/Ag mole anhydro-5-chloro-9-ethyl-5'-phenyl-3'-(3-sulfobutyl)-3-(3-sulfopropyl)oxacarbocyanine hydroxide, sodium salt and 144 mg/Ag mole anhydro-11-ethyl-1,1'-bis-(3-sulfopropyl)naphth[1,2-d]oxazolocarbocyanine hydroxide, sodium salt. In addition, 3.0 mole percent sodium iodide based on total silver halide was added to the spectrally sensitized emulsion.

The internally sensitized tabular grain emulsion was then coated on a polyester film support at 2.15 g/m$^2$ silver and 10.4 g/m$^2$ gelatin. The coating was exposed for 1/100 second through a 0–4.0 continuous density wedge (plus Wratten 12 filter) to a 600 W 5500° K. tungsten light source and processed for 6 minutes at 20° C. in a N-methyl-p-aminophenol sulfate (®Metol)-hydroquinone developer containing potassium iodide. The resulting internal negative image displayed good discrimination with a minimum density of 0.20 and a maximum density of 1.36.

Examples to Illustrate Properties of Silver Bromides

A. Emulsion Preparations

Emulsion 1 (Example)

To 8.0 liters of a well-stirred aqueous bone gelatin (1.5 percent by weight) solution containing 0.14 molar potassium bromide were added by double-jet addition at constant flow a 1.15 molar potassium bromide and a 1.0 molar silver nitrate solution for 2 minutes at pBr 0.85 at 60° C. consuming 2.3 percent of the total silver used. A 2.0 molar silver nitrate solution was then added at constant flow for approximately 5 minutes until pBr 1.2 at 60° C. was reached consuming 5.7 percent of the total silver used. A 2.3 molar potassium bromide solution and a 2.0 molar silver nitrate solution were added by double-jet addition utilizing accelerated flow (5.6x from start to finish) for 25.6 minutes at controlled pBr 1.2 at 60° C. consuming 49.4 percent of the total silver used. Then a 2.0 molar silver nitrate solution was added at constant flow for 5.4 minutes until pAg 8.25 at 60° C. was reached consuming 7.7 percent of the total silver used. A 2.3 molar potassium bromide solution and a 2.0 molar silver nitrate solution were added by double-jet addition at constant flow for 49.4 minutes at controlled pAg 8.25 at 60° C. consuming 34.9 percent of the total silver used. Approximately 11.3 moles of silver were used to prepare this emulsion. Following precipitation the emulsion was cooled to 40° C., 2.2 liters of a phthalated gelatin (15.3 percent by weight) solution was added, and the emulsion was washed by the coagulation process of Yutzy and Russell U.S. Pat. No. 2,614,929. Then 1.9 liters of a bone gelatin (13.5 percent by weight) solution was added and the emulsion was adjusted to pH 5.5 and pAg 8.2 at 40° C.

The resultant tabular grain silver bromide emulsion had an average grain diameter of 1.67 μm, an average thickness of 0.10 μm, and an average aspect ratio of 16.7:1, and the tabular grains accounted for greater than 95 percent of the projected area.

Emulsion 2 (Example)

To 6.0 liters of a well-stirred aqueous bone gelatin (1.5 percent by weight) solution containing 0.14 molar potassium bromide were added by double-jet a 1.15 molar potassium bromide solution and a 1.0 molar silver nitrate solution for 2 minutes at constant flow at pBr 0.85 at 65° C. consuming 1.6 percent of the total silver used. Following a 0.5 minute hold at pBr 0.85 at 65° C., a 2.0 molar silver nitrate solution was added for approximately 7.5 minutes until pBr 1.23 at 65° C. was reached consuming 6.0 percent of the total silver used. A 2.3 molar potassium bromide solution and a 2.0 molar silver nitrate solution were added at controlled pBr 1.23 at 65° C. by double-jet addition for 25.5 minutes utilizing accelerated flow (5.6x from start to finish) consuming 29.8 percent of the total silver used. A 2.0 molar silver nitrate solution was added at a constant flow for approximately 6.5 minutes until pAg 8.15 at 65° C. was reached consuming 6.4 percent of the total silver used. Then a 2.3 molar potassium bromide solution and a 2.0 molar silver nitrate solution were added by double-jet for 70.8 minutes at constant flow at pAg 8.15 at 65° C. consuming 56.2 percent of the total silver used. Approximately 10 moles of silver were used to prepare this emulsion. Following precipitation the emulsion was cooled to 40° C., 1.65 liters of a phthalated gelatin (15.3 percent by weight) solution was added, and the emulsion was washed two times by the coagulation process of Yutzy and Russell U.S. Pat. No. 2,614,929. Then 1.55 liters of a bone gelatin (13.3 percent by weight) solution was added and the emulsion was adjusted to pH 5.5 and pAg 8.3 at 40° C.

The resultant tabular grain AgBr emulsion had an average grain diameter of 2.08 μm, an average thickness of 0.12 μm, and an average aspect ratio of 17.3:1, and the tabular grains accounted for greater than 95 percent of the projected area.

Emulsion 3 (Example)

To 8.0 liters of a well-stirred aqueous bone gelatin (1.5 percent by weight) solution containing 0.14 molar potassium bromide were added by double-jet addition at constant flow a 1.15 molar potassium bromide solution and a 1.0 molar silver nitrate solution for 2 minutes at controlled pBr 0.85 at 60° C. consuming 3.6 percent of the total silver used. A 2.0 molar silver nitrate solution was then added at constant flow for approximately 5 minutes until pBr 1.2 at 60° C. was reached consuming 8.8 percent of the total silver used. A 2.3 molar potassium bromide solution and a 2.0 molar silver nitrate solution were added by double-jet addition utilizing accelerated flow (5.6x from start to finish) for 25.5 minutes at controlled pBr 1.2 at 60° C. consuming 75.2 percent of the total silver used. Then a 2.0 molar silver nitrate solution was added at constant flow for 5.73 minutes until pAg 7.8 at 60° C. was reached consuming 12.4 percent of the total silver used. Approximately 7.4 moles of silver were used to prepare this emulsion. Following precipitation the emulsion was cooled to 40° C., 1.4 liters of a phthalated gelatin (15.3 percent by weight) solution were added, and the emulsion was washed by the coagulation process of Yutzy and Russell U.S. Pat. No. 2,614,919. Then 1.3 liters of a bone gelatin (13.5 percent by weight) solution were added and the emulsion was adjusted to pH 5.5 and pAg 8.2 at 40° C.

The resultant tabular grain silver bromide emulsion had an average grain diameter of 1.43 μm, an average thickness of 0.07 μm, and an average aspect ratio of 20.4:1, and the tabular grains accounted for greater than 95 percent of the projected area.

Emulsion 4 (Example)

To 4.5 liters of a well-stirred aqueous bone gelation (0.75 percent by weight) solution containing 0.14 molar potassium bromide were added by double-jet a 0.39 molar potassium bromide and a 0.10 molar silver nitrate solution for 8 minutes at constant flow at pBr 0.85 at 55° C. consuming 3.4 percent of the total silver used. Following a 0.5 minute hold at pBr 0.85 at 55° C., a 2.0 molar silver nitrate solution was added for approximately 18 minutes at constant flow until pBr 1.23 at 55° C. was reached consuming 15.4 percent of the total silver used. A 2.3 molar potassium bromide and a 2.0 molar silver nitrate solution were added at controlled pBr 1.23 at 55° C. by double-jet addition for 27 minutes utilizing accelerated flow (5.6x from start to finish) consuming 64.1 percent of the total silver used. Then a 2.0 molar silver nitrate solution was added at a constant flow for approximately 8 minutes until pAg 8.0 at 55° C. was reached consuming 17.1 percent of the total silver used. Approximately 4.7 moles of silver were used to prepare this emulsion. Following precipitation the emulsion was cooled to 40° C., 0.85 liter of a phthalated gelatin (15.3 percent by weight) solution was added, and the emulsion was washed two times by the coagulation process of Yutzy and Russell U.S. Pat. No. 2,614,929. Then 0.8 liter of a bone gelatin (13.3 percent by weight) solution was added and the emulsion was adjusted to pH 5.5 and pAg 8.3 at 40° C.

The resultant tabular grain AgBr emulsion had an average grain diameter of 2.09 μm, an average thickness of 0.08 μm, and an average aspect ratio of 26.1:1, and the tabular grains accounted for greater than 95 percent of the projected area.

Emulsion 5 (Example)

To 6.0 liters of a well-stirred aqueous bone gelatin (1.5 percent by weight) solution containing 0.14 molar potassium bromide were added by double-jet addition at constant flow a 1.15 molar potassium bromide solution and a 1.0 molar silver nitrate solution for 16 minutes at controlled pBr 0.85 at 55° C. consuming 3.4 percent of the total silver used. A 2.3 molar potassium bromide solution and a 2.0 molar silver nitrate solution were then added by double-jet addition utilizing accelerated flow (5.0x from start to finish) for approximately 25 minutes at controlled pBr 0.85 at 55° C. consuming 64.4 percent of the total silver used. A 2.0 molar silver nitrate solution was added at constant flow for approximately 15 minutes until pAg 8.0 at 55° C. was reached consuming 32.2 percent of the total silver used. Approximately 4.66 moles of silver were used to prepare this emulsion. Following precipitation the emulsion was cooled to 40° C., 0.85 liter of a phthalated gelatin (15.3 percent by weight) solution was added, and the emulsion was washed by the coagulation process of Yutzy and Russell U.S. Pat. No. 2,614,919. Then 0.8 liter of a bone gelatin (13.3 percent by weight) solution was added and the emulsion was adjusted to pH 5.5 and pAg 8.1 at 40° C.

The resultant tabular grain silver bromide emulsion had an average grain diameter of 2.96 μm, an average thickness of 0.08 μm, and an average aspect ratio of 37:1, and the tabular grains accounted for greater than 95 percent of the projected area.

Emulsion A (Control)

To 2.2 liters of a stirred aqueous phthalated gelatin (4.54 percent by weight) solution at pH 5.6 were added by double-jet addition at controlled pAg 8.3 at 70° C. an aqueous 3.5 molar potassium bromide solution and an aqueous 3.5 molar silver nitrate solution. The halide and silver salt solutions were added stepwise according to the procedure described in H. S. Wilgus DT No. 2,107,118, in seven four-minute increments with increased flows of approximately X (i.e., no flow rate increase), 2.3X, 4X, 6.3X, 9X, 12.3X and 16X ml/minute from start to finish respectively. Approximately 7.0 moles of silver were used to prepare this emulsion. Following precipitation 0.4 liter of an aqueous phthalated gelatin (10.0 percent by weight) solution was added at 40° C. and the emulsion was washed two times by the coagulation process of Yutzy and Russell U.S. Pat. No. 2,614,929. Then 2.0 liters of an aqueous bone gelatin (10.5 percent by weight) solution were added and the emulsion was adjusted to pH 5.5 and pAg 8.5 at 40° C.

Emulsion B (Control)

To 2.0 liters of an aqueous bone gelatin (1.25 percent by weight) and phthalated gelatin (3.75 percent by weight) solution were added 558 g (0.6 mole) of Emulsion A and stirred at pH 5.8. Next were added by double-jet addition at controlled pAg 8.3 at 70° C. an aqueous 3.5 molar potassium bromide solution and an aqueous 3.5 molar silver nitrate solution. The halide and silver salt solutions were added stepwise according to the procedure described in H. S. Wilgus DT 2,107,118 in seven four-minute increments with increased flows of approximately X, 1.2X, 1.5X, 1.8X, 2.0X, 2.4X, and 2.7X ml/minute from start to finish respectively. Approximately 6.4 moles of silver were used in addition to the seed grains to prepare this emulsion. Following precipitation 0.65 liter of an aqueous phthalated gelatin (10 percent by weight) solution was added at 40° C. and the emulsion was washed two times by the coagulation process of Yutzy and Russell U.S. Pat. No. 2,614,929. Then 2.0 liters of an aqueous bone gelatin (10.5 percent by weight) solution were added and the emulsion was adjusted to pH 5.5 and pAg 8.5 at 40° C.

Emulsion C (Control)

To 2.0 liters of an aqueous bone gelatin (2.8 percent by weight) and phthalated gelatin (2.2 percent by weight) solution were added 1169 g (1.3 moles) of Emulsion B and stirred at pH 5.7. Next were added by double-jet addition at controlled pAg 8.3 at 70° C. an aqueous 3.5 molar potassium bromide solution and an aqueous 3.5 molar silver nitrate solution. The halide and silver salt solutions were added stepwise according to the procedure described in H. S. Wilgus DT No. 2,107,118, in twelve four-minute increments with increased flows of approximately X, 1.2X, 1.3X, 1.5X, 1.6X, 1.8X, 1.9X, 2.1X, 2.3X, 2.5X, 2.7X, and 2.9X ml/minute from start to finish respectively. Approximately 5.7 moles of silver were used in addition to the seed grains to prepare this emulsion. Following precipitation 0.96 liter of an aqueous phthalated gelatin (10 percent by weight) solution was added at 40° C. and the emulsion was washed two times by the coagulation process of Yutzy and Russell U.S. Pat. No. 2,614,929. Then 2.0 liters of an aqueous bone gelatin (10.5 percent by weight) solution were added and the emulsion was adjusted to pH 5.5 and pAg 8.5 at 40° C.

Emulsion D (Control)

To 1.3 liters of an aqueous bone gelatin (5.07 percent by weight) solution were added 1395 g (1.4 moles) of Emulsion C and stirred at pH 5.3. Next were added by double-jet addition at controlled pAg 8.3 at 70° C. an aqueous 3.5 molar potassium bromide solution and an aqueous 3.5 molar silver nitrate solution. The halide and silver salt solutions were added by accelerated flow for 60 minutes (1.86X from start to finish) consuming 89 percent of the silver salt solution added. Then the halide and silver salt solutions were added at constant flow for 5 minutes consuming 11 percent of the silver salt solution added. Approximately 2.1 moles of silver were used in addition to the seed grains to prepare this emulsion. Following precipitation 0.70 liter of an aqueous phthalated gelatin (10 percent by weight) solution was added at 40° C. and the emulsion was washed two times by the coagulation process of Yutzy and Russell U.S. Pat. No. 2,614,929. Then 1.0 liter of an aqueous bone gelatin (10.5 percent by weight) solution was added and the emulsion was adjusted to pH 5.5 and pAg 8.5 at 40° C.

The physical characteristics of the tabular grain and the control silver bromide emulsions are summarized in Table XVIII.

TABLE XVIII

| Emulsion | Grain Shape | Average Grain Diameter | Average Grain Thickness | Aspect Ratio | Projected Area % Tabular Grains |
|---|---|---|---|---|---|
| 1 | tabular | 1.67 μm | 0.10 μm | 16.7:1 | >95 |
| 2 | " | 2.08 μm | 0.12 μm | 17.2:1 | >95 |
| 3 | " | 1.43 μm | 0.07 μm | 20.4:1 | >95 |
| 4 | " | 2.09 μm | 0.08 μm | 26.1:1 | >95 |
| 5 | " | 2.96 μm | 0.08 μm | 37:1 | >95 |
| A | octahedral | 0.27 μm | * | ≃1:1 | ** |
| B | " | 0.64 μm | * | ≃1:1 | ** |
| C | " | 1.20 μm | * | ≃1:1 | ** |
| D | " | 1.30 μm | * | ≃1:1 | ** |

*Estimated to be approximately equal to grain diameter.
**Tabular grains greater 0.6 micron in diameter were essentially absent.

B. Emulsion Sensitizations

The tabular grain AgBr emulsions and the octahedral AgBr control emulsions were optimally chemically sensitized and then optimally spectrally sensitized to the green region of the spectrum according to the conditions listed in Table XIX. All values represent mg of sensitizer/Ag mole.

TABLE XIX

| | Chemical | | Sensitization* | | Spectral Sensitization** |
|---|---|---|---|---|---|
| Emulsion | Gold | Sulfur | Thiocyanate | Hold | Dye A |
| Tabular | | | | | |
| 1 | 3.5 | 7.0 | 175 | 30' @ 70° C. | 500 |
| 2 | 5.0 | 10.0 | 175 | 10' @ 70° C. | 700 |
| 3 | 5.0 | 10.0 | 225 | 30' @ 70° C. | 750 |
| 4 | 5.0 | 10.0 | 225 | 10' @ 70° C. | 750 |
| 5 | 4.0 | 8.0 | 225 | 30' @ 70° C. | 700 |
| Control | | | | | |
| A | 10.0 | 15.0 | 800 | 30' @ 70° C. | 700 |
| B | 3.2 | 4.8 | 800 | 30' @ 70° C. | 370 |
| C | 0.9 | 1.35 | 150 | 30' @ 70° C. | 170 |
| D | 1.0 | 1.5 | 150 | 30' @ 70° C. | 80 |

*Gold = potassium tetrachloroaurate
Sulfur = sodium thiosulfate pentahydrate
Thiocyanate = sodium thiocyanate
**Dye A = anhydro-5-chloro-9-ethyl-5'-phenyl-3'-(3-sulfobutyl)-3-(3-sulfopropyl-)oxacarbocyanine hydroxide, sodium salt C. Emulsion Coatings The tabular grain and the control AgBr emulsions were separately coated in a single-layer magenta format on cellulose triacetate film support at 1.07 g silver/m$^2$ and 2.15 g gelatin/m$^2$. The coating element also contained a solvent dispersion of the magenta image-forming coupler 1-(2,4-dimethyl-6-chlorophenyl)-3-[α-(3-n-pentadecylphenoxy)butyramido]-5-pyrazolone at 0.75 g/m$^2$, the antifoggant 4-hydroxy-6-methyl-1,3,3a,7-tetraazaindene, sodium salt at 3.6 g/Ag mole, and the antistain agent potassium 5-sec.-octadecylhydroquinone-2-sulfonate at 3.5 g/Ag mole. The coatings were overcoated with a 0.51 g/m$^2$ gelatin layer and were hardened at 1.0% bis(vinylsulfonylmethyl) ether based on the total gelatin content.

D. Speed/Granularity Comparisons

The coatings were exposed for 1/100 second to a 600 W 3000° K. tungsten light source through a 0–3.0 density step tablet plus Wratten No. 9 filter and 1.2 density neutral filter. Processing was for variable times between 1½ and 6 minutes to achieve matched fog levels at 37.7° C. in a color developer of the type described in the *British Journal of Photography Annual,* 1979, pages 204–206.

Figure 7:
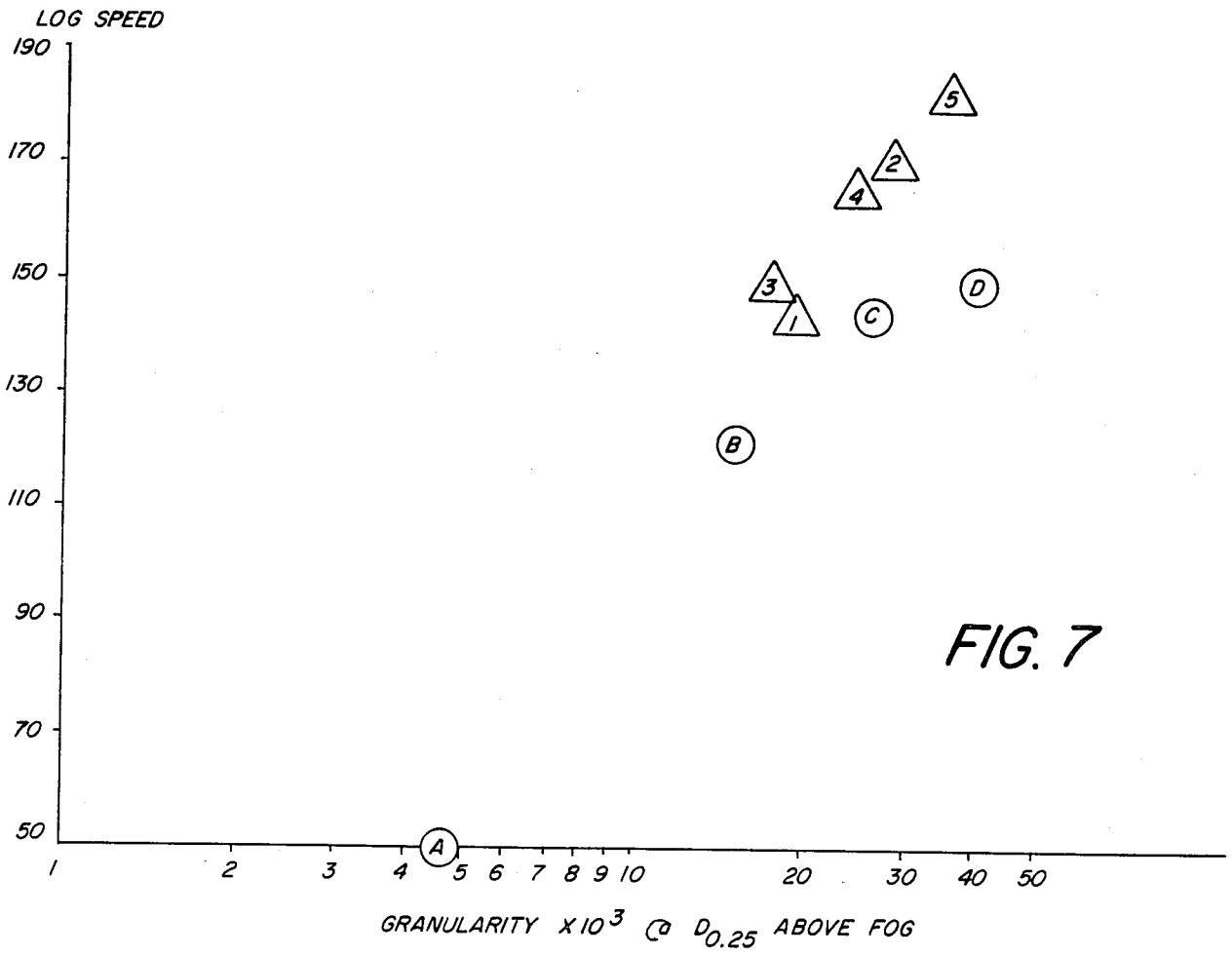

Both relative speed values and granularity measurements were independently taken at 0.25 density units above fog. A Log Green Speed vs. rms Granularity$\times 10^3$ is shown in FIG. 7. Log speed is 100 (1-log E), where E is the exposure in metercandle-seconds at a density of 0.25 above fog. As illustrated, the tabular grain AgBr emulsions consistently exhibited a superior speed-granularity relationship as compared to the nontabular control emulsions.

E. Minus Blue to Blue Speed Separation

The tabular-grain emulsions No. 1, 3, 4, and 5 were compared to the nontabular grain control emulsions A, B, and D in regard to minus blue to blue speed separation. The emulsions were optimally chemically and spectrally sensitized as described above. The emulsions were coated and processed similar to that for the speed/grain comparisons. Exposure to the blue region of the spectrum was for 1/100 second to a 600 W 5500° K. tungsten light source through a 0–3.0 density step tablet plus Wratten No. 36+38A filter. The minus blue exposure was the same except that a Wratten No. 9 filter was used in place of the Wratten No. 36+38A filter. Relative speed values were recorded at 0.25 density units above fog. Sensitometric results are given in Table XX.

TABLE XX

| Emulsion No. | Relative Blue Speed (BS) | Relative Minus Blue Speed (MBS) | Δ Speed* (MBS-BS) |
|---|---|---|---|
| Tabular No. | | | |
| 1 | 28 | 173 | 145 |
| 3 | 33 | 192 | 159 |
| 4 | 43 | 203 | 160 |
| 5 | 57 | 220 | 163 |
| Control | | | |
| A | — | 81 | >81 |
| B | 37 | 160 | 123 |
| D | 109 | 187 | 78 |

*100 = 1.00 log E

As illustrated in Table XX, the tabular grain AgBr emulsions show significantly higher blue speed and minus blue speed separation. These results demonstrate that optimally minus blue sensitized high aspect ratio tabular grain AgBr emulsions exhibit increased separation of sensitivity in the minus blue and blue spectral regions as compared to optimally sensitized nontabular grain AgBr emulsions.

Examples to Illustrate Properties of Silver Bromoiodides of Uniform Iodide Distribution

A. Emulsion Preparations

Emulsion 1 (Example)

To 30.0 liters of a well-stirred aqueous bone gelatin (0.8 percent by weight) solution containing 0.10 molar potassium bromide were added by double-jet addition at constant flow, a 1.20 molar potassium bromide and a 1.2 molar silver nitrate solution for 5 minutes at pBr 1.0 at 75° C. thereby consuming 2.40 percent of the total silver used. A phthalated gelatin solution (2.4 liters, 20 percent by weight) was added to the reaction vessel and stirred for 1 minute at 75° C. The silver nitrate solution described above was added then at constant flow rate for approximately 5 minutes until pBr 1.36 at 75° C. was reached consuming 4.80 percent of the total silver used. An aqueous solution containing potassium bromide (1.06 molar) plus potassium iodide (0.14 molar) and an aqueous solution of silver nitrate (1.2 molar) were added by double-jet addition utilizing accelerated flow (2.4X from start to finish) at pBr 1.36 at 75° C. for approximately 50 minutes until the silver nitrate solution was exhausted thereby consuming 92.8 percent of the total silver used. Approximately 20 moles of silver were used to prepare the emulsion. Following precipitation the emulsion was cooled to 35° C., 350 grams of additional phthalated gelatin were added, stirred well and the emulsion was washed three times by the coagulation process of Yutzy and Russell, U.S. Pat. No. 2,614,929. Then 2.0 liters of bone gelatin solution (12.3 percent by weight) solution were added and the emulsion was adjusted to pH 5.5 and pAg 8.3 at 40° C.

The resultant tabular grain silver bromoiodide (88:12) emulsion had an average tabular grain diameter of 2.8 μm, an average tabular grain thickness of 0.095 μm, and an average aspect ratio of 29.5:1. The tabular grains accounted for greater than 85% of the total projected area of the silver bromoiodide grains present in the emulsion.

Emulsion 2 (Example)

To 7.5 liters of a well-stirred bone gelatin (0.8 percent by weight) solution containing 0.10 molar potassium bromide were added by double jet, a 1.20 molar potassium bromide solution and a 1.20 molar silver nitrate solution at constant flow for 5 minutes at pBr 1.0/65° C. consuming 2.4 percent of the total silver used. After adding an aqueous phthalated gelatin solution (0.7 liter, 17.1 percent by weight) the emulsion was stirred for 1 minute at 65° C. A 1.20 molar silver nitrate solution was added at 65° C. until pBr 1.36 was reached consuming 4.1 percent of the total silver used. A halide solution containing potassium bromide (1.06 molar) plus potassium iodide (0.14 molar) and a 1.20 molar silver nitrate solution were added by double-jet addition utilizing accelerated flow (2X from start to finish) for 52 minutes at pBr 1.36/65° C. consuming 93.5 percent of the total silver used. Approximately 5.0 moles of silver were used to prepare this emulsion. Following precipitation the emulsion was cooled to 35° C., adjusted to pH 3.7 and washed by the process of Yutzy and Russell, U.S. Pat. No. 2,614,929. Additional phthalated gelatin solution (0.5 liter, 17.6 percent by weight) was added; after stirring for 5 minutes the emulsion was cooled again to 35° C./pH 4.1 and washed by the Yutzy and Russell process. Then 0.7 liter of aqueous bone gelatin solution (11.4 percent by weight) was added and the emulsion was adjusted to pH 5.5 and pAg 8.3 at 40° C.

The resultant tabular silver bromoiodide emulsion (88:12) had an average tabular grain diameter of 2.2 μm, an average tabular grain thickness of 0.11 μm and an average aspect ratio of 20:1. The tabular grains accounted for greater than 85% of the total projected area of the silver bromoiodide grains present in the emulsion.

Emulsion 3 (Example)

To 7.5 liters of a well-stirred bone gelatin (0.8 percent by weight) solution containing 0.10 molar potassium bromide were added by double-jet addition, a 1.20 molar potassium bromide solution and a 1.20 molar silver nitrate solution at constant flow for 5 minutes at pBr 1.0/55° C. thereby consuming 2.40 percent of the total silver used. After adding a phthalated aqueous gelatin solution (0.7 liter, 17.1 percent by weight) and stirring for 1 minute at 55° C., a 1.20 molar solution of silver nitrate was added at constant flow rate until pBr 1.36 was reached consuming 4.1 percent of the total silver used. A halide solution containing potassium bromide (1.06 molar) plus potassium iodide (0.14 molar) and a 1.20 molar silver nitrate solution were added by double-jet addition utilizing accelerated flow (2X from start to finish) for 52 minutes at pBr 1.36/55° C. consuming 93.5 percent of the total silver used. Approximately 5.0 moles of silver were used to prepare this emulsion. Following precipitation the emulsion was cooled to 35° C., adjusted to pH 3.7 and washed by the process of Yutzy and Russell, U.S. Pat. No. 2,614,929. Additional phthalated gelatin solution (0.5 liter, 17.6 percent by weight) was added; after stirring for 5 minutes the emulsion was cooled again to 35° C./pH 4.1 and washed by the Yutzy and Russell process. Then 0.7 liter of aqueous bone gelatin solution (11.4 percent by weight) and the emulsion was adjusted to pH 5.5 and pAg 8.3 at 40° C.

The resulting tabular grain silver bromoiodide (88:12) emulsion had an average tabular grain diameter of 1.7 μm, an average tabular grain thickness of 0.11 μm and an average aspect ratio of 15.5:1. The tabular grains accounted for greater than 85% of the total projected area of the silver bromoiodide grains present in the emulsion.

Emulsion 4 (Example)

To 7.5 liters of a well-stirred bone gelatin (0.8 percent by weight) solution containing 0.10 molar potassium bromide were added by double-jet addition, a 1.20 molar potassium bromide solution and a 1.20 molar silver nitrate solution at constant flow for 2.5 minutes at pBr 1.0/55° C. thereby consuming 2.40 percent of the total silver used. After adding an aqueous phthalated gelatin solution (0.7 liter, 17.1 percent by weight) and stirring for 1 minute at 55° C., a 1.20 molar solution of silver nitrate was added at a constant flow rate until pBr 1.36 was reached consuming 4.1 percent of the total silver used. A halide salt solution containing potassium bromide (1.06 molar) plus potassium iodide (0.14 molar) and a 1.20 molar silver nitrate solution were added by double-jet addition utilizing accelerated flow (2X from start to finish) for 52 minutes at pBr 1.36/55° C. consuming 93.5 percent of the total silver used. Approximately 5.0 moles of silver were used to prepare this emulsion. Following precipitation the emulsion was cooled to 35° C., adjusted to pH 3.7 and washed by the process of Yutzy and Russell, U.S. Pat. No. 2,614,929. Additional phthalated gelatin solution (0.5 liter, 17.6 percent by weight) was added and the emulsion was redispersed at pH 6.0, 40° C. After stirring for 5 minutes the emulsion was cooled again to 35° C./pH 4.1 and washed by the Yutzy and Russell process. Then 0.7 liter of aqueous bone gelatin solution (11.4 percent by weight) was added and the emulsion was adjusted to pH 5.5 and pAg 8.3 at 40° C.

The resulting tabular grain silver bromoiodide (88:12) emulsion had an average tabular grain diameter of 0.8 μm, an average tabular grain thickness of 0.08 μm and an average aspect ratio of 10:1. The tabular grains accounted for greater than 55% of the total projected area of the silver bromoiodide grains present in the emulsion.

Emulsion A (Control)

9.0 liters of an aqueous phthalated gelatin (1.07 percent by weight) solution which contained 0.045 molar potassium bromide, 0.01 molar potassium iodide, and 0.11 molar sodium thiocyanate was placed in a precipitation vessel and stirred. The temperature was adjusted to 60° C. To the vessel were added by double-jet addition a 1.46 molar potassium bromide solution which contained 0.147 potassium iodide and a 1.57 molar silver nitrate solution for 40 minutes at a constant flow rate at 60° C. consuming 4.0 moles of silver. At approximately 1 minute prior to completion of the run, the halide salt solution was halted. After precipitation, the emulsion was cooled to 33° C. and washed two times by the coagulation process described in Yutzy and Frame, U.S. Pat. No. 2,614,928. Then 680 ml of a bone gelatin (16.5 percent by weight) solution was added and the emulsion was adjusted to pH 6.4 at 40° C.

Emulsion B (Control)

This emulsion was prepared similarly as Emulsion A, except that the temperature was reduced to 50° C. and the total run time was reduced to 20 minutes.

Emulsion C (Control)

This emulsion was prepared similarly as Emulsion A, except that the temperature was reduced to 50° C. and the total run time was reduced to 30 minutes.

Emulsion D (Control)

This emulsion was prepared similarly as Emulsion A, except that the temperature was increased to 75° C. The total run time was 40 minutes.

The physical characteristics of the tabular grain and the control silver bromoiodide emulsions are summarized in Table XXI.

TABLE XXI

| Emulsion | Grain Shape | Average Grain Diameter | Average Grain Thickness | Average Aspect Ratio | Projected Area % Tabular Grains |
|---|---|---|---|---|---|
| 1 | Tabular | 2.8 μm | 0.095 μm | 29.5:1 | >85 |
| 2 | Tabular | 2.2 μm | 0.11 μm | 20:1 | >85 |
| 3 | Tabular | 1.7 μm | 0.11 μm | 15.5:1 | >85 |
| 4 | Tabular | 0.8 μm | 0.08 μm | 10:1 | >55 |
| A | Spherical | 0.99 μm | * | ≃1:1 | ** |
| B | Spherical | 0.89 μm | * | ≃1:1 | ** |
| C | Spherical | 0.91 μm | * | ≃1:1 | ** |
| D | Spherical | 1.10 μm | * | ≃1:1 | ** |

*Estimated to be approximately equal to grain diameter.
**Tabular grains greater than 0.6 micron in diameter were essentially absent.

Each of Emulsions 1 through 4 and A through D contained 88 mole percent bromide and 12 mole percent iodide. In each of the emulsions the iodide was substantially uniformly distributed within the grains.

B. Dye Imaging Results

The tabular grain and control AgBrI emulsions were optimally chemically sensitized at pAg adjusted to 8.25 at 40° C. according to the conditions listed in Table XXII. For the tabular grain emulsions spectral sensitization at pAg 9.95 at 40° C. preceded the chemical sensitization while the control emulsions were optimally spectrally sensitized after chemical sensitization without further pAg adjustment. All values represent mg of sensitizer/Ag mole.

TABLE XXII

| | Chemical Sensitization (mg/Ag mole)* | | | | Spectral Sens.** |
|---|---|---|---|---|---|
| Emulsion | Gold | Sulfur | Thiocyanate | Hold | Dye A |
| Tabular | | | | | |
| 1 | 3.0 | 9.0 | 100 | 5' @ 60° C. | 700 |
| 2 | 4.0 | 12.0 | 100 | 0' @ 60° C. | 793 |
| 3 | 4.0 | 12.0 | 100 | 0' @ 65° C. | 800 |
| 4 | 5.0 | 15.0 | 100 | 5' @ 60° C. | 900 |
| Control | | | | | |
| A | 1.0 | 2.9 | 0 | 5' @ 65° C. | 210 |
| B | 1.1 | 3.2 | 0 | 5' @ 65° C. | 290 |
| C | 0.8 | 2.4 | 0 | 5' @ 65° C. | 233 |
| D | 0.5 | 1.5 | 0 | 5' @ 65° C. | 200 |

*Gold = potassium tetrachloroaurate
Sulfur = sodium thiosulfate pentahydrate
Thiocyanate = sodium thiocyanate
**Dye A = anhydro-5-chloro-9-ethyl-5'-phenyl-3'-(3-sulfobutyl)-3-(3-sulfopropyl-)oxacarbocyanine hydroxide, sodium salt The differences in sensitization that appear in Table XXII were necessary to achieve optimum sensitization for each of the various emulsions. If the control emulsions had been chemically and spectrally sensitized identically to the tabular grain emulsions, their relative performance would have been less than optimum. To illustrate the results of identical sensitizations of the tabular grain and control emulsions, portions of Emulsion 2 and Emulsion C, hereinafter designated Emulsion 2x and Emulsion Cx, were identically chemically and spectrally sensitized as follows: Each emulsion was spectrally sensitized with 900 mg Dye A/Ag mole at pAg 9.95 at 40° C., adjusted to pAg 8.2 at 40° C. and then chemically sensitized for 20 minutes at 65° C. with 4.0 mg potassium tetrachloroaurate/Ag mole, 12.0 mg sodium thiosulfate pentahydrate/Ag mole, and 100 mg sodium thiocyanate/Ag mole.

The tabular grain and control AgBrI emulsions were separately coated in a single-layer magenta format on cellulose triacetate film support at 1.07 g silver/$m^2$ and 2.15 g gelatin/$m^2$. The coating element also contained a solvent dispersion of the magenta image-forming coupler 1-(2,4-dimethyl-6-chlorophenyl)-3-[α(3-n-pentadecylphenoxy)-butyramido]-5-pyrazolone at 0.75 g/$m^2$, the antifoggant 4-hydroxy-6-methyl-1,3,3a,7-tetraazaindene, sodium salt at 3.6 g/Ag mole, and the antistain agent potassium 5-sec.-octadecylhydroquinone-2-sulfonate at 3.5 g/Ag mole. The coatings were overcoated with a 0.51 g/$m^2$ gelatin layer and were hardened at 1.5% bis(vinylsulfonylmethyl) ether based on the total gelatin content.

The coatings were exposed for 1/100 second to a 600 W 3000° K. tungsten light source through a 0–3.0 density step tablet plus Wratten No. 9 filter and 1.8 density neutral filter. Processing was for variable times between 1½ and 6 minutes to achieve matched fog levels at 37.7° C. in a color developer of the type described in the *British Journal of Photography Annual,* 1979, pages 204–206.

Figure 8:
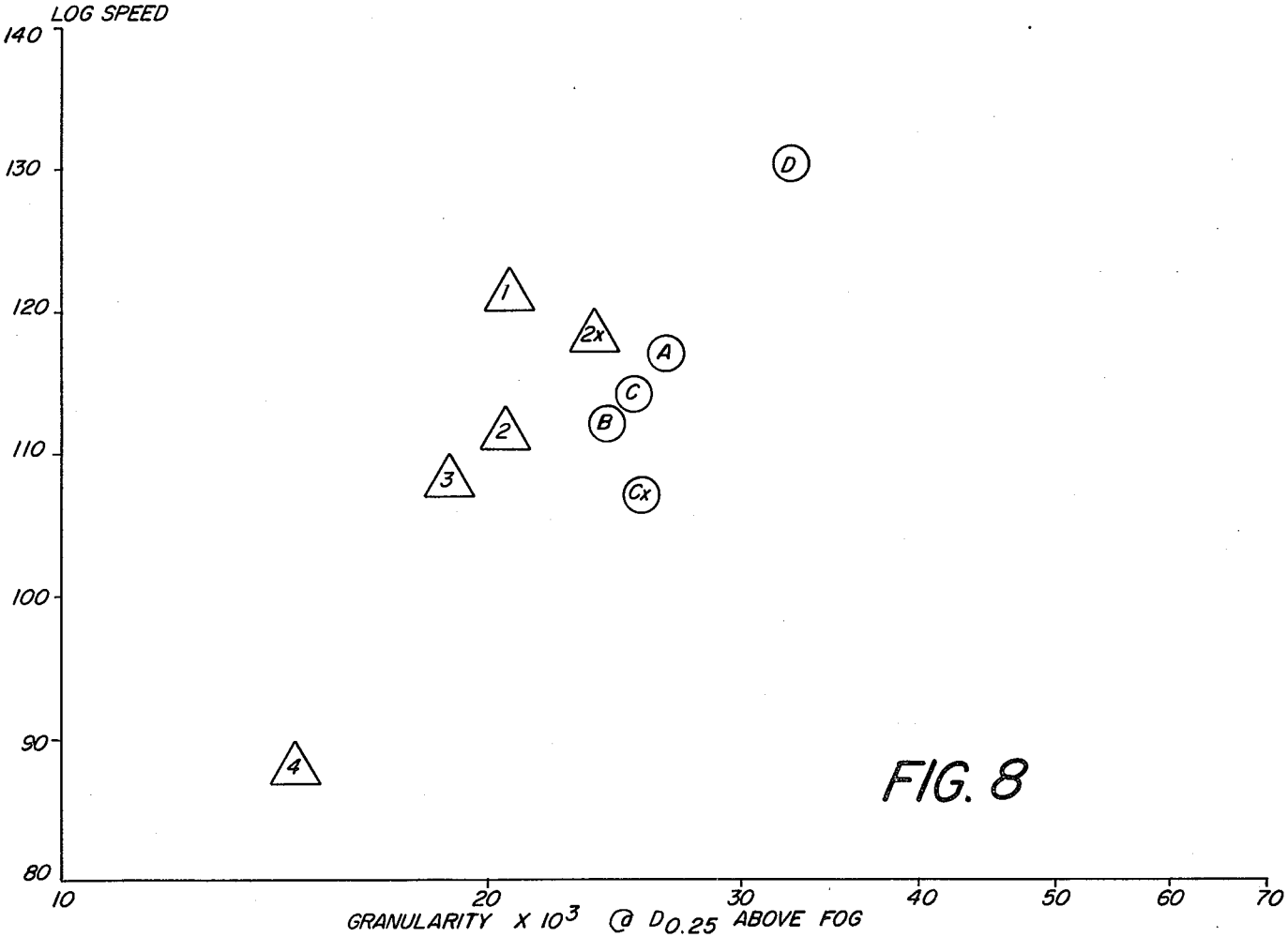

Both relative speed values and granularity measurements were independently taken at 0.25 density units above fog. A Log Green Speed vs. rms Granularity$\times 10^3$ is shown in FIG. 8. As illustrated, the tabular grain AgBrI emulsions consistently exhibited speed-granularity relationships superior to those exhibited by the control emulsions.

The speed-granularity relationships of Emulsions 2x and Cx in FIG. 8 should be particularly compared. Giving the tabular grain and control emulsions 2x and Cx identical chemical and spectral sensitizations as compared to individually optimized chemical and spectral sensitizations, as in the cae of Emulsions 2 and C, an even greater superiority in the speed-granularity relationship of Emulsion 2x as compared to that of Emulsion Cx was realized. This is particularly surprising, since Emulsions 2x and Cx exhibited substantially similar average volumes per grain of 0.418 $\mu m^3$ and 0.394 $\mu m^3$, respectively.

To compare the relative separations in minus blue and blue speeds of the example and control emulsions, these emulsions, sensitized and coated as described above, were exposed to the blue region of the spectrum was for 1/100 second to a 600 W 3000° K. tungsten light source through a 0–3.0 density step table (0.15 density steps) plus Wratten No. 36+38A filter and 1.0 density neutral filter. The minus blue exposure was the same except that a Wratten No. 9 filter was used in place of the Wratten No. 36+38A filter and the neutral filter was of 1.8 density units. Processing was for variable times between 1½ and 6 minutes at 37.7° C. in a color developer of the type described in the *British Journal of Photography Annual,* 1979, pages 204–206. Speed/fog plots were generated and relative blue and minus blue speeds were recorded at 0.20 density units above fog. Sensitometric results are given in Table XXIII.

TABLE XXIII

| Emulsion No. | Δ Speed (Minus blue speed - blue speed) |
|---|---|
| Tabular | |
| 1 | +45* |
| 2 | +42 |
| 3 | +43 |
| 4 | +37 |
| Control | |
| A | −5 |
| B | +5 |
| C | +0 |
| D | −5 |

*30 relative speed units = 0.30 Log E

As illustrated in Table XXIII the tabular grain AgBrI emulsions showed significantly greater minus blue to blue speed separation than the control emulsions of the same halide composition. These results demonstrate that optimally sensitized high aspect ratio tabular grain AgBrI emulsions in general exhibit increased sensitivity in the spectral region over optimally sensitized conventional AgBrI emulsions. If the iodide content is decreased, a much larger separation of minus blue and blue speeds can be realized, as has already been illustrated by prior examples.

Emulsions 1, 2, and 3 and Control Emulsions A, B, C and D were compared for sharpness. Sensitization, coating and processing were identical to that described above. Modulation transfer functions for green light were obtained by exposing the coatings at various times between 1/30 and ½ second at 60 percent modulation in conjunction with a Wratten No. 99 filter. Following processing, Cascaded Modulation Transfer (CMT) Acutance Ratings at 16 mm magnification were obtained from the MTF curves. The example emulsions exhibited a green CMT acutance ranging from 98.6 to 93.5. The control emulsions exhibited a green CMT acutance ranging from 93.1 to 97.6. The green CMT acutance of Emulsions 2 and C, which had substantially similar average volumes per grain, is set forth below in Table XXIV.

TABLE XXIV

| | Green CMT Acutance |
|---|---|
| Example Emulsion 2 | 97.2 |
| Control Emulsion C | 96.1 |

C. Silver Imaging Results

The control emulsions were adjusted to pH 6.2 and pAg 8.2 at 40° C. and then optimally chemically sensitized by adding sodium thiosulfate pentahydrate plus potassium tetrachloroaurate and holding the emulsions at a specified temperature for a period of time. The emulsions were spectrally sensitized by adding anhydro-5-chloro-9-ethyl-5'-phenyl-3'-(3-sulfobutyl)-3-(3-sulfopropyl)-oxacarbocyanine hydroxide, sodium salt (Dye A) and anhydro-3-ethyl-9-methyl-3'-(3-sulfobutyl)thiocarbocyanine hydroxide (Dye B) at the specified amounts. (See Table XXV for details.)

The tabular grain emulsions were spectrally sensitized by adding Dyes A and B to the emulsions at pAg 9.95 at 40° C. prior to chemical sensitization with sodium thiocyante, sodium thiosulfate pentahydrate and potassium tetrachloroaurate at a specified temperature for a period of time. (See Table XXV.)

TABLE XXV

| Emulsion | *SCN/S/Au mg/mole Ag | Time/Temp min/°C. | Dye A/Dye B mg/mole Ag | 35 mm CMT |
|---|---|---|---|---|
| 1 | 100/4.5/1.5 | 0/60 | 387/236 | 101.3 |
| 2 | 100/4.5/1.5 | 5/60 | 387/236 | 101.5 |
| 3 | 100/4.5/1.5 | 5/60 | 581/354 | 100.8 |
| 4 | 100/12/4 | 0/55 | 581/354 | 97.3 |
| A | 0/1.94/0.97 | 5/65 | 123/77 | 97.6 |
| B | 0/1.94/0.97 | 15/65 | 139/88 | 96.5 |
| C | 0/1.94/0.97 | 10/65 | 116/73 | 97.5 |
| D | 0/1.50/0.525 | 5/60 | 68.1/43 | 98.0 |

*SCN: Sodium Thiocyanate
S: Sodium Thiosulfate Pentahydrate
Au: Potassium Tetrachloroaurate The emulsions were coated at 4.3 g Ag/m$^2$ and 7.53 g gel/m$^2$ on a film support. All coatings were hardened with mucochloric acid (1.0% by wt. gel). Each coating was overcoated with 0.89 g gel/m$^2$.

The procedure for obtaining Photographic Modulation Transfer Functions is described in *Journal of Applied Photographic Engineering,* 6(1):1–8, 1980.

Modulation Transfer Functions were obtained by exposing for 1/15 second at 60 percent modulation using a 1.2 neutral density filter. Processing was for 6 minutes at 20° C. in an N-methyl-p-aminophenol sulfate-hydroquinone developer (Kodak Developer D-76®). Following processing, Cascaded Modulation Transfer (CMT) Acutance ratings at 35 mm magnification were determined from the MTF curves. (see Table XXV.)

The data in Table XXV clearly demonstrate the improvement in sharpness obtainable with tabular grain emulsions in a black-and-white format.

Figure 9:
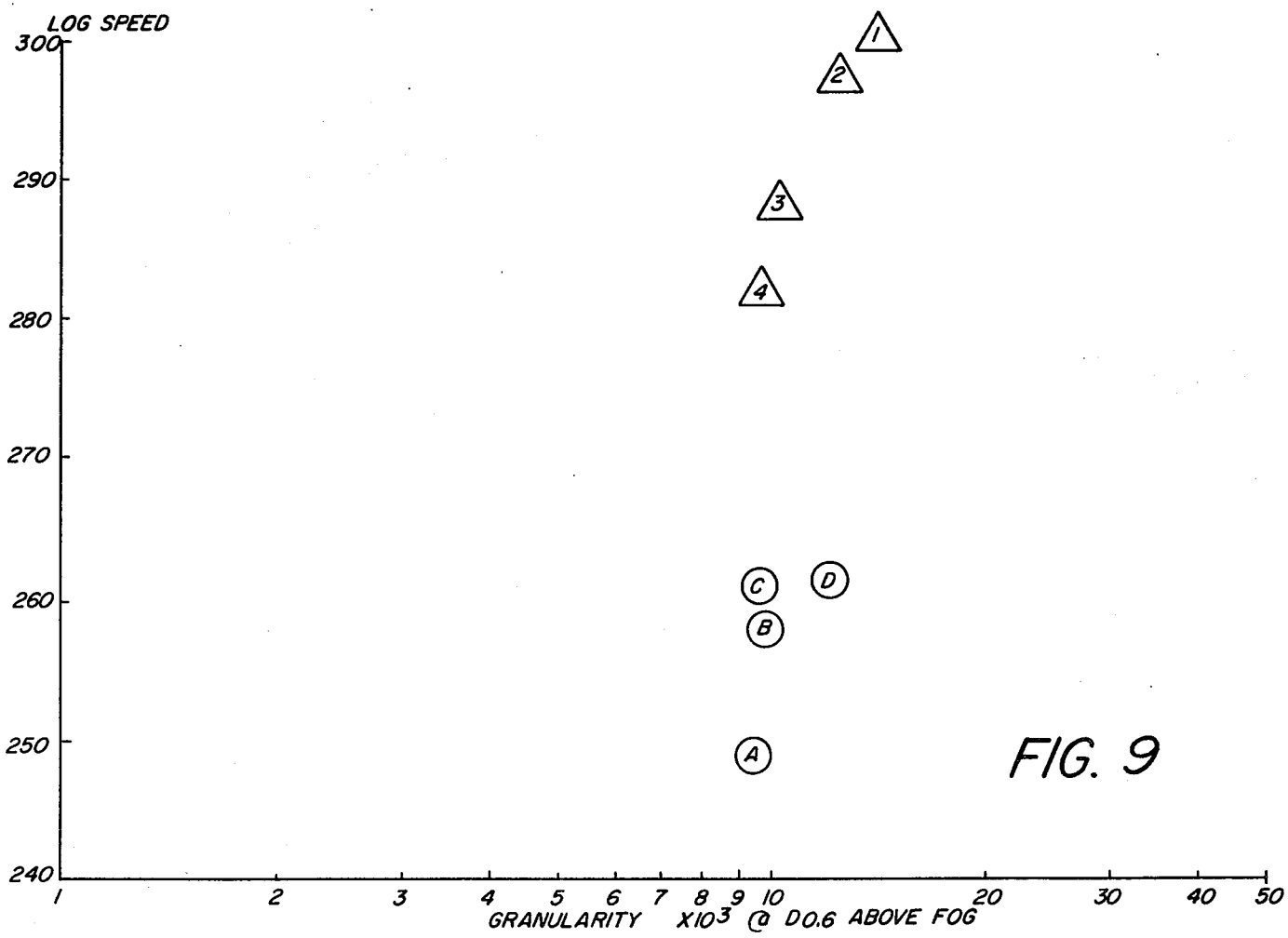

To compare silver image speed-granularity relationships, separate portions of the coatings described above were also exposed for 1/100 second to a 600 W 5500° K. tungsten light source through a 0–4.0 continuous density tablet and processed for 4, 6, and 8 minutes at 20° C. in an N-methyl-p-aminophenol sulfate-hydroquinone developer (Kodak Developer D-76®). Relative speed values were measured at 0.30 density units above fog and rms semispecular (green) granularity determinations were made at 0.6 density units above fog. A log speed vs rms semi-specular granularity plot for the 6 minute development time is given in FIG. 9. The speed-granularity relationships of the tabular grain AgBrI emulsions were clearly superior to those of the AgBrI control emulsions. Development times of 4 and 8 minutes gave similar results. In those instances in which matched contrasts were not obtained, the tabular grain emulsions had higher contrasts. This had the result of showing the tabular grain emulsions of higher contrast to have a higher granularity than would have been the case if contrasts of the emulsions had been matched. Thus, although FIG. 9 shows the tabular grain emulsions to be clearly superior to the control emulsions, to the extent the tabular grain emulsions exhibited higher contrasts than the control emulsions, the full extent of their speed-granularity relationship superiority is not demonstrated.

Example Illustrating the Performance of a 175:1 Aspect Ratio Emulsion

The high aspect ratio tabular grain silver bromoiodide emulsion employed in this example had an average tabular grain diameter of approximately 27 microns, an average tabular grain thickness of 0.156 micron, and an average aspect ratio of approximately 175:1. The tabular grains accounted for greater than 95 percent of the total projected area of the silver bromoiodide grains present.

The emulsion was chemically and spectrally sensitized by holding it for 10 min at 65° C. in the presence of sodium thiocyanate (150 mg/mole Ag), anhydro-5,5-dichloro-3,3'-bis(3-sulfopropyl)thiacyanine hydroxide, triethylamine salt (850 mg/mole Ag), sodium thiosulfate pentahydrate (1.50 mg/mole Ag) and potassium tetrachloroaurate (0.75 mg/mole Ag).

The sensitized emulsion was combined with yellow image-forming coupler α-pivalyl-α-[4-(4-hydroxybenzene-sulfonyl)phenyl]-2-chloro-5-(n-hexadecanesulfonamido)-acetanilide (0.91 g/m$^2$), 4-hydroxy-6-methyl-1,3,3a,7-tetraazaindine (3.7 g/mole Ag), 2-(2-octadecyl)-5-sulfohydroquinone, sodium salt (3.4 g/mole Ag) and coated at 1.35 g Ag/m$^2$ and 2.58 g gel/m$^2$ on 1 polyester film support. The emulsion layer was overcoated with a gelatin layer (0.54 g/m$^2$) containing bis(vinylsulfonylmethyl)ether (1.0% by weight total gel).

The dried coating was exposed (1/100 sec, 500 W, 5500° K.) through a graduated density step wedge with a 1.0 neutral density filter plus a Wratten 2B filter and processed for 4½ min/37.8° C. in a color developer of the type described in *The British Journal of Photography Annual,* 1979, pages 204–206. The element had a $D_{min}$ of 0.13, a $D_{max}$ of 1.45, and a contrast of 0.56.

The invention has been described in detail with particular reference to preferred embodiments thereof, but it will be understood that variations and modifications can be effected within the spirit and scope of the invention.

What is claimed is:

1. A radiation-sensitive high aspect ratio tabular grain silver halide emulsion comprised of a dispersing medium and silver halide grains, wherein at least 50 percent of the total projected area of said silver halide grains is provided by chemically and spectrally sensitized tabular silver halide grains having a thickness of less than 0.3 micron, a diameter of at least 0.6 micron, and an average aspect ratio of greater than 8:1.

2. A radiation-sensitive high aspect ratio tabular grain silver halide emulsion according to claim 1 wherein said silver halide grains are comprised of bromide.

3. A radiation-sensitive high aspect ratio tabular grain silver halide emulsion according to claim 2 wherein said silver halide grains are additionally comprised of iodide.

4. A radiation-sensitive high aspect ratio tabular grain silver halide emulsion according to claim 1 wherein said dispersing medium is comprised of a peptizer.

5. A radiation-sensitive high aspect ratio tabular grain silver halide emulsion according to claim 4 wherein said peptizer is gelatin or a gelatin derivative.

6. A radiation-sensitive high aspect ratio tabular grain silver halide emulsion according to claim 1 wherein said tabular silver halide grains have an average aspect ratio of at least 12:1.

7. A radiation-sensitive high aspect ratio tabular grain silver halide emulsion according to claim 1 wherein said tabular silver halide grains have an average aspect ratio of at least 20:1.

8. A radiation-sensitive high aspect ratio tabular grain silver halide emulsion according to claim 1 wherein said tabular silver halide grains account for at least 70 percent of the total projected area of said silver halide grains.

9. A radiation-sensitive high aspect ratio tabular grain silver halide emulsion according to claim 1 wherein said tabular silver halide grains account for at least 90 percent of the total projected area of said silver halide grains.

10. A radiation-sensitive high aspect ratio tabular grain silver halide emulsion according to claim 3 wherein said silver halide grains are comprised of up to 40 mole percent iodide.

11. A radiation-sensitive high aspect ratio tabular grain emulsion according to claim 1 wherein said grains are internally doped with a sensitivity modifier.

12. A radiation-sensitive high aspect ratio tabular grain emulsion according to claim 11 wherein said grains are internally doped with a Group VIII noble metal.

13. A radiation-sensitive high aspect ratio tabular grain emulsion according to claim 2 wherein said grains are surface chemically sensitized with noble metal sensitizer, middle chalcogen sensitizer, reduction sensitizer, or a combination of said sensitizers.

14. A radiation-sensitive high aspect ratio tabular grain emulsion according to claim 13 wherein said grains are chemically sensitized in the presence of a ripening agent.

15. A radiation-sensitive high aspect ratio tabular grain emulsion according to claim 14 wherein said grains are chemically sensitized in the presence of a sulfur containing ripening agent.

16. A radiation-sensitive high aspect ratio tabular grain emulsion according to claim 1 wherein said tabular grains are substantially optimally chemically and spectrally sensitized to at least 60 percent of the maximum log speed attainable from the grains in the spectral region of sensitization.

17. A radiation-sensitive high aspect ratio tabular grain silver bromide emulsion comprised of gelatin or a gelatin derivative peptizer and silver bromide grains, wherein at least 70 percent of the total projected area of said silver bromide grains is provided by substantially optimally chemically and spectrally sensitized tabular silver bromide grains having a thickness of less than 0.3 micron, a diameter of at least 0.6 micron, and an average aspect ratio of at least 12:1.

18. A radiation-sensitive high aspect ratio tabular grain silver bromiodide emulsion comprised of gelatin or a gelatin derivative peptizer and silver bromoiodide grains comprised of from 0.1 to 20 mole percent iodide, wherein at least 70 percent of the total projected area of said silver bromoiodide grains is provided by substantially optimally chemically and spectrally sensitized tabular silver bromoiodide grains having a thickness of less than 0.3 micron, a diameter of at least 0.6 micron, and an average aspect ratio of at least 12:1.

19. A radiation-sensitive high aspect ratio tabular grain silver bromide or bromoiodide emulsion comprised of gelatin or a gelatin derivative peptizer, silver bromide or bromoiodide grains, wherein at least 50 percent of the total projected area of said silver bromide or bromoiodide grains is provided by substantially optimally chemically sensitized tabular silver bromide or bromoiodide having a thickness of less than 0.5 micron, a diameter of at least 0.6 micron, and an average aspect ratio of greater than 8:1, and a blue sensitizer adsorbed to the surface of said silver bromide or bromoiodide grains.

20. A radiation-sensitive high aspect ratio tabular grain silver bromide or bromoiodide emulsion according to claim 19 wherein at least one blue spectral sensitizer is employed chosen from the class consisting of cyanine, merocyanine, hemicyanine, hemioxonol, and merostyryl sensitizing dyes.

21. A radiation-sensitive high aspect ratio tabular grain silver bromide or bromoiodide emulsion according to claim 19 wherein said tabular silver bromide or bromoiodide grains have an average aspect ratio of at least 12:1.

22. A radiation-sensitive high aspect ratio tabular grain silver bromoiodide emulsion comprised of gelatin or a gelatin derivative peptizer and silver bromoiodide grains comprised of up to 40 mole percent iodide, wherein the tabular silver bromoiodide grains having a thickness of less than 0.3 micron and a diameter of at least 0.6 micron have an average aspect ratio of at least 12:1, account for at least 50 mole percent of the total projected area of said bromoiodide grains, and are substantially optimally chemically sensitized with gold in combination with at least one of sulfur and selenium in the presence of a thiocyanate ripening agent and with a spectral sensitizing dye having an absorption peak in the minus blue region of the spectrum.

23. A radiation-sensitive high aspect ratio tabular grain silver bromoiodide emulsion according to claim 22 wherein said silver bromoiodide grains are comprised of from 0.1 to 20 mole percent iodide.

24. A radiation-sensitive high aspect ratio tabular grain silver bromoiodide emulsion according to claim 23 wherein said tabular grains have an average aspect ratio of from 20:1 to 100:1.

25. A radiation-sensitive high aspect ratio tabular grain silver bromoiodide emulsion according to claim 22 wherein said grains are chemically sensitized in the presence of least a portion of said spectral sensitizing dye.

26. A radiation-sensitive high aspect ratio tabular grain silver bromoiodide emulsion according to claim 22 wherein additional silver halide is present on the surface of said silver bromoiodide grains in an amount sufficient to increase sensitivity.

27. A radiation-sensitive high aspect ratio tabular grain silver bromide or bromoiodide emulsion comprised of gelatin or a gelatin derivative peptizer and silver bromide or bromoiodide grains, wherein tabular silver bromide or bromoiodide grains having a thickness of less than 0.3 micron and a diameter of at least 0.6 micron have an average aspect ratio of at least 12:1, account for at least 50 mole percent of the total projected area of said silver bromide or bromoiodide grains, contain rhodium incorporated as a dopant in a contrast increasing amount, and are substantially optimally chemically sensitized with gold in combination with at least one of sulfur and selenium in the presence of a thiocynate ripening agent and substantially optimally spectrally sensitized with a spectral sensitizing dye.

28. In a photographic element comprised of a support and at least one radiation-sensitive emulsion layer, the improvement wherein said emulsion layer is comprised of an emulsion according to claim 1, 2, 3, 4, 5, 6, 7, 8, 9, 10, 11, 12, 13, 14, 15, 16, 17, 18, 19, 20, 21, 22, 23, 24, 25, 26, or 27.

29. In a photographic element comprised of a support and, located thereon, a first silver halide emulsion layer positioned to receive substantially specularly transmitted light, and a second silver halide emulsion layer positioned to receive light transmitted through said first silver halide emulsion layer, the improvement wherein, said first silver halide emulsion layer contains chemically and spectrally sensitized tabular silver halide grains having a thickness of less than 0.5 micron, a diameter of at least 0.6 micron, an average aspect ratio of at least 12:1, and an average diameter of at least 1.0 micron, which account for at least 70 percent of the total projected area of the silver halide grains present in said first emulsion layer.

30. An improved photographic element according to claim 29 wherein said tabular silver halide grains have an average diameter of at least 2 microns.

31. In a black-and-white photographic element capable of producing a viewable silver image comprised of a support and, located thereon, at least one chemically and spectrally sensitized emulsion layer containing silver halide grains in a dispersing medium, the improvement wherein, tabular silver halide grains having a thickness of less than 0.3 micron, a diameter of at least 0.6 micron, and an average aspect ratio of at least 12:1 account for at least 50 percent of the total projected area of said silver halide grains grains and are substantially optimally chemically sensitized and orthochromatically or panchromatically spectrally sensitized.

32. An improved black-and-white photographic element according to claim 31 wherein the emulsion layer is positioned to receive during imagewise exposure light that is free of significant scattering in an overlying light transmissive layer.

33. An improved black-and-white photographic element according to claim 32 wherein said emulsion layer is the outermost emulsion layer of the photographic element.

34. An improved black-and-white photographic element according to claim 31 wherein the emulsion layer is positioned to receive during imagewise exposure light that falls within a collection angle of less than 10 degrees.

35. An improved black-and-white photographic element according to claim 31 wherein said silver halide grains are comprised of silver bromoiodide chemically sensitized with gold and at least one of sulfur and selenium in the presence of a thiocyanate ripening agent.

36. In a multicolor photographic element comprised of a support and, located thereon, emulsion layers for separately recording blue, green, and red light each comprised of a dispersing medium and silver halide grains, said green and red recording emulsion layers containing green and red spectral sensitizing dyes, respectively, the improvement wherein in at least one of said green and red recording emulsion layers contain chemically and spectrally sensitized tabular silver halide grains having a thickness of less than 0.3 micron, a diameter of at least 0.6 micron, and an average aspect ratio of greater than 8:1 accounting for at least 50 percent of the total projected area of said silver halide grains present in the same emulsion layer.

37. An improved multicolor photographic element according to claim 36 wherein one of said emulsion layers containing said tabular silver halide grains is positioned to receive exposing radiation prior to remaining emulsion layers of said multicolor photographic element.

38. An improved multicolor photographic element according to claim 36 wherein one of said emulsion layers containing said tabular silver halide grains is positioned to receive substantially specularly transmitted light and overlies at least one other emulsion layer of said multicolor photographic element.

39. An improved multicolor photographic element according to claim 38 wherein said tabular silver halide grains of said one emulsion layer have an average diameter of at least 2 microns.

40. An improved multicolor photographic element according to claim 36 wherein said blue recording emulsion layer is comprised of chemically and spectrally sensitized tabular silver halide grains having a thickness of less than 0.5 micron and a diameter of at least 0.6 micron having an average aspect ratio of greater than 8:1 and accounting for at least 50 percent of the total projected area of said silver halide grains present in the same emulsion layer.

41. An improved multicolor photographic element according to claim 36 wherein at least one of said green and red recording emulsion layers containing tabular grains is comprised of silver bromide or bromoiodide.

42. An improved multicolor photographic element according to claim 41 wherein said silver bromide or bromoiodide grains are substantially optimally chemically sensitized.

43. In a multicolor photographic element comprised of a film support and, located thereon, emulsion layers for separately recording blue, green, and red light each comprised of a dispersing medium and silver halide grains, said green and red recording emulsion layers containing green and red spectral sensitizing dyes, respectively, the improvement wherein tabular silver bromoiodide grains in at least one of said green and one of said red recording emulsion layers having a thickness of less than 0.3 micron, a diameter of at least 0.6 micron, and an average aspect ratio of at least 12:1, account for at least 70 percent of the total projected area of said silver halide grains present in the same emulsion layer and are surface chemically sensitized with gold and at least one of sulfur and selenium.

44. An improved multicolor photographic element according to claim 43 wherein said tabular silver bromoiodide grains are substantially optimally chemically sensitized in the presence of a sulfur containing ripening agent.

45. An improved multicolor photographic element according to claim 44 wherein said sulfur containing ripening agent is a thiocyanate.

46. In a multicolor photographic element comprised of a support and, located thereon, emulsion layers for separately recording blue, green, and red light each comprised of a dispersing medium and silver halide grains, said green and red recording emulsion layers containing green and red spectral sensitizing dyes, respectively, and being chemically sensitized, the improvement wherein at least one of said green and red recording emulsions layers contain tabular silver halide grains having a thickness of less than 0.30 micron, a diameter of at least 0.6 micron, and an average aspect ratio of at least 12:1, accounting for at least 70 percent of the total projected area of said silver halide grains in the same emulsion layer, and the halide of said tabular grains consisting essentially bromide and, optionally, iodide, and at least one of said tabular grain containing emulsion layers is positioned to receive during exposure of the photographic element at a color temperature of 5500° K., blue light in addition to light the layer is intended to record, and Δlog E for said emulsion layer being less than 0.6, where $$\Delta\log E = \log E_T - \log E_B$$

log $E_T$ being the log of exposure to red or green light said tabular grain containing emulsion layer is intended to record and log $E_B$ being the log of concurrent exposure to blue light of said tabular grain containing emulsion layer.

47. A multicolor photographic element according to claim 46 in which said element is substantially free of yellow filter material interposed between exposing radiation incident upon said element and at least one of said tabular grain containing emulsion layers.

48. A multicolor photographic element according to claim 46 in which at least one of said layers containing tabular grains is positioned to receive exposing radiation prior to said blue recording emulsion layer.

49. A multicolor photographic element according to claim 46 in which at least one of said layers containing said tabular grains is positioned to receive exposing radiation prior to all other silver halide emulsion layers of said photographic element.

50. A multicolor photographic element according to claim 46 in which said tabular grains are present in said green recording emulsion layer.

51. A multicolor photographic element according to claim 46 in which said tabular grains are present in said red recording emulsion layer.

52. A multicolor photographic element according to claim 46 in which said tabular grains are present in each of said green and red recording emulsion layers.

53. In a multicolor photographic element comprised of a film support and, located thereon, color-forming layer units for separately recording blue, green, and red light, said color-forming layer units being chosen so that when said photographic element is exposed at a color temperature of 5500° K. through a spectrally non-selective step wedge and processed said photographic element exhibits, in relation to blue contrast and speed, green and red contrast variations of less than 20 percent and green and red speed variations of less than 0.3 log E, using blue, green, and red densities determined according to American Standard PH2.1-1952, each of said color-forming layer units including at least one emulsion layer comprised of a dispersing medium and silver halide grains, said silver halide grains of a triad of said emulsion layers for separately recording blue, green, and red light being positioned to receive exposing radiation prior to any remaining emulsion layers and having an average diameter of at least 0.7 micron, the improvement wherein tabular silver bromoiodide grains in said green and red recording emulsion layers of said triad having a thickness of less than 0.3 micron, a diameter of at least 0.6 micron, and an average aspect ratio of at least 12:1, account for at least 70 percent of the total projected area of said silver bromoiodide grains present in the same emulsion layer, and are surface chemically sensitized with gold and at least one of sulfur and selenium, and said element is substantially free of yellow filter material interposed between exposing radiation incident upon said element and said red and green recording emulsion layers of said triad.

54. A multicolor photographic element according to claim 53 in which each of said green and red recording color-forming layer units of said triad exhibits a minus blue speed which is at least 10 times greater than its blue speed.

55. A multicolor photographic element according to claim 54 in which each of said green and red recording color-forming layer units of said triad exhibits a minus blue speed which is at least 20 times greater than its blue speed.

56. A multicolor photographic element according to claim 53 in which the blue speed of the blue record produced by said element is at least 6 times greater than the blue speed of the minus blue record produced by said element.

57. A multicolor photographic element according to claim 56 in which the blue speed of the blue record produced by said element is at least 8 times greater than the blue speed of the minus blue record produced by said element.

58. A multicolor photographic element according to claim 53 in which said color-forming layer units for separately recording blue, green, and red light contain yellow, magenta, and cyan dye-forming couplers, respectively.

59. A multicolor photographic element according to claim 58 in which the blue recording emulsion layer of said triad contains a higher mole percentage of iodide than said green and red emulsion layers of said triad.

60. A multicolor photographic element according to claim 53 in which one of said green and red recording emulsion layers of said triad is located to receive substantially all exposing radiation directed toward said photographic element.

61. A multicolor photographic element comprised of a film support and, located thereon, color-forming layer units for separately recording blue, green, and red light containing yellow, magenta, and cyan dye image formers, respectively, and each containing at least one silver halide emulsion layer, said color-forming layer units being chosen so that when said photographic element is exposed at a color temperature of 5500° K. through a spectrally non-selective step wedge and processed said photographic element exhibits, in relation to blue contrast and speed, green and red contrast variations of less than 20 percent and green and red speed variations of less than 0.3 log E, using blue, green, and red densities determined according to the American Standard PH2.1-1952, a triad of said emulsion layers for separately recording blue, green, and red light being positioned to receive exposing ratiation prior to any remaining emulsion layers, at least one of said green and red recording emulsion layers of said triad being positioned to receive substantially specularly transmitted exposing radiation prior to at least one other emulsion layer and, during exposure of the photographic element at a color temperature of 5500° K., blue light in addition to light the layer is intended to record, Δlog E for said emulsion layer being less than 0.6, where $$\Delta\log E = \log E_T - \log E_B$$

log $E_T$ being the log of exposure to red or green light said emulsion layer is intended to record and log $E_B$ being the log of concurrent exposure of said emulsion layer to blue light, and containing silver bromoiodide grains having an average diameter of at least 1.0 micron including substantially optimally chemically and spectrally sensitized tabular silver bromoiodide grains having a thickness of less than 0.3 micron, a diameter of at least 0.6 micron, and an average aspect ratio of at least 12:1 accounting for at least 70 percent of the total projected area of said silver bromoiodide grains.

62. A process of producing a viewable photographic image by processing in an aqueous alkaline solution in the presence of a developing agent an imagewise exposed photographic element according to claim 28.

63. A process of producing a viewable photographic image by processing in an aqueous alkaline solution in the presence of a developing agent an imagewise exposed photographic element according to claim 29, 30, 31, 32, 33, 34, or 35.

64. A process of producing a viewable multicolor image by processing in an aqueous alkaline solution in the presence of a developing agent an imagewise exposed photographic element according to claim 36, 37, 38, 39, 40, 41, 42, 43, 44, 45, 46, 47, 48, 49, 50, 51, 52, 53, 54, 55, 56, 57, 58, 59, 60, or 61.

* * * * *